United States Patent [19]

Hiyoshi et al.

[11] 4,184,401

[45] Jan. 22, 1980

[54] ELECTRONIC MUSICAL INSTRUMENT WITH AUTOMATIC BASS CHORD PERFORMANCE DEVICE

[75] Inventors: Teruo Hiyoshi; Akira Nakada; Shigeru Yamada; Eiichiro Aoki; Eiichi Yamaga, all of Hamamatsu, Japan

[73] Assignee: Nippon Gakki Seizo Kabushiki Kaisha, Hamamatsu, Japan

[21] Appl. No.: 825,443

[22] Filed: Aug. 17, 1977

[30] Foreign Application Priority Data

Aug. 23, 1976 [JP] Japan ..... 51-100354
Sep. 8, 1976 [JP] Japan ..... 51-107445

[51] Int. Cl.[2] ..... G10H 1/00; G10H 5/00

[52] U.S. Cl. ..... 84/1.03; 84/1.17; 84/1.01; 84/DIG. 12; 84/DIG. 22; 84/DIG. 25

[58] Field of Search ..... 84/1.03, 1.17, DIG. 12, 84/DIG. 22, DIG. 25, 1.01, 1.24

[56] References Cited

U.S. PATENT DOCUMENTS

| | | | |
|---|---|---|---|
| 3,708,602 | 1/1973 | Hiyama | 84/1.17 |
| 3,708,604 | 1/1973 | Hebeisen | 84/1.03 |
| 3,889,568 | 6/1975 | Amaya | 84/1.03 |
| 3,918,341 | 11/1975 | Bunger | 84/1.17 |
| 3,921,491 | 11/1975 | Freeman | 84/1.17 |
| 3,955,460 | 5/1976 | Southard | 84/1.17 |
| 4,059,039 | 11/1977 | Carlson | 84/1.17 |
| 4,065,993 | 1/1978 | Hirose | 84/1.03 |
| 4,072,078 | 2/1978 | Shallenberger | 84/DIG. 22 |
| 4,120,225 | 10/1978 | Dietrich | 84/DIG. 22 |
| 4,127,048 | 11/1978 | Schmoll | 84/1.24 |

*Primary Examiner*—Gene Z. Rubinson
*Assistant Examiner*—William L. Feeney
*Attorney, Agent, or Firm*—Spensley, Horn, Jubas & Lubitz

[57] ABSTRACT

An electronic musical instrument comprises an upper keyboard channel, a lower keyboard channel and a pedal keyboard channel. The lower keyboard channel includes a tone gate which is actuated by a chord rhythm pattern pulse generated by an automatic rhythm generator to gate the lower keyboard tones. The pedal keyboard channel includes a root/subordinate tone generator which provide a root tone designated by the depressed pedal key and subordinate tones related to the root tone with predetermined musical intervals, and a tone keyer which is actuated by a bass rhythm pattern pulse generated by the automatic rhythm generator to gate the bass tones.

27 Claims, 19 Drawing Figures

TONE GENERATOR
13
11
UPPER KEYBOARD CIRCUIT
14
TONE FILTER
12
LOWER KEYBOARD CIRCUIT
15
TONE FILTER
17
TONE GATE
CHORD TYPE DETECTION
23
CG
22'
22
25
TONE SELECTION
TONE KEYER
TONE FILTER
20
ROOT/SUBORDI-NATE TONE GENERATION
21
16
24
SOUND SYSTEM
19
PEDAL KEYBOARD
RYTHM GENERATION
18

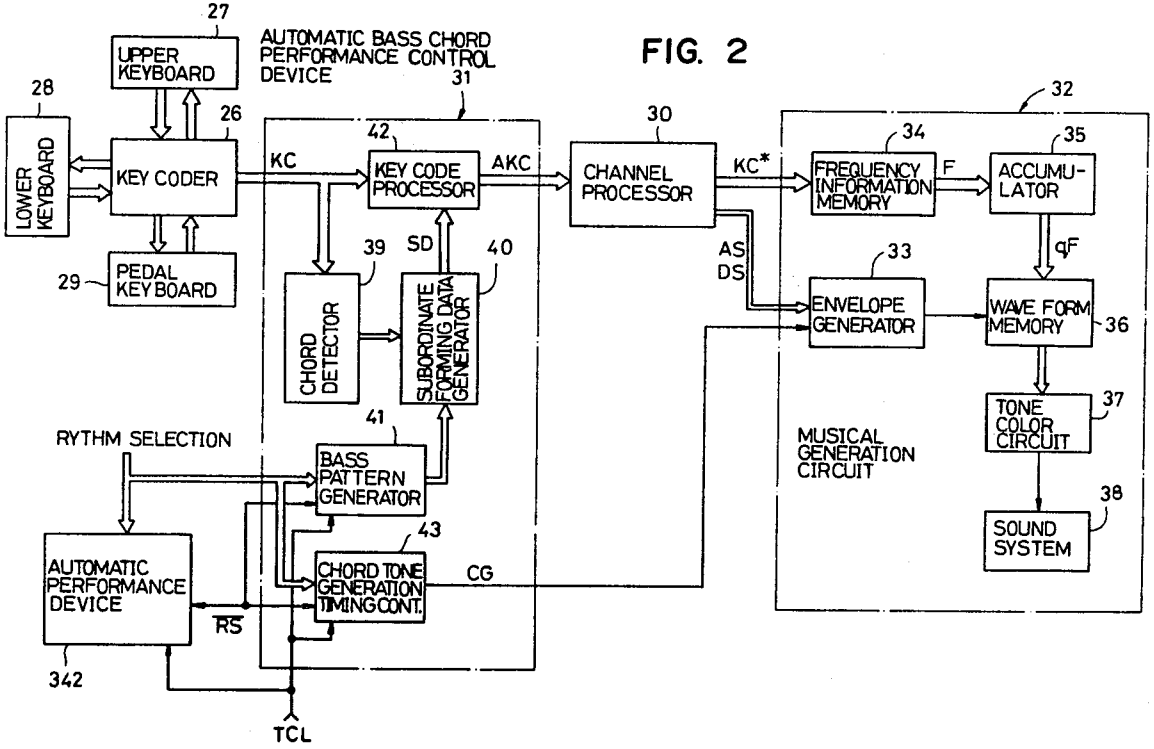
FIG. 2
AUTOMATIC BASS CHORD PERFORMANCE CONTROL DEVICE
31
UPPER KEYBOARD
27
LOWER KEYBOARD
28
KEY CODER
26
PEDAL KEYBOARD
29
KC
KEY CODE PROCESSOR
42
AKC
CHORD DETECTOR
39
SD
SUBORDINATE FORMING DATA GENERATOR
40
BASS PATTERN GENERATOR
41
CHORD TONE GENERATION TIMING CONT.
43
CG
RS
TCL
RYTHM SELECTION
AUTOMATIC PERFORMANCE DEVICE
342
CHANNEL PROCESSOR
30
KC*
AS
DS
32
FREQUENCY INFORMATION MEMORY
34
F
ACCUMU-LATOR
35
ENVELOPE GENERATOR
33
qF
WAVE FORM MEMORY
36
TONE COLOR CIRCUIT
37
SOUND SYSTEM
38
MUSICAL GENERATION CIRCUIT

ELECTRONIC MUSICAL INSTRUMENT WITH AUTOMATIC BASS CHORD PERFORMANCE DEVICE

BACKGROUND OF THE INVENTION

This invention relates to an improvement of an electronic musical instrument capable of automatically processing the performance of bass tones and chord tones.

In a prior art electronic musical instrument, in order to automatically perform base tones, a plurality of keys on the manual keyboard section are depressed according to chords, and the chords are judged from the depressed keys thereby producing tones, one after another, according to a predetermined rhythm, by utilizing the root note tone and the subordinate note tones of the chord as the bass tones. At this time, the tones of the plurality of selected keys are also generated simultaneously as the chord tones at a desired timing. For this reason, where a desired chord is selected at the keyboard section, the chord tones and the bass tones are simultaneously produced. However, since the relationship between the chord tone performance and the bass tone performance is determined by operation of a single keyboard, there is a defect that the musical interest decreases greatly.

SUMMARY OF THE INVENTION

Accordingly, it is an object of this invention to provide an improved electronic musical instrument capable of independently and automatically performing the bass tones and the chord tones thereby expanding the scope of performance available for the player so as to increase the performance characteristics of the musical instrument.

According to this invention, the automatic performance can be achieved by using independent keyboards for the chord tones and the bass tones. For the sake of description, the keyboard for performing the chord tones is hereinafter termed a "chord tone performance keyboard" and the keyboard for performing the bass tones a "bass tone performance keyboard". One or more tones selected on the chord tone performance keyboard according to a chord are automatically generated as chord tones at desired timings, and a single tone selected on the bass tone performance keyboard is utilized in the bass tone performance as the root tone thereby producing one or more subordinate tones having predetermined note intervals with reference to the root tone by a subordinate tone forming circuit. These root tone and subordinate tones are generated as bass tones according to a predetermined rhythm timing.

Although it is possible to select any note interval of the subordinate tone formed by the subordinate tone forming circuit, it is also possible to generate a subordinate tone having a note interval corresponding to the type (major, minor, seventh, etc.) selected on the chord tone performance keyboard. According to this invention, since the chord performance keyboard and the bass tone performance keyboard are independent from each other, the relationship between the chord name of the chord tone and the root note name of the bass tone is not fixed but may be of any selected relationship. Accordingly, it is possible to automatically perform the chord tone and the bass tone guide independently from each other. Moreover, as has been pointed out hereinabove, by making the note interval of the subordinate tone of the automatic bass tone to correspond to the type of the chord selected on the chord tone performance keyboard, without the designating or setting a particular subordinate note interval for the subordinate tone forming circuit, the subordinate note interval can be automatically set thus facilitating the performance operation. For this reason, the performer can play, any bass tone and chord tone as desired while fully enjoying the advantage of the automatic performance.

Generally, a keyboard type electronical musical instrument comprises a manual keyboard and a pedal keyboard and the manual keyboard includes an upper keyboard and a lower keyboard. When the keyboards are arranged in this manner, the lower keyboard may be used as the chord tone performance keyboard and the pedal keyboard as the bass tone performance keyboard. The remaining upper keyboard is utilized as a melody performance keyboard but it may also be used as the chord or bass tone performance keyboard. It should be understood that the term "subordinate tone" means tones having predetermined note intervals (for example, minor third degree, perfect fifth degree, minor seventh degree, etc.) with respect to the root note.

Thus, according to this invention, there is provided an electronic musical instrument comprising a first keyboard for performing a chord tone, a second keyboard for performing a bass tone, a circuit for generating at least one of a plurality of notes each having a predetermined note interval with respect to a note selected by the second keyboard in accordance with a desired rhythm, and tone generating mean for producing the note generated by the generating circuit as a bass tone and for generating the note selected by the first keyboard as a chord tone.

BRIEF DESCRIPTION OF THE DRAWINGS

In the accompanying drawings:

FIG. 2 is a block diagram showing a modified embodiment;

FIGS. 12 and 13 show examples of bass patterns expressed in terms of staff notation in which FIG. 12 shows one example of the bass pattern of swing and FIG. 13 one example of the bass pattern of march;

DESCRIPTION OF THE PREFERRED EMBODIMENTS

Figure 1:
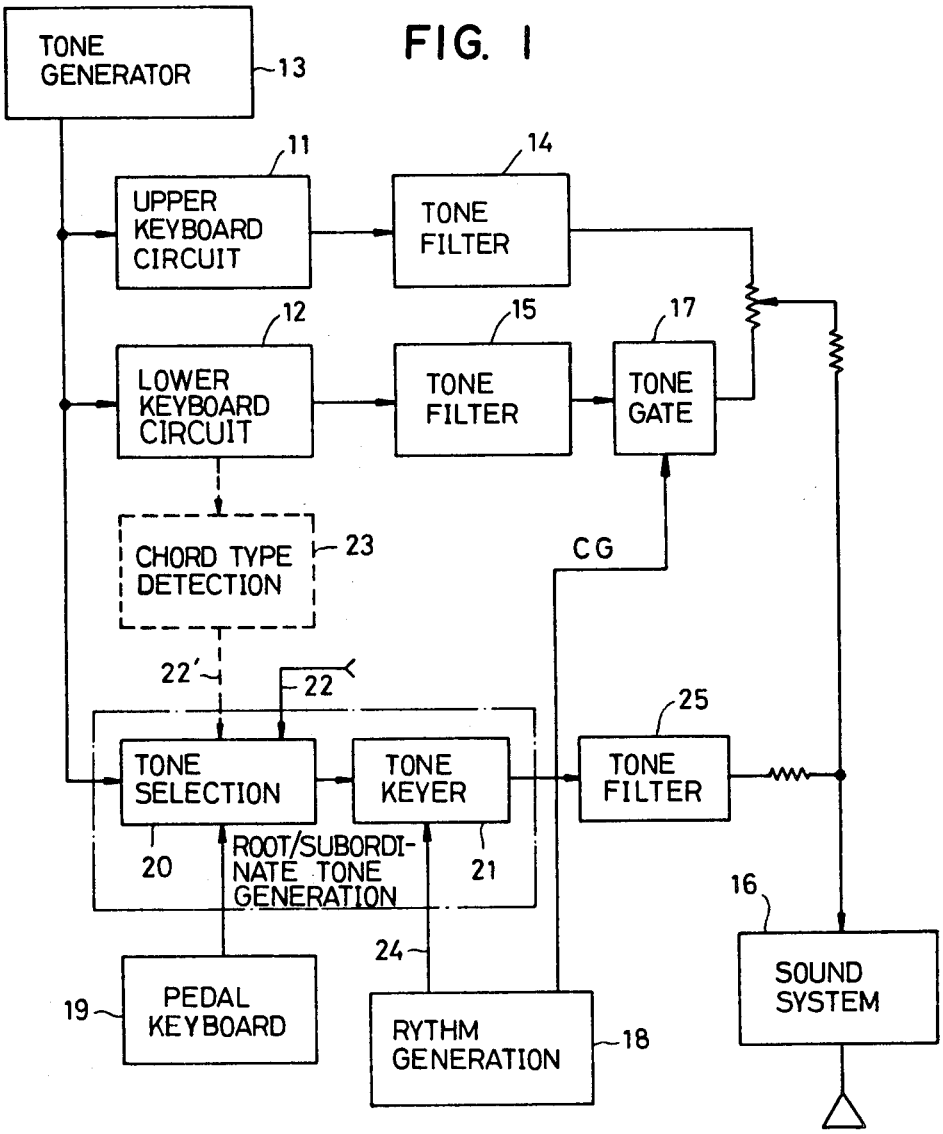
FIG. 1 is a block diagram showing one embodiment on the electronic musical instrument according to the invention.

In the block diagram shown in FIG. 1, there are provided an upper keyboard circuit 11 and a lower keyboard circuit 12 which select from a tone generator 13 tone source signals of tones selected by the upper and lower keyboards respectively and apply amplitude envelopes to the selected tone source signals. The outputs of the upper and lower keyboard circuits are applied to tone controlling filter circuits 14 and 15 respectively. The tone selected by the upper keyboard is generated as a melody tone through the filter circuit 14 and a sound system 16 in accordance with depression of corresponding keys without any modification. In the lower keyboard, single or a plurality of tones selected by the lower keyboard in the form of a chord are applied to a gate circuit 17 through filter circuit 15. A rhythm generation circuit 18 produces a chord tone gating signal CG at each timing of generation of a chord tone for enabling the gate circuit 17 so that the chord tone selected by the lower keyboard is generated automatically through the gate circuit 17 and the sound system 16. The chord tone gating signal CG is given at a predetermined timing corresponding to the rhythm selected by the player.

A pedal keyboard 19 is used for the automatic performance of the bass tone and a single tone selected by the keyboard 19 is processed as a tone corresponding to a root note in the progress of the bass tone in which tones constituting a chord are performed successively. Thus, a tone source signal corresponding to the single tone selected by the pedal keyboard 19 is selected from the tone generator 13 by a tone selector circuit 20 and the selected signal is applied to a switch circuit 21. At the same time, a tone having a predetermined interval relationship with respect to a tone (root note) selected by the pedal keyboard 19, that is, a subordinate tone, is selected from the tone generator 13 by a tone selection circuit 20 and applied to the switch circuit 21.

The purpose of the tone selection circuit 20 is to form the subordinate tone to the root tone selected by the pedal keyboard 19. More particularly, the tone selection circuit 20 comprises a plurality of gate circuit which are connected to select from the tone generator 13 tones respectively corresponding to the subordinate tones of different note intervals where respective note names (C, C# --- A#, B, for example) are used as respective root tones. Selection of a specific subordinate tone having a specific interval is determined by a chord type selection signal applied through a line 22. Thus, for example, when the signal from the line 22 selects the major chord, the tone selection circuit 20 selects from the tone generator 13 the tone selected by the pedal keyboard 19, that is the root tone, a tone having a major third interval with respect to the selected root tone, and a tone having perfect fifth interval with respect to the selected root tone. These selected tones are applied to the switch circuit 21.

Where the signal on line 22 selects a minor chord or a seventh chord, the tone selection circuit 20 selects subordinate tones having a note interval corresponding to the type of the chord in the same manner as above described. (that is, subordinate tones are formed). The chord type selection signal can be applied to line 22 when the player operates a suitable switch, not shown.

Instead of applying a specific chord type selection signal on line 22 as above described, it is also possible to form (or select) a subordinate tone having a desired note interval by the tone selection circuit 20. This can be accomplished by automatically forming a subordinate tone for a bass tone in accordance with the chord type of the chord tone selected by the lower keyboard. To this end, a chord type detection circuit 23 shown by dotted lines in FIG. 1 is provided for detecting the chord type of a chord tone selected by the lower keyboard and for applying a signal which selects a subordinate tone interval corresponding to the detected chord type regardless of the chord designation thereof to the tone selection circuit 20 via a line 22′ instead of a signal applied to line 22. For example, where the chord tone selected by the lower keyboard is a major chord, a signal showing that subordinate tones having the intervals of major third and perfect fifth are applied to line 22′. In the case where the type of the chord is the minor chord, seventh chord or other types, a signal showing that subordinate tones having predetermined note intervals are to be formed is applied to the tone selection circuit 20 via line 22′ in the same manner as above described.

As above described, a tone signal corresponding to a root note selected by the pedal keyboard 19 and one or more tone signals corresponding to a subordinate tone or tones having a predetermined interval and formed by the tone selection circuit 20 are applied to the switch circuit 21 which selects at least one of the root tone and subordinate tones in accordance with a timing signal applied thereto from the rhythm generating circuit 18 over a line 24 for generating a bass tone thereby applying an amplitude envelope to the selected tone and sending it to a bass pitch filter 25. For example, at the first beat generating timing a tone corresponding to the root tone is selected as the bass tone whereas at the second beat generating timing a tone having the major third interval with respect to the root tone is selected as the bass tone. In this manner, at least one of the root tone and the subordinate tones is selected at each timing. The selection of a tone of a specific interval at a predetermined beat timing is determined by a bass tone progress pattern corresponding to the rhythm selected by the player. The signal representing the bass tone progress pattern is the bass tone generating timing signal applied to line 24.

As above described, in accordance with a single key operation of the pedal keyboard, a bass tone is automatically performed.

The modified embodiment shown in FIG. 2 shows the application of this invention to an electronic musical instrument of the type wherein in response to the depression of a key, a key code in the form of a digital code signal which identifies the depressed key is generated and a musical tone is generated on the basis of the key code. Thus, a key coder 26 detects the operations of respective key switches for an upper keyboard 27 for performing a melody tone, a lower keyboard 28 for performing a chord tone, and a pedal keyboard 29 for performing a bass tone thereby generating a key code signal representing the depressed key. As the key coder 26 may be used a key coder disclosed in U.S. Pat. application Ser. No. 714,084, now U.S. Pat. No. 4,114,495, of a title "channel processor apparatus", for example. The key coder 26 generates sequentially and repeatedly a plurality of key codes corresponding to one or a plurality of depressed keys. In order to identify respective keys of the keyboards 27, 28 and 29, the key codes are constituted by 9 bit code signals, that is a keyboard code $K_1$, $K_2$ which represent the type of the keyboard, an octave code $B_1$, $B_2$, $B_3$ which represents an octave range and a note code $N_1$, $N_2$, $N_3$, $N_4$ which represents 12 notes in a chromatic scale, as shown in the following Table 1.

Table 1

| Keyboard designation | | Key code KC | | | | | | | | |
|---|---|---|---|---|---|---|---|---|---|---|
| | | $K_2$ | $K_1$ | $B_2$ | $B_2$ | $B_1$ | $N_4$ | $N_3$ | $N_2$ | $N_1$ |
| Keyboard | Upper | 0 | 1 | | | | | | | |
| | Lower | 1 | 0 | | | | | | | |
| | Pedal | 1 | 1 | | | | | | | |
| Octave range | 1 | | | 0 | 0 | 0 | | | | |
| | 2 | | | 0 | 0 | 1 | | | | |
| | 3 | | | 0 | 1 | 0 | | | | |
| | 4 | | | 0 | 1 | 1 | | | | |
| | 5 | | | 1 | 0 | 0 | | | | |
| | 6 | | | 1 | 0 | 1 | | | | |
| Note names | C# | | | | | | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |
| Start code | (SC) | 0 | 0 | 0 | 0 | 0 | 1 | 1 | 1 | 1 |

The binary values of the octave code $B_1$, $B_2$, $B_3$ and the note code $N_1$, $N_2$, $N_3$, $N_4$ correspond to the tone pitch. For example, each time the binary value of the octave ocde $B_1$, $B_2$, $B_3$ increases by one, the octave range is raised by one octave. The note code $N_1$ through $N_4$ having a higher binary value represents a higher tone but the weight of the binary value does not exactly correspond to the tone pitch. As can be clearly noted from Table 1, data "0011", "0111", "1011" and "1111" are not included in the note code $N_1$ through $N_4$. This is to facilitate processing of key codes for preparing subordinate tones as will be described later. Generally, the notes in the chromatic scale in one octave are arranged in the order of C, C#, D ..... B with the note C coming at the lowest. In the case of Table 1, where the octave code $B_1$ through $B_3$ is constant, the order of the tone pitches of C#, D .... B, C is established. This means that if the octave code $B_1$ through $B_3$ is the same, the octave range of the note C is higher than the octave tone ranges of the other notes C# through B. For example, if the code $B_1$, $B_2$ .... $N_2$, $N_1$ is "0001110", it represents the note $C_2$, whereas if it is "0010000", it represents the note $C_2$#. When the code $B_3$ .. $N_1$ is "1011101", it represents the note $B_6$ whereas if it is "1011110", it represents the note $C_7$.

The key coder disclosed in said patent U.S. Patent Appln. Ser. No. 714,084, now U.S. Pat. No. 4,114,495, is constructed to extract only key codes KC of depressed keys and to sequentially produce the extract key codes with a width of 24 microseconds per key code. When the keys of the keyboards 27, 28 and 29 are released, the key codes thereof are not produced, but for the purpose of detecting which one of the key codes is extinguished (i.e., the key has been released) by a channel processor to be described later, the key coder 26 periodically produces a start code SC having a content as shown in Table 1. The interval of generation of the start code SC is 24 microseconds like the key code KC and its period of generation is, e.g., about 5 ms (milliseconds). While the start code SC is generated, the key code KC is not generated. The channel processor 30 indges that a key corresponding to a key code has been released when no key code is not generated during one period of the start code SC.

The channel processor 30 is connected to receive the key code data applied from the key coder 26 (or through an automatic bass chord performance control device 31 to be described later) for designating the tone generation of a tone corresponding to the key code data to one of channels of a number equal to the maximum number of tones to be generated simultaneously (for example 12 tones). The channel processor 30 includes memory positions corresponding to respective channels so as to store in the memory position corresponding to a channel to which generation of a tone for a specific key has been assigned key code data corresponding to that key and to produce the stored key code data KC* for respective channels on the time division basis. The key code data KC* that has been assigned to respective channels are applied to a musical tone generating circuit 32 thus generating a tone corresponding to the content of the key code data. The channel processor 30 further produces an attack start signal AS showing that a tone should be generated by a channel to which the key code data KC* has been assigned, and a decay start signal DS showing that a key assigned to said channel has been released (that is application of the key code to the channel processor 30 has ceased), and signals AS and DS are applied to an envelope generating circuit 33. As the channel processor 30, one disclosed in said U.S. Patent application Ser. No. 714,084, now U.S. Pat. No. 4,114,495, may be used.

The musical tone generating circuit 32 may be constituted by a known circuit that generates a musical tone based on the key code data KC* (for example, a circuit disclosed in U.S. Pat. No. 3,882,751 of the title "Electronic Musical Instrument"). A frequency information memory device 34 produces a value F which is proportional to the musical tone frequency of a key represented by key code data given by the channel processor 30. An accumulator 35 is provided to accumulate the value F for producing address data qF utilized to repeatedly read out a tone source waveform signal from a waveform memory circuit 36.

The envelope generating circuit 33 generates the amplitude envelope waveform of a musical tone in accordance with data As and DS which are applied from the channel processor and represent depressed and released keys for changing with time the maximum amplitude value of the tone source waveform repeatedly read from the memory circuit 36 in accordance with the amplitude of the generated envelope waveform. A tone color circuit 37 controls the tone color of the tone source waveform signal read from the waveform memory circuit 36 for producing a musical tone signal having a desired tone color. The musical tone signal is converted into sound by sound system 38. The generation of the musical tone by the musical tone generating circuit 32 is executed in respective channels on the time division basis corresponding to the tone generation assigned by the channel processor 30.

The automatic base chord performance control device 31 connected between the key coder 26 and the channel processor 30 receives from the key coder 26 a key code KC of a key selected by a depressed key of the lower keyboard 28 or the pedal keyboard 29 for producing a key code corresponding to the bass tone for the automatic bass performance based on the key code KC and for producing a key code AKC corresponding to chord component tones of the automatic chord performance. More particularly, the automatic bass chord performance control device 31 automatically produces a key code AKC for a specific key in response to the key code KC of a depressed key on the keyboard although the specific key is not actually depressed.

A chord detector 39 is connected to receive a key code KC regarding the lower keyboard 28 for detecting the chord name and the chord type of the chord tone generated by the lower keyboard 28. A subordinate tone forming data generator 40 produces subordinate tone forming data SD corresponding to a note of a predetermined interval in response to the type of the chord detected by the code detector 39. The subordinate tone forming data SD has a value corresponding to the interval of the tone. The output of a bass pattern generator 41 controls the timing of generating subordinate tone forming data SD corresponding to a specific interval. A key code processor 42 changes the value of a key code given by the key code 26 in accordance with the value of the subordinate tone forming data SD for producing a key code AKC corresponding to a subordinate tone having a predetermined interval with reference to a root tone where the key code KC generated by the key coder 26 is utilized as the root tone.

In this embodiment, since the lower keyboard 28 is used as the chord tone performing keyboard, key codes KC for a plurality of keys of the lower keyboard 28 which are depressed to play a chord are supplied to the channel processor 30 without being subjected to any processing by the key code processor 42. These tones (chord component tones) generated by the lower keyboard 28 are assigned to respective channels by the channel processor 30.

A chord tone generation timing controller 43 generates a chord tone generation timing signal CG in accordance with the rhythm selected by the player. The chord tone generation timing signal CG is applied to the envelope generator 33 which generates an envelope waveform signal in a channel assigned with a lower keyboard tone (chord tone). Accordingly, each time a chord tone generation timing signal CG is generated, a tone of a depressed key of the lower keyboard is generated at the same time (that is, as the chord tone).

The type of the chord constituted by one or more of the depressed keys of the lower keyboard 28 is detected by the chord detector 39, for applying to the key chord processor 42 subordinate tone forming data SD for a note of a predetermined interval corresponding to the type of the chord detected by the chord detector 39 in accordance with a bass progress pattern corresponding to a rhythm selected by the player. The key code processor 42 receives from the key coder 26 a key code KC of a sungle depressed key of the pedal keyboard 29 for storing the key code KC and for having it changed by the subordinate tone forming data SD. In the case of a timing wherein a tone corresponding to the root tone is generated as the bass tone, the subordinate tone forming data SD is not applied and the key code KC of the pedal keyboard which has been stored in the key code processor 42 is applied to the channel processor 30 without any change. In this manner, the bass tone is assigned to a predetermined channel (usually a specific channel utilized only for the pedal keyboard) thereby producing a tone corresponding to the root tone as the bass tone. In the case of a timing wherein a tone having a predetermined interval (for example, a major third interval) with respect to the root tone is generated as the bass tone, subordinate tone forming data SD having a value corresponding to said predetermined interval is supplied to the key code processor 42 for modulating the value of a key code KC produced by depressing key of the pedal keyboard 29 by the predetermined interval so as to form a processed key code AKC. The tone of this code AKC is assigned to a predetermined channel by the channel processor 30, for example the channel exclusively used for the pedal keyboard, instead of a bass tone previously generated so that the musical tone generating circuit 32 produces a tone corresponding to the subordinate tone having the predetermined interval as the bass tone. Usually, even when a plurality of keys of the pedal keyboard 27 are operated, the key coder 26 produces the key code of only one key.

Figure 3:
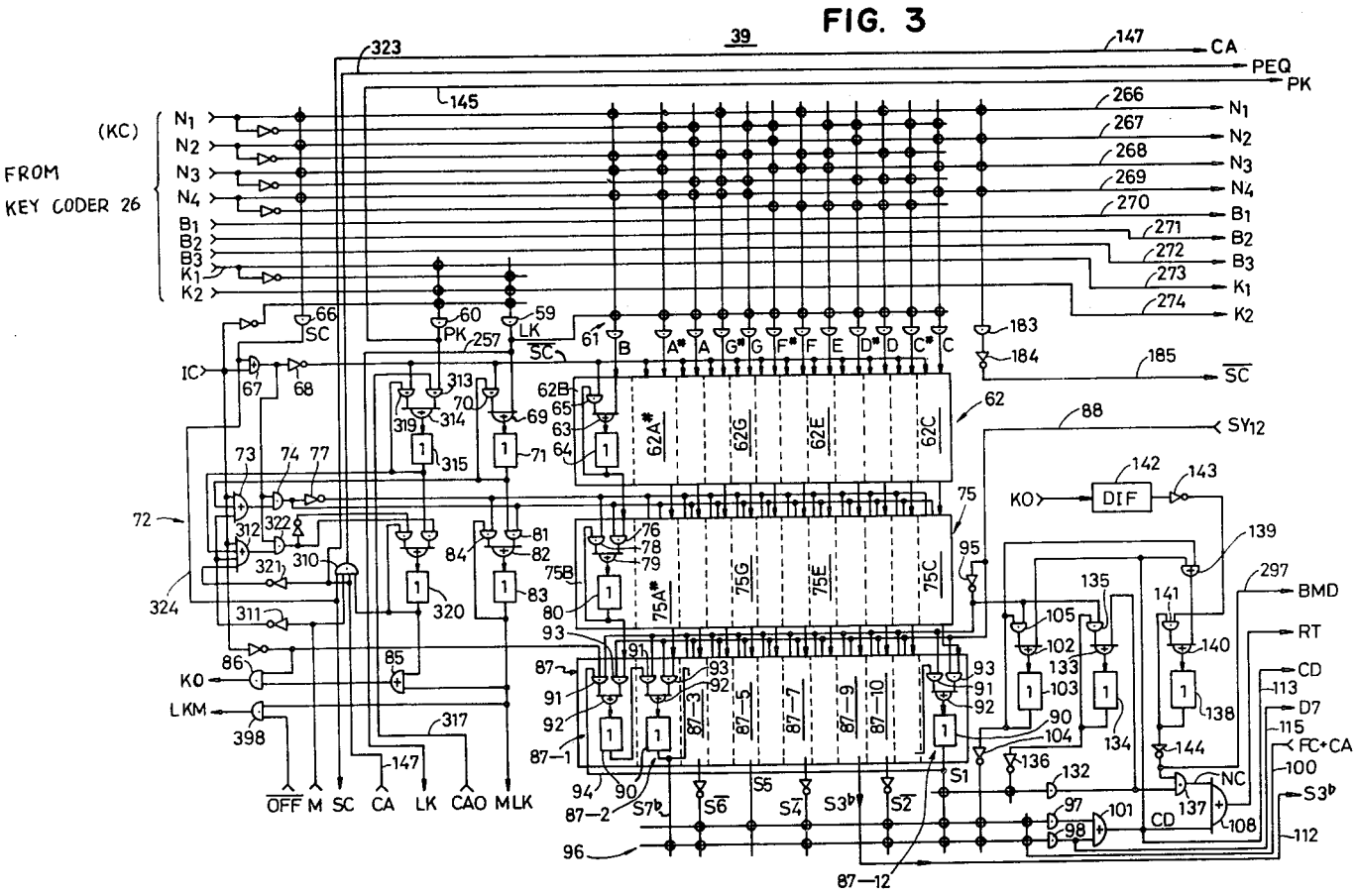
FIG. 3 is a connection diagram showing details of a chord detector utilized in the embodiments shown in FIG. 1 and FIG. 2.

One example of the automatic bass chord performance controller 31 is shown in FIGS. 3 through 7. Thus, FIG. 3 shows the detail of the chord detector 39, FIG. 4 the detail of the subordinate tone forming data generator 40, FIG. 5 that of the key code processor 42, FIG. 6 that of the bass pattern generator 41 and FIG. 7 that of the chord tone generation timing controller 43.

Figure 6:
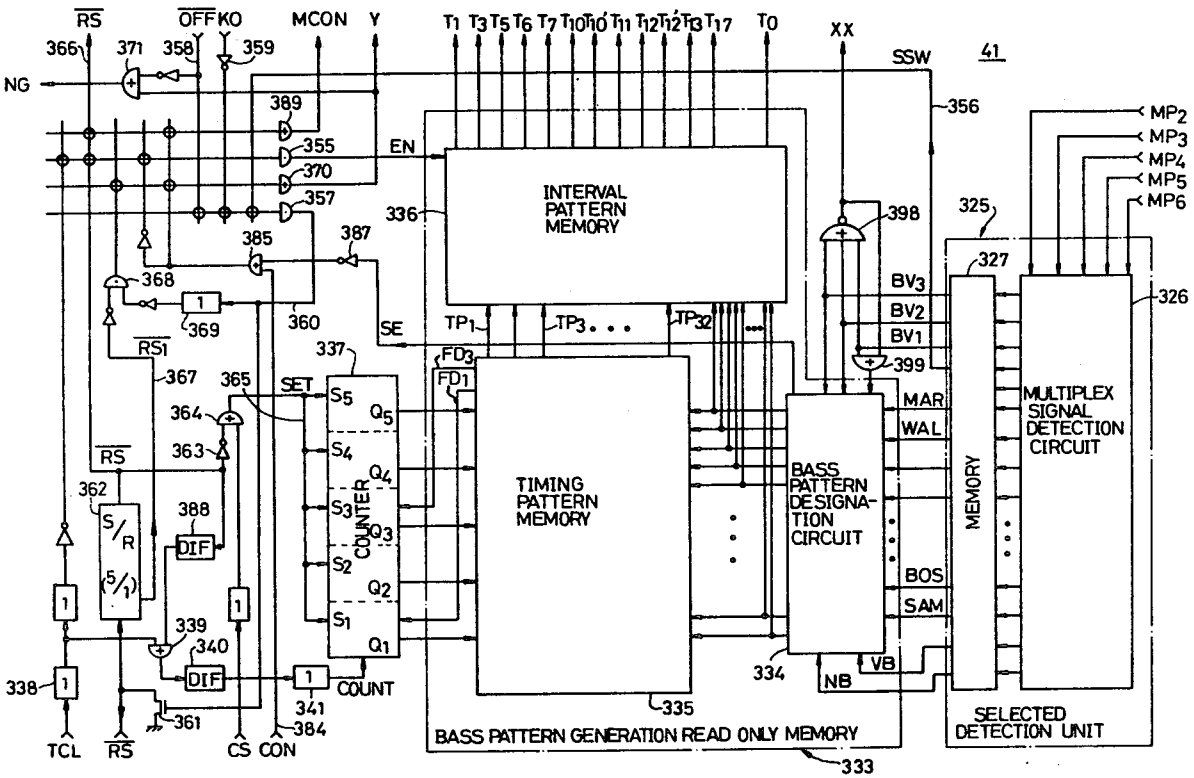
FIG. 6 is a connection diagram showing details of a bass pattern generator utilized in the embodiment shown in FIG. 2.
Figure 7:
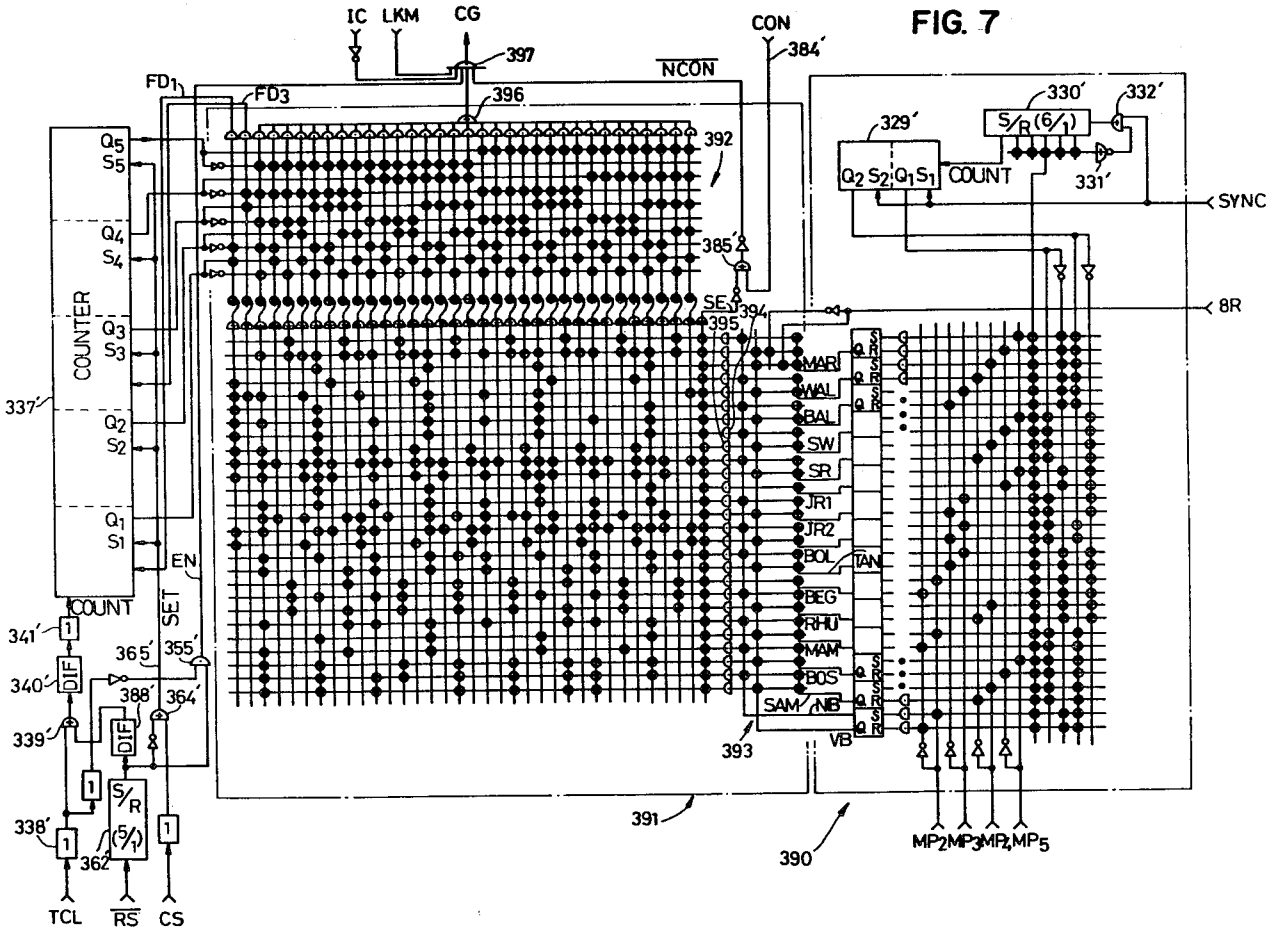
FIG. 7 is a connection diagram showing details of a chord tone generation timing controller 43 utilized in the embodiment shown in FIG. 2.
Figure 8:
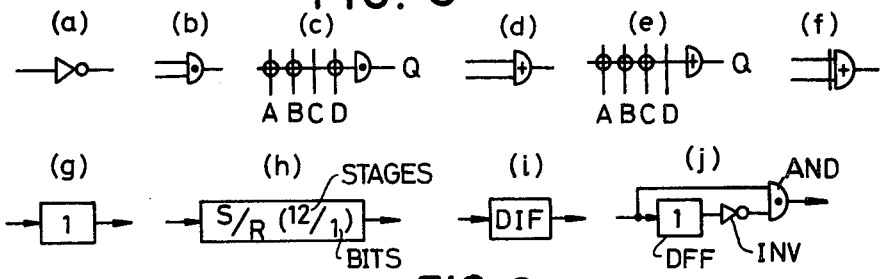
FIG. 8*a* through *l* are symbols for representing various logical circuits.

The concrete construction of verious logical circuit elements utilized in the circuits shown in FIGS. 3 to 7 are shown in FIG. 8.

FIG. 8*a* shows an inverter, FIGS. 8*b* and 8*c* AND gate circuits. FIGS. 8*d* and 8*e* OR gate circuits, FIG. 8*f* an exclusive OR gate circuit and FIG. 8*g* a one bit delay flip-flop circuit. Where the AND or OR gate circuit has a small number of inputs, they are shown by ordinary symbols shown in FIGS. 8*b* and 8*d*, whereas where there are many inputs, they are shown by the symbols as shown in FIGS. 8*c* and 8*e* in which an input is shown by one line and a plurality of signal lines are crossed with the input line, cross-points therebetween being marked by small circles. Accordingly, in the case shown in FIG. 8*c*, the logical equation is expressed as $Q=A\cdot B\cdot D$, whereas in the case of FIG. 8*e*, The logical equation is $Q=A+B+C$. FIG. 8*h* shows a shift register, the numerator of a fraction in parenthesis represents the number of the stages of the shift register and the denominator represents the number of bits of the input data to the shift register. Although shift clock pulses for the delay flip-flop circuit and the shift register are not shown, they are shifted by the same shift clock pulse (preferably a two phase clock pulse). The shift clock pulse utilized in the circuits shown in FIGS. 3 to 7 has the same period (for example, about 24 microseconds) as the clock pulse utilized for the key coder 26. Accordingly, a key code KC having a width of 24 microseconds and supplied from the key coder 26 can be positively stored in the delay flip-flop circuit in the automatic bass chord performance controller 31. The interval 24 microseconds of one period of the shift clock pulse is hereinafter termed one bit time.

The circuit shown by the symbols of FIG. 8*i* shows a differentiating circuit which, as shown in FIG. 8*i*, comprises a delay flip-flop circuit DFF, an inverter INV and an AND gate circuit AND thereby producing a differentiated pulse having a width of one bit time (24 microseconds) at the build up of the input signal.

The automatic bass chord performance comtroller 31 shown in FIGS. 3 to 7 is constructed such that it can select any one of three automatic performance functions including a function (hereinafter termed a custom function) of automatically performing the chord tone and the bass tone by using separate keyboards, which is the object of this invention. These three functions comprises (1) the above described "custom" function, (2) a function (hereinafter termined a "finger chord function") in which a plurality of keys of the chord tone performance keyboard (lower keyboard) are depressed in the form of a chord for automatically generating the chord tone as well as a boss tone corresponding there to, and (3) a function (hereinafter termed a "single finger function") for automatically performing a chord tone constituted by a plurality of chord component tones and the bass tone by depressing a single key corresponding to the root tone of the chord tone performance keyboard and by designating the chord type by suitable means. The finger chord function and the single finger function which have already been known primarily determine the relationship between the chord tone and the bass tone (particularly the root tone of the chord) which are automatically performed by depressing keys of the chord tone performing keyboard. In this example, it is possible to selectively perform one of the custom function of this invention, the finger chord function and the single finger function by using a single bass chord performance controller 31.

Figure 4:
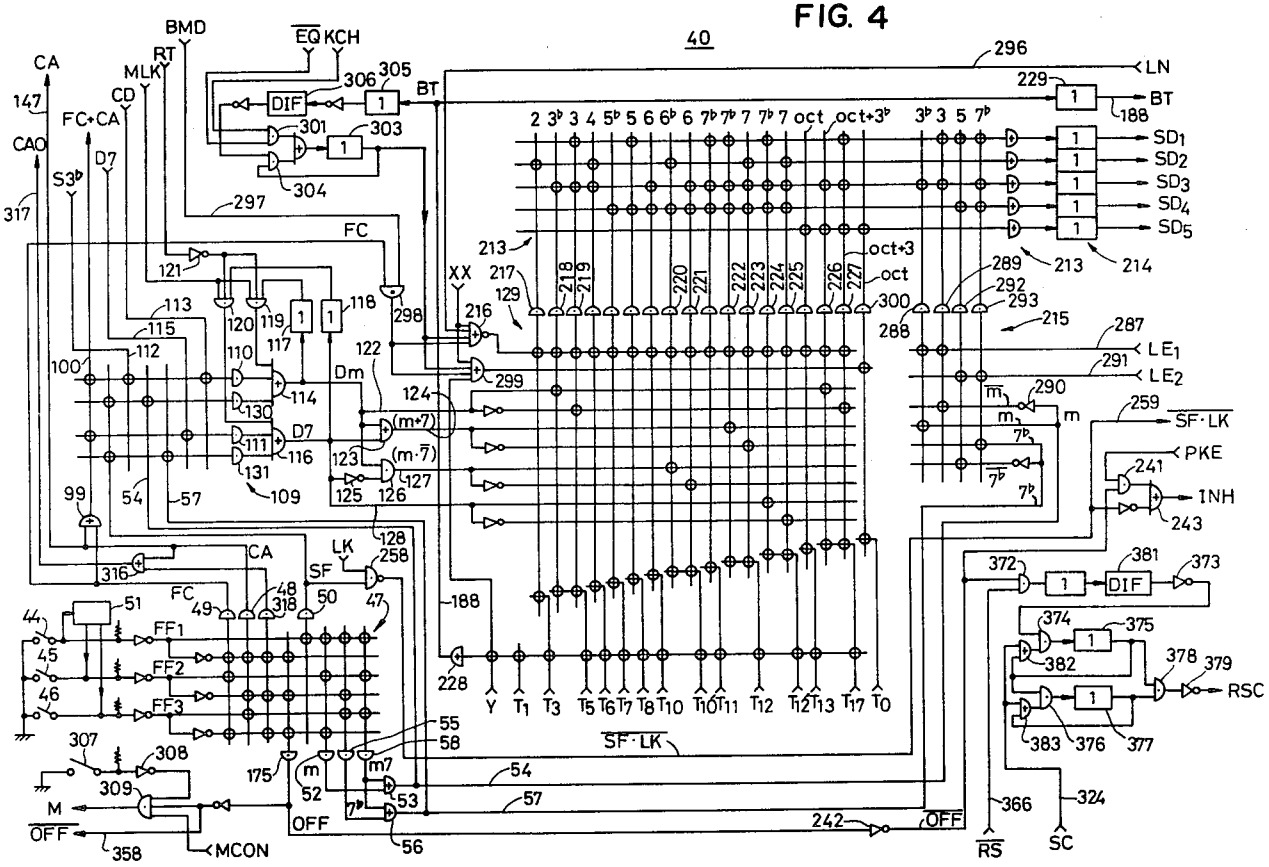
FIG. 4 is a connection diagram showing details of a subordinate tone forming data generator utilized in the embodiment shown in FIG. 2.

Selection of the automatic performance functions is made by the manipulation of function switches 44, 45 and 46 shown in FIG. 4. The function swith 44 is used to select the single finger function, switch 45 the finger chord function and the switch 46 the custom function. When these function switches are closed, signals $FF_1$, $FF_2$ and $FF_3$ produced thereby become "1" respectively and are applied to a function decoder 47 (see FIG. 4) which produces a signal for selecting respective functions shown in the following Table 2 in accordance with the logical values of input signals $FF_1$, $FF_2$ and $FF_3$. When all switches 44, 45 and 46 are opened, the condition is "OFF" and no automatic bass chord is performed.

Table 2

| function | | $FF_1$ | $FF_2$ | $FF_3$ |
|---|---|---|---|---|
| single finger function (SF) | major | 1 | 0 | 0 |
| | minor (m) | 1 | 1 | 0 |
| | seventh ($7^b$) | 1 | 0 | 1 |
| | minor seventh ($m^7$) | 1 | 1 | 1 |
| finger code function (FC) | | 0 | 1 | 0 |
| custom function (CA) | | 0 | 0 | 1 |
| OFF | | 0 | 0 | 0 |

Where the custom function is to be selected, only switch 46 is closed to change signal $FF_3$ to "1" and to enable an AND gate circuit 48 (FIG. 4) for changing the custom function selection signal CA to "1". To select the finger chord function, only switch 45 is closed for changing signal $FF_2$ to "1" and for enabling an AND gate circuit 49 thus changing the finger chord function selection signal FC to "1". To select the single finger function, switch 44 is closed for changing signal $FF_1$ to "1" thereby changing the single finger function selection signal SF to "1" via one input of AND gate circuit 50. Upon closure of switch 44 for selecting the single finger function, a chord type selection switch circuit 51 (FIG. 4) is enabled thereby applying information which designates the chord type of the single finger function to the lines of signal $FF_2$ and $FF_3$ provided that switches 45 and 46 which select the other functions are open. Since in the single finger function only one key of the chord tone performance keyboard is selected, it is necessary to select the type of the chord by a chord type selection switch circuit 51. As shown in Table 2, when the chord type is a "major," both signals $FF_2$ and $FF_3$ given by the switch circuit 51 are "0" so that no chord type designation signal is generated. In the case of a "minor chord", the signal $FF_2$ is "1" and the signal $FF_3$ is "0". Accordingly, the output of an AND gate circuit 52 of the function decoder 47 becomes "1" thus producing a minor chord signal m on line 54 via an OR gate circuit 53. In the case of a "seventh chord", signal $FF_2$ is "0" and the signal $FF_3$ is "1" so that the output of an AND gate circuit 55 is "1" thus producing a seventh chord signal $7^b$ on line 57 via an OR gate circuit 56. In the case of a "minor seventh chord", both signals $FF_2$ and $FF_2$ are "1" and the output of an AND gate circuit 58 becomes "1" thereby producing a minor seventh chord signal m7 which produces a signal "1" on lines 54 and 57.

The white and black keys of the pedal keyboard 29 can be advantageously used as the switches (not shown) of the chord type selection switch circuit 51. Thus, the white key may be used to select the "seventh chord" and the black key the "minor chord". The invention, however, is not limit to such use and an independent switch may be used for selecting the chord type.

The detail of the operation, particularly the "custum function" of the automatic bass chord performance controller 31 shown in FIGS. 3 to 7 will be described in the following.

CHORD DETECTION

Referring first to FIG. 3, in response to the keyboard code $K_1$, $K_1$ among the nine bit key code signal KC produced by the key coder 26 (see FIG. 2), an AND gate circuit 59 detects the information regarding the lower keyboard whereas an AND gate circuit 60 detects the information regarding the pedal keyboard. When the applied key code KC relates to the lower keyboard, the lower keyboard detection signal LK produced by the AND gate circuit 59 becomes "1" thereby enabling respective AND gate circuit of a lower keyboard note decoder 61. The inputs of this lower keyboard note decoder 61 are connected to receive the note code $N_1$ through $N_4$ among the key code KC supplied by the key coder 26 thereby decoding it into any one of the 12 notes C, C . . . B. This decoding operation is performed only when the note code $N_1$ through $N_4$ is generated by depression of a key on the lower keyboard. 12 outputs corresponding to 12 note C to B generated by the lower keyboard decoder 61 are stored in the memory positions for respective tone designations of a lower keyboard note primary memory circuit 62. While in FIG. 3 only the memory position 62B for note B is shown in detail, the memory positions 62A through 62C for the other note A through C have the same construction. At respective memory positions 62B through 62C of the primary memory circuit 62, the note detection signal produced by the note decoder 61 is applied to a delay flip-flop circuit 64 via an OR gate circuit 63 and held by the delay flip-flop circuit 64 via an AND gate circuit 65. When a start code 56 is given by the key coder 26 instead of the key code KC, an AND gate circuit 66 detects that all bits of the note code $N_1$ through $N_4$ have changed to "1" thereby producing a signal "1" corresponding to the start code SC. A start code detection signal SC from the AND gate circuit 66 is applied to the AND gate circuit 65 at respective memory positions via an OR gate circuit 67 and an inverter 68 thereby disenabling ANG gate circuit 65. Accordingly, the memories in the primary memory circuit 62 (self holding type) are cleared each time the start code SC is generated. The initial clear signal IC applied to the OR gate circuit 67 and the other circuits temporally becomes "1" only at the time of closing a power source circuit thereby inhibiting the operation of these circuits and clearing the memory. Normally, the initial clear signal IC is "0".

Suppose now that tones $G_5$, $E_5$ and $C_5$, for example, are produced by the keys of the lower keyboard 28 and that tone $G_2$ is produced by the pedal keyboard 29. As shown in FIG. 9*a*, the start signal SC is generated substantially periodically while code signals respectively representing depressed keys (tones $G_5$, $E_5$ and $C_5$ of the lower keyboard, and tone $G_2$ of the pedal keyboard) are sequentially supplied as the key code KC as shown in FIG. 9*b*. Consequently, the AND gate circuit 59 produces a lower keyboard detection signal LK (see FIG. 9*c*) corresponding to the key code of the lower keyboard whereas the AND gate circuit 60 produces a pedal detection signal PK corresponding to the key code of the pedal keyboard, as shown in FIG. 9*d*. The lower keyboard note decoder 61 decodes the note codes of tones G, E and C, respectively whereby signals "1" are stored in the memory position 62G for tone G of the lower keyboard note primary memory circuit 62, and in the memory positions 62E and 62C for tones E and C respectively, and the stored signal is produced as shown in FIG. 9*e*.

The lower keyboard detection signal LK produced by the AND gate circuit 59 is also stored in a delay flip-flop circuit 71 via an OR gate circuit 69. Like the lower keyboard note primary memory circuit 62, the memory in the delay flip-flop circuit 71 is cleared each time the start code SC is generated. However, when the output of the OR gate circuit 67 is changed to "1" by the generation of the start code SC, the output of the delay flip-flop circuit 71 is "1" so that the output of an OR gate circuit 73 of a memory controller 72 is "1" and the output of an AND gate circuit 74 becomes "1" at the time of generating the start code SC. The output "1" from the AND gate circuit 74 erases the previous memory of a lower keyboard secondary memory circuuit 75 and stores therein the output from the binary memory circuit 62. More particularly, the lower keyboard note secondary memory circuit 75 comprises memory positions 75A through 75*c* having the same construction as the memory positions 75B for note B for the other notes A through C respectively. By the output "1" from the AND gate circuit 74, the AND gate c circuit 76 is enabled at respectively memory positions 75B through 75C thereby writing signals stored at the memory positions 62B through 62C of the primary memory circuit 62 at corresponding memory positions 75B through 75C of the secondary memory circuit 75. The output "1" of the AND gate circuit 74 is inverted by an inverter 77 and then applied to the AND gate circuit 78 at memory positions 75B and 75C of the secondary memory circuit 75 thus disenabling the AND gate circuit 78. Consequently, the previous memories of the secondary memory circuit 75 are cleared and the memory signals of respective notes read from the primary memory circuit 62 are stored in a delay flip-flop circuit 80 via an AND gate circuit 76 and an OR gate circuit 79. When the start code SC disappears, the output of the AND gate circuit 74 becomes "0" so that the AND gate circuit 78 of the secondary memory circuit 75 is enabled and the memories of the delay flip-flop circuit 80 are held.

Figure 9:
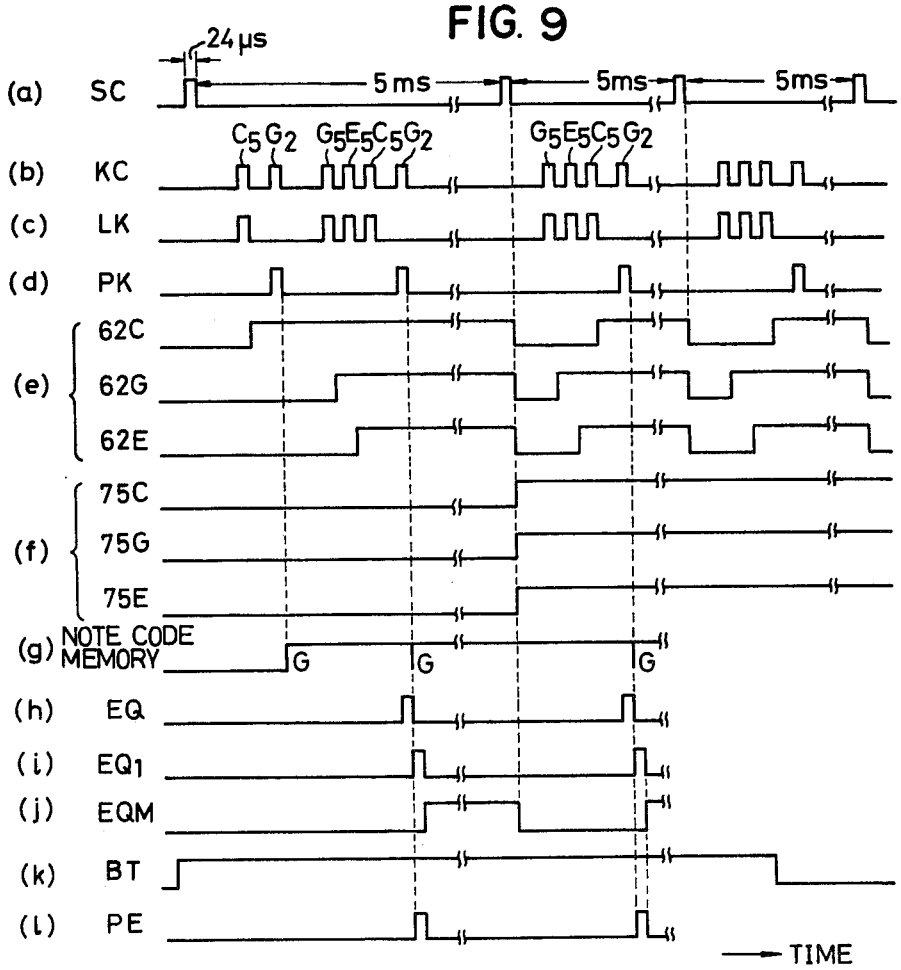
FIG. 9*a* through *l* show a timing chart for explaining the operation of storing the depressed keyboard chord data of the lower keyboard in the circuit shown in FIG. 3 and for explaining the operation of the circuit shown in FIG. 5 when a bass tone generation commanding signal PE is generated at the time of selecting a custom function.

Accordingly, in the example shown in FIG. 9, a signal "1" is stored with the timing of the start code SC at the memory positions 75G, 75E and 75C of the lower keyboard note secondary memory circuit for notes G, E and C respectively. As shown in FIG. 9*f*, when signal "1" is stored in respective memory positions 75G, 75E and 75C of the secondary memory circuit 75, the signal "1" is continuously held until it has been found that no key code KC for the depressed key has been given (i.e. the key has been released) during one period of the start code SC. In other words, in the secondary memory circuit 75, the signal "1" is always stored at the memory positions 75G, 75E and 75C for the notes of the depressed keys on the lower keyboard.

In the same manner as above described, the memory signal in a delay flip-flop circuit 71 which acts as the primary memory circuit for the lower keyboard detection signal LK is stored in a delay flip-flop circuit 83 acting as the secondary memory circuit via an AND gate circuit 81 and an OR gate circuit 82 at the time of generation of a start code SC. The lower keyboard detection signal LK stored in the delay flip-flop circuit 83 is read out after one bit time. At this time, since the start code SC disappears, an AND gate circuit 84 is enabled whereby the delay flip-flop circuit 83 self-holds its memory. Consequently, when a key of the lower keyboard (chord tone performing keyboard) is being depressed, the output from the delay flip-flop circuit 83 is a continuous signal "1" which is utilized as a lower keyboard operation memory signal MLK. Further, the output "1" from the delay flip-flop circuit 83 is used as a key depression signal KO via an OR gate circuit 85 and an AND gate circuit 86.

In the lower keyboard note secondary memory circuit 75, depressed key memory signals "1" are produced from memory positions (in the example shown in FIG. 9, positions 75C, 75E and 75G) corresponding to the notes of the depressed keys of the low keyboard. The outputs from the other memory positions are "0". The memory outputs of respective notes from the secondary memory circuit 75 are written in parallel in 12 memory stages of a scanning circuit 87. To the write control line of the scanning circuit 87 is applied a load pulse $Sy_{12}$ having one bit time width at each 12 bit time from a shift register 89 shown in FIG. 5.

Although the detail of only the first memory stage 87-1 the second memory stage 87-2 and the last twelfth memory stage of the scanning circuit 87 is shown in FIG. 3, the third to eleventh memory stages 87-3 through 87-11 have the same construction. These memory stages are constructed such that the output of a preceding memory circuit, that is a delay flip-flop circuit 90, is stored in the delay flip-flop circuit 90 of the succeeding stage via a data circulating AND gate circuit 91 and an OR gate circuit of the succeeding stage, and that the output from the delay flip-flop circuit 90 of the last stage 87-12 is applied to the data circulating AND gate circuit of the first stage 87-1 via a circulating line 94. Data writing AND gate circuit 93 of respective stages receive the memory output of respective notes of the lower keyboard note secondary memory circuit 75. In other words, the scanning circuit 87 is a parallel input, series shift type circulating shift register driven by a shift clock pulse having a period of 24 microseconds which is also used to drive the delay flip-flop circuit 90.

The data writing AND gate circuit 93 of respective stages of the scanning circuit 87 is enabled when the load pulse $SY_{12}$ on a writing control line 88 is "1" and the data circulating AND gate circuit 91 is enabled by the output "1" of inverter 95 when the load pulse $SY_{12}$ is "0". The number of stages of the scanning circuit 87 is 12 so that 12 bit times are necessary to circulate all data. Since the load pulse $SY_{12}$ is generated at each 12 bit time, the scanning circuit 67 completes one circulation (scanning) whenever a load pulse $SY_{12}$ is generated.

The scanning circuit 87 operates to scan the data of respective note C through B stored in respective memory positions 75C through 75B of the lower keyboard note secondary memory circuit 75. The following Table 3 shows the scanning stage of respective tone of the scanning circuit 87.

As shown in Table 3, one bit time after generation of the load pulse $SY_{12}$, the first stage 87-1 holds the data of the maximum tone B and succeeding stages 87-2 through 87-11 hold the data of notes A#, A. . . C# in the order of the tone pitch. The last stage 87-12 holds the data of the lowest tone C. Thereafter, each one bit time the data of the higher tone is sequentially shifted toward the lower tone side and 12 bit times later, the last stage 87-12 holds the data of the highest tone, and the first stage 87-1 to the stage 87-11 hold the data of notes A# to C in the order of the tone pitch. The data of respective notes C through B circulating through the scanning circuit is a signal "1" for the notes whose depressed key memories are stored in the secondary memory circuit 75 whereas the data of the other notes is a signal "0". The spacings between respective stages of the scanning circuit 87 correspond to the note intervals. Thus, taking a note whose data is held at the last stage 87-12 as the root tone (interval of first degree), the note held at the tenth stage 87-10 has an interval of major second, and the note held at the nineth stage 87-19 has an interval of minor third. Similarly, the seventh stage 87-7, the fifth stage 87-5, the third stage 87-3, and the second stage 87-3 respectively correspond to the perfect fourth interval, the perfect fifth interval, the major sixth interval and the minor seventh interval.

A chord detection logic 96 detects, on the time devision basis, chord name (root note) formed by the depressed keys of the lower keyboard (chord tone performing keyboard) in accordance with signals $S_1$ through $S_7b$ derived from a predetermined stage of the scanning circuit and corresponding to various intervals. Signals utilized in the chord detection logic 96 are a first degree interval signal $S_1$ derived from the last stage 87-12 of the scanning circuit 87, a major second interval absence signal $\overline{S}_2$ representing that the second major interval signal is not held in the stage 87-10, a minor third interval signal $S_{3b}$ derived from stage 87-9, a perfect fourth interval absence signal $S_4$ representing that the perfect fourth interval signal is not held in stage 87-7, a perfect fifth interval signal $S_5$ derived from stage 87-5, a major sixth interval absence signal $\overline{S}_6$ representing that the major sixth interval signal is not held in stage 87-3, and a minor seventh interval signal $S_{7b}$ derived from stage 87-2.

An AND gate circuit 97 is provided for the chord detection logic 96 for the purpose of detecting a chord (major chord or a minor chord) containing a tone of the perfect fifth interval.

Table 3

| | | memory stage of scanning circuit 87 | | | | | | | | | | | |
|---|---|---|---|---|---|---|---|---|---|---|---|---|---|
| bit time | | 1 | 2 | 3 | 4 | 5 | 6 | 7 | 8 | 9 | 10 | 11 | 12 |
| Time | 1 | B | A# | A | G# | G | F# | F | E | D# | D | C# | C |
| ↓ | 2 | C | B | A# | A | G# | G | F# | F | E | D# | D | C# |
| ↓ | 3 | C# | C | B | A# | A | G# | G | F# | F | E | D# | D |
| ↓ | 4 | D | C# | C | B | A# | | | | | | | D# |
| ↓ | 5 | | ..... | | C | B | A# | ..... | | | | | E |
| ↓ | 6 | | ..... | | | C | B | A# | ..... | | | | F |
| ↓ | 7 | | ..... | | | | C | B | A# | ..... | | | F# |
| ↓ | 8 | | ..... | | | | | C | B | A# | ..... | | G |
| ↓ | 9 | | ..... | | | | | | C | B | A# | ..... | G# |
| ↓ | 10 | | ..... | | | | | | | C | B | A# | A |
| ↓ | 11 | | ..... | | | | | | | | C | B | A# |
| $SY_{12}$→ | 12 | A# | A | G# | G | F# | F | E | D# | D | C# | C | B |
| | | | ↑ minor seventh | ↑ major sixth | | ↑ perfect fifth | | ↑ perfect fourth | | ↑ minor third | ↑ major second | | ↑ first |

The basic logical equation of the AND gate circuit 97 is as follows:

$$S_1 \cdot S_2 \cdot \bar{S}_4 \cdot S_5 \cdot \bar{S}_6 \qquad \text{logical equation 1}$$

The condition of detection holds when a key for the first degree interval (root tone) and a key for the perfect fifth interval are depressed simultaneously, and keys for the major second interval, the perfect fourth interval and the major sixth interval are not depressed.

The purpose of an AND gate circuit 98 is to detect a chord (the seventh chrod or the minor seventh chord) containing a tone of the minor seventh interval, and the logical equation of the AND gate circuit 98 is $$S_1 \cdot \bar{S}_2 \cdot \bar{S}_4 \cdot \bar{S}_6 \cdot S_{7b} \qquad \text{logical equation 2}$$

The condition of detection hold when the keys for the first degree interval (root tone) and the minor seventh interval are depressed simultaneously, and the keys for the major second interval, the peffect fourth interval and the major sixth interval are not depressed.

Where the "custom function" or the "finger chord function" is selected, the custum function selection signal CA or the finger chord function selection signal FC is gated by an OR gate circuit (FIG. 4) so that the signal FC or CA is applied to AND gate circuits 97 and 98 over line 100 so that the AND gate circuits 97 and 98 are enabled to detect the chord only in a case of the "custom function" or the "finger chord function". When the load pulse $SY_{12}$ is generated, the output "0" of an inverter 95 disenables an AND gate circuit 105 thus clearing the memory of a delay flip-flop circuit 103. Then, the output of an inverter 104 becomes "1" to enable AND gate circuits 97 and 98.

When the chord detection conditions (equations 1 and 2) and the operating condition described above are satisfied, the AND gate circuit 97 or 98 produces a signal "1" having a width of one bit time in coincidence with the scanning timing of the scanning circuit 57 when the logical equation 1 or 2 is satisfied. This output is applied to an OR gate circuit 101 to form the chord detection signal CD. The output of the OR gate circuit 101 is stored in the delay flip-flop circuit 103 via an OR gate circuit 102. The signal "1" stored in the delay flip-flop circuit 103 is self-hold until a load pulse $SY_{12}$ is applied to the delay flip-flop circuit 103 via an AND gate circuit 105. When either one of the AND gate circuits 97 and 98 firstly produces a chord detection signal, the delay flip-flop circuit 103 is set so that AND gate circuits 97 and 98 are disenabled via an inverter 104. For this reason, even when the logical equation 1 or 2 is satisfied, many times during one period (that is during one scanning) of the load pulse $SY_{12}$, the chord detection signal CD is produced only when the logical equation 1 or 2 is firstly satisfied. Many times satisfaction of the logical equations 1 or 2 means detection of a plurality of chords, but where the delay flip-flop circuit 103 is provided, only one chord firstly detected preferentially generates chord detection signal CD. This order of preference depends upon the order of scanning of respective notes of the scanning circuit 87. As table 3 clearly shows, at first the data of note C is stored in the memory stage 87-12 of the scanning circuit 87 which corresponds to the first degree interval root tone and thereafter the scanning proceeds starting from the low tone side in a manner of C# D, D# . . . B. Accordingly, in this embodiment, a chord whose root note is on the lower tone side of the chromatic scale will be detected preferentially.

Figure 10:
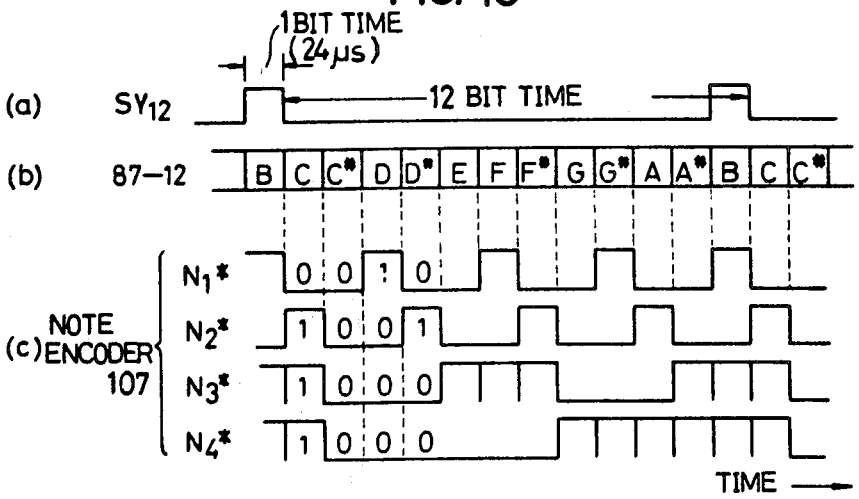
FIG. 10*a* through *c* show a timing chart useful to explain that the scanning of respective chord data by a scanning circuit shown in FIG. 3 and the generation of note codes $N_1$* through $N_4$* which are generated on the time division basis by the chord encoder shown in FIG. 5 are synchronous.

Since the timing of generating the chord detection signal CD is synchronous with the scanning timing of the scanning circuit 87, the root tone name of the load detected by the chord detection logic 96 is discriminated by the timing of generating the chord detection signal CD. The relationship between the notes of the data held in the last stage 87-12 of the scanning circuit which corresponds to the root tone, and the load pulse $SY_{12}$ is shown by FIGS. 10*a* and 10*b*. As shown, each time one bit time elapses from the generation of the load pulse $SY_{12}$, the root tone name is shifted sequentially from the low tone side toward the high tone side in the order of C, C#, D . . . B. Accordingly, it is possible to descriminate the root tone by determining the number of bit times between the generation of the chord detection signal and the generation of the load pulse $SY_{12}$.

A shift register 89 (FIG. 5) which generates the load pulse $SY_{12}$ shifts a single pulse "1" in synchronism with the scanning of the scanning circuit 87. When the signal "1" reaches the twelfth stage of the shift register 89, a load pulse $SY_{12}$ is applied on line 88. At the same time, the contents of the first through eleventh stages are all "0" so that the output of a NOR gate circuit 106 (FIG. 5) is "1" which is written into the shift register 89. At one bit time after generation of the load pulse $SY_{12}$, signal "1" is held at the first stage of the shift register 89 so that a note encoder 107 constituted by four OR gate circuits produces note code $N_1$* through $N_4$* representing the note C expressed by a code "1110". At the next bit time, the signal "1" is shifted to the second stage of the shift register 89 so that note encoder 107 produces note code $N_1$* through $N_4$* of the note C# expressed by a code "0000". Each time the bit time proceeds further, note codes are sequentially produced from the lower note side in the order of D, D#, . . . B. FIG. 10*c* shows the timing of generating of the note code $N_1$ through $N_4$ corresponding to respective notes generated by the note encoder 107 wherein the notes are generated on the time division basic.

The note encoder 107 is synchronized with scanning of the scanning circuit 87 so that the root note of the chord detected by the chord detection logic 96 coincides with the note of the output note produced by the note encoder 107. In this manner, the chord detection signal CD is utilized as the root tone detection signal RT via an OR gate circuit 108 (FIG. 3), Thus, the note of the note code produced by the encoder 107 at the same timing as the root note detection signal RT coincides with the note of the root tone detected by the chord detection logic 96.

As above described, the chord formed by the depressed keys of the lower keyboard is detected by using the scanning circuit 87 and the chord detection logic 96 and the chord detection signal CD having a width of one bit time and the root note detection signal RT are generated at a timing corresponding to the root note of the detected chord.

In this embodiment, the number of the detectable chords are four, that is, the "major", "minor", "seventh" and "minor seventh" chords. The type of the chords can be judged by whether the chord detection signal CD satisfies the logical equation 1 or 2, and whether the data of the minor third interval is contained in the stage 87-9 of the scanning circuit 87 corresponding to the minor third interval or not.

In the chord type detection circuit 109 shown in FIG. 4, in the case of the finger chord function or the custom function, AND gate circuits 110 and 111 are enabled by signal FC+CA on line 100 whereby the type of the chords is detected on the basis of the signal given by the chord detection logic 96.

To the inputs of the AND gate circuit 110 are applied a minor third interval signal $S_3B$ which is applied through line 112 from the stage 87-9 of the scanning circuit 87 corresponding to the minor third interval, and a chord detection signal CD over line 113. Accordingly, when the minor third interval signal $S_3b$ is detected where a chord is established according to logical equation 1 or 2, the output of the AND gate circuit 110 becomes "1" and the minor detection signal $D_m$ becomes "1" through an OR gate circuit 114. When the minor detection signal is "1", the chord is the "minor" or "minor seventh". Where the logical equation 2 is satisfied the, AND gate circuit 98 (FIG. 3) applies the seventh detection signal $D_7$ to the input of the AND gate circuit 111 via line 115 whereby this AND gate circuit 111 is enabled to provide this signal via an OR gate circuit 116.

The minor detection signal $D_m$ and the seventh detection signal $D_7$ are stored in delay flip-flop circuits 117 and 118 and are held therein through AND gate circuits 119 and 120 and OR gate circuits 114 and 116. To the inputs of the AND gate circuits 119 and 120 are applied a depressed key memory signal MLK of the lower keyboard sent from the delay flip-flop circuit 83 (FIG. 3) and a signal obtained by inverting by an inverter 121 a root tone detection signal RT produced by the OR gate circuits 108 (FIG. 3). Consequently, each time a root tone detection signal RT is produced, the self-holding actions of the delay flip-flop circuits 117 and 118 are released and at the same time new contents are stored in these flip-flop circuits only when a chord detection signal CD is generated. When all keys of the lower keyboard have been released, the depressed key memory signal MLK of the lower keyboard becomes "0" so that the stored contents in the delay flip-flop circuit 117 and 118 are cleared. In this manner, the minor detection signal Dm or the seventh detection signal $D_7$ is stored and held in the flip-flop circuit in accordance with the type of the detected chord.

When only the minor detection signal Dm is produced, the chord is a minor chord (minor third chord), whereas when only the seventh detection signal is produced, the chord is a seventh chord. When both minor detection signal Dm and seventh detection signal $D_7$ are produced, the chord is a minor seventh chord. When both detection signals Dm and $D_7$ are not produced but the chord detection signal CD is produced, the chord is a major chord.

A bass system subordinate tone selection gate circuit 129 is connected to receive the minor detection signal Dm via line 122, a signal m+7 produced by combining the minor detection signal Dm and the seventh detection signal $D_7$ by an OR gate circuit 123 via line 124, a signal $m.\overline{7}$ which is produced by an AND gate circuit 126 from the minor detection signal Dm and an inverted seventh detection signal $\overline{D}_7$ which is produced by inverting the seventh detection signal by an inverter 125 via line 127, and the seventh detection signal $D_7$ via line 128.

Where the single finger function is selected, AND gate circuits 130 and 131 of the chord detection circuit 109 are enabled by a single finger function selection signal SF from the AND gate circuit 50 of the function decoder 47 (FIG. 4). As described above, a minor system selection signal is applied to one input of the AND gate circuit 130 from the OR gate circuit 53 through the OR gate circuit 54, and a seventh system selection signal is applied to one input of the AND gate circuit 131 from the OR gate circuit 56 via line 57. The output from the AND gate circuit 130 or 131 is converted into a minor detection signal Dm or a seventh detection signal $D_7$ via the OR gate 114 or 116, and signal $D_m$ or $D_7$ is supplied to the bass system subordinate tone selection gate circuit 129.

Root Note Detection where Chord Detection is Impossible or in the Case of the Single Finger Function.

In a case wherein the logical equation 1 or 2 is not satisfied in the chord detection logic 96 (FIG. 3) or in the case of the single finger function, a note on the lower tone side among notes for the depressed keys of the lower keyboard is considered as a root note and the root tone detection signal RT is produced. The output of the last stage 87-12 of the scanning circuit 87 which corresponds to the first degree interval is applied to the input of an AND gate circuit 132 and its output is stored in a delay flip-flop circuit 134 via an OR gate circuit 133. The memory in the delay flip-flop circuit 134 is self-held through an AND gate circuit 135. A signal "1" firstly produced by the last stage 87-12 of the scanning circuit 87 during one scanning period (12 bit times) is stored in the delay flip-flop circuit 134 via the AND gate circuit 132. When signal "1" is stored, the output of an inverter 136 becomes "0" so that the AND gate circuit 132 is disenabled. At the start of the scanning period, when the load pulse $SY_{12}$ becomes "1" the AND gate circuit 135 is disenabled via the inverter 95, thus clearing the delay flip-flop circuit 134. The note data held in the last stage 87-12 of the scanning circuit 87 is produced from the lower tone side like C→C#→D→ . . . A#→ B so that the AND gate circuit 132 produces an output "1" in accordance with the timing of the note of the lowest tone among the tones for the depressed keys.

The output from the AND gate circuit 132 is applied to the input of an AND gate circuit 137 which is enabled when no chord is formed by the lower keyboard for producing a signal on the lower tone side which is preferentially selected by the AND gate circuit 132 as a no-chord NC which is applied to the OR gate circuit 108 together with the chord detection signal CD thus producing a root tone detection signal RT. Consequently, even when the chord detection signal CD is not produced (i.e. the chord is not detected), the root tone detection signal RT would be generated by the no-chord signal NC.

This root tone detection signal RT is used for the "finger chord function" and the "single finger function" but not for the "custom function" because in the last case, the root tone of the bass tone is designated by the pedal keyboard instead of the lower keyboard.

When the root tone detection signal RT is produced by the no-chord signal NC, the chord detection signal CD and the seventh detection signal $D_7$ are not produced, and the AND gate circuits 110 and 111 of the chord type detection circuit 107 (FIG. 4) would not be enabled.

Storage of the Chord Detection Signal

The delay flip-flop circuit 138 shown in FIG. 3 is used to memorize the fact that a chord has been formed and functions to maintain its memory of the formed chord until keys for another chord are depressed. More particularly, when a chord detection signal CD is produced by the OR gate circuit 101 of the chord detection logic 96, a signal "1" is stored in a delay flip-flop circuit 138 via OR gate circuits 139 and 140, and the memory is self-held through an AND gate circuit 141.

When a key of the lower keyboard is depressed, the AND gate circuit 86 (FIG. 3) produces a depressed key signal KO (the signal builds up to "1" level), whereas when the key is released, signal KO falls to "0" level. This depressed key signal KO is applied to a differentiating circuit 142 so as to produce a "1" pulse having a width of one bit time when the signal KO builds up. This "1" pulse is inverted by an inverter 143 to form a "0" signal thereby disenabling the AND gate circuit 141.

During depression of the key and at a time when the key is released (that is, signal fall from "1" to "0" level) the output from the differentiating circuit 142 remains at "0" so that the output of the inverter 143 is "1" and the AND gate circuit 141 is enabled. Accordingly, the chord detection signal CD stored in the delay flip-flop circuit 138 will besself-held.

Consequently, the delay flip-flop circuit 138 is cleared only at the beginning of the key depression (at the beginning of the depression of keys as viewed from the entire keyboard) but not at the time of releasing the key.

The memory output of the delay flip-flop circuit 138 is inverted by an inverter 144 and then applied to one input of AND gate circuit 137 thereby controlling the generation of a no-chord signal NC. More particularly, once the formation of a chord is detected and the chord detection signal CD is stored in the delay flip-flop circuit 138, the AND gate circuit 137 is disenabled so that the no-chord signal NC is not produced.

Figure 11:
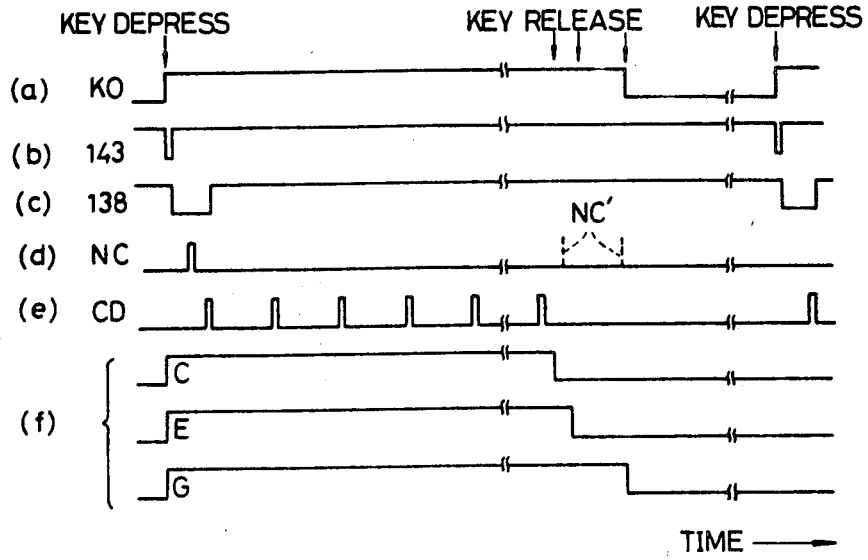
FIGS. 11*a* through *f* are time charts showing that the memory of the code detection signal CD in the circuit shown in FIG. 3 in not erased by the release of the key but erased when the next key is depressed.

One example of the operation of the delay flip-flop circuit 138 for storing the chord detection signal is shown in FIG. 11. It should be understood that the time relationship of various signals shown in FIG. 11 is not accurately shown in terms of the unit of the system clock pulse (bit time unit) but are merely illustrated diagrammatically to show the time relationship between the build-up and build down of respective signals. When keys of the lower keyboards are depressed to form a chord the depressed key signal KO builds up (see FIG. 11*a*) and the differentiating circuit 142 operates so that inverter 143 produces a "0" pulse for clearing the memory (see FIG. 11*b*). Accordingly, the memory in the delay flip-flop circuit 138 is cleared (see FIG. 11*c*). In the scanning circuit 87, since the data corresponding to the first interval is scanned from the low tone side (from the note C). During the first scanning period (12 bit times) there is a chance for producing the no-chord signal NC only once before producing the chord detection signal CD (see FIG. 11*d*). However, where a chord has been established, the chord detection signal CD is always formed during the first scanning period so that the code detection signal CD is produced at a timing corresponding to the note of the root tone of that chord (see FIGS. 10*b*) and stored in the delay flip-flop circuit 138 (FIGS. 11*c* and 11*e*). Thereafter, the memory in the delay flip-flop circuit 138 is self-held and the chord detection signal CD is produced at each 12 bit times as shown in FIG. 11*e*. As will be described later, only when the root tone detection signal RT corresponding to the no-chord detection signal NC or the chord detection signal CD is given twice with reference to the same note, it is deemed as the true root tone detection signal RT for generating a musical tone. For this reason, these is no problem even when the no-chord detection signal is produced only once as shown in FIG. 11*d*.

FIG. 11*f* shows in a somewhat exaggerated fashion the manner of releasing keys for three tones C, E and G which were depressed to form a chord. Since there is a difference between the movements of the fingers of the player, the key release timings of the three tones are not generally equal. Suppose now that a key for the note C is firstly released so that the chord is no more formed. The delay flip-flop circuit 138 for storing the chord detection signal is cleared. Then, as shown by dotted lines NC' in FIG. 11*d*, there is a problem of producing the no-chord signal NC by a key which has not yet been released and the resulting in the generation of an unpleasant tone. According to this invention, to eliminate this problem, the memory of the chord detection signal which is self-held in the delay flip-flop circuit 138 is cleared at the time of beginning the key release.

Depressed key Memory of the Pedal Keyboard

Referring again to FIG. 3, when a key code regarding the pedal keyboard is generated by the key coder 26, the output of the AND gate circuit 60 becomes "1" thus generating a pedal keyboard detection signal PK. Where the custom function is selected, an AND gate circuit 313 is enabled thus storing a signal representing a depressed key of the pedal keyboard in a delay flip-flop circuit 315 via an OR gate circuit 314. When the custom function selection signal CA is "1", the output of an OR gate circuit 316 shown in FIG. 4 becomes "1" so that a signal CAO representing that the pedal keyboard signal can be stored is applied to the input of the AND gate circuit 313 through line 317. This signal CAO is also produced by an AND gate circuit 318 in the function decoder 47 via an OR gate circuit 316 even when the automatic bass chord performance is ceased.

The memory in the delay flip-flop circuit 315 is self-held through an AND gate circuit 319. Like the delay flip-flop circuit 71 for the lower keyboard, the delay flip-flop circuit 315 acts as the primary memory circuit and the memory therein is shifted to the delay flip-flop circuit 320 acting as a secondary memory device when the start code SC is generated. The delay flip-flop circuit 320 operates to convert the pedal keyboard detection signal PK into a direct current, thereby continuously producing a signal "1" (depressed keybmemory) when a key of the pedal keyboard is being depressed. The pedal keyboard depressed key memory signal stored in the dealy flip-flop circuit 320 is applied to the input of the OR gate circuit 85.

Memory of the key code Data of the Pedal Keyboard Corresponding to the Root tone of the Bass Tone during Custom Function In the case of the custom function, the data is processed by the key code processor 42 based on the key code of a single tone selected on the pedal keyboard 29 (FIG. 2) for producing the key code of a tone corresponding to a subordinate tone having a predetermined interval with reference to a tone corresponding to a root tone selected by the pedal keyboard 29 for performing a bass tone. In the key code processor 42 shown in FIG. 5, the data of a key code regarding the pedal keyboard 29 and supplied from the key coder 26 is firstly stored and then the stored data is modified to prepare the key code data of the subordinate tone. The stored data is used to prepare the key code data for the root tone without any modification. The term root tone and subordinate tone used herein mean the interval relationship of a bass tone performed chronologically separately.

When a key code regarding the pedal keyboard is supplied from the key coder 26, the output of the OR gate circuit 60 (FIG. 3) becomes "1" so that a pedal actuated keyboard detection signal PK is applied to one input of an AND gate circuit 146 over line 145. The other input of the AND gate circuit 146 is connected to receive a custom function selection signal CA from the AND gate circuit 48 of the function decoder 47 (FIG. 4) over line 147.

Figure 5:
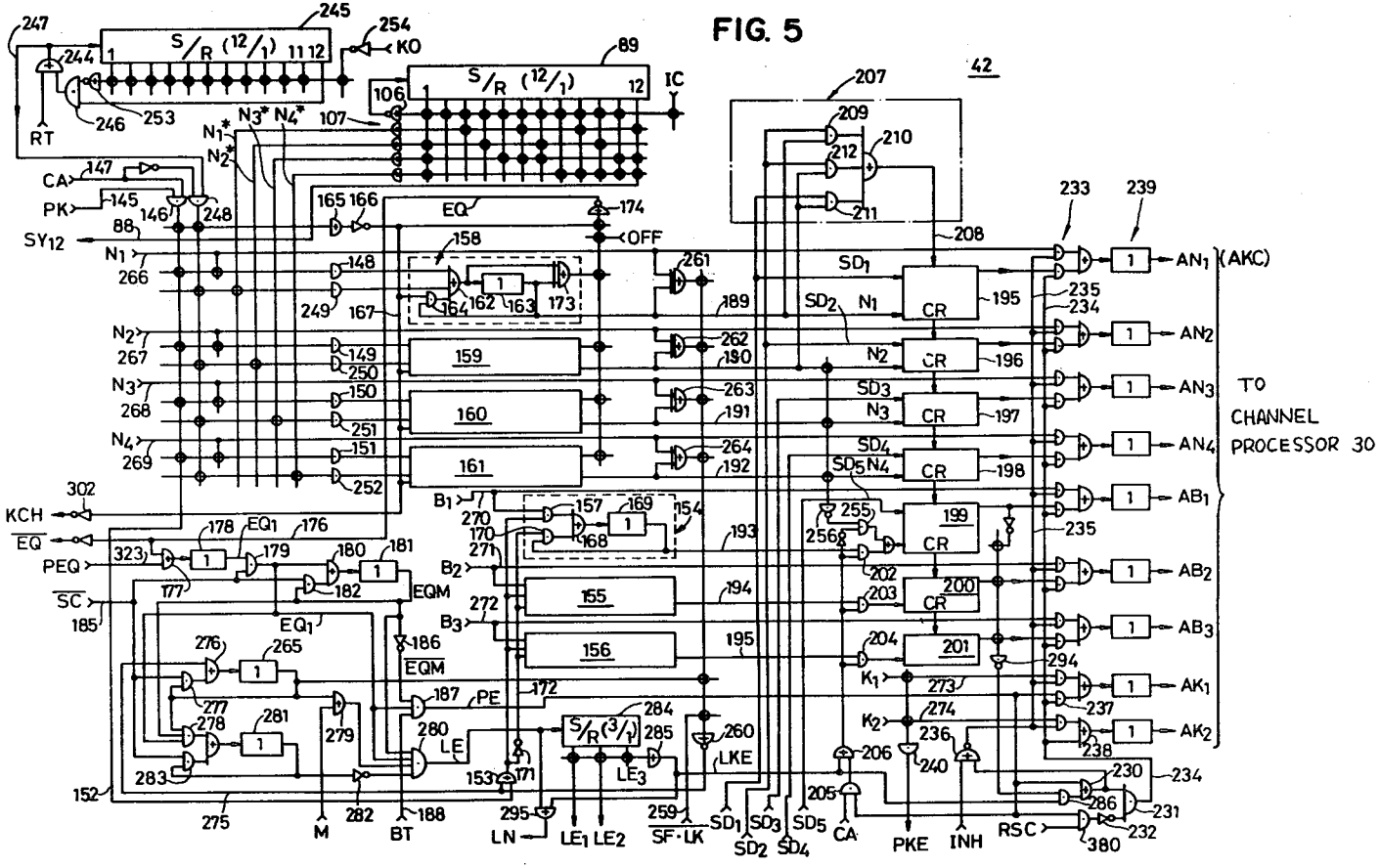
FIG. 5 is a connection diagram showing details of a keycode processor utilized in the embodiment shown in FIG. 2.

The output "1" from the AND gate circuit 146 enables AND gate circuits 148, 149 150 and 151 respectively and also enables a data writing AND gate circuit 157 in octave code memory circuits 154, 155 and 156 via line 152 and an OR gate circuit 153. Although the detail of only the octave code memory 154 is shown in FIG. 5, it should be understood that the other octave code memory circuits 155 and 156 have the same construction.

To the other inputs of the AND gate circuits 148, 149 150 and 151 is applied data $N_1$, $N_2$, $N_3$, $N_4$ of respective bits of the note code given by the key coder 26, and their outputs are stored in note code memory circuits 158, 159, 160 and 161, respectively. Although only the note code memory circuit 158 is shown in detail, it will be clear that the other note code memory circuits 159, 160 and 161 have the same construction. The note code memory circuits 158 through 161 store the data $N_1$ through $N_4$ of respective bits of the note code applied through the AND gate circuit 148, 149, 150 or 151 in the delay flip-flop circuit 163 via an OR gate circuit 162 and the memory is self-held through the AND gate circuit 164. When the output of the AND gate circuit 146 becomes "1" and when write data is given from AND gate circuits 148 through 151, a signal "0" is applied to a self-holding clearing line 167 via an OR gate circuit 165 and an inverter 166 whereby the self-holding AND gate circuit 164 is disenabled thus rewriting the memories of the memory circuits.

The octave code memory circuits 154, 155 and 156 are used to store data $B_1$, $B_2$ and $B_3$ respectively of the bits of the octave code given by the key coder 26, and to the other inputs of a data writing AND gate circuit 157 in respective memory circuits 154, 155 and 156 is applied the data $B_1$, $B_2$ and $B_3$ of the respective bits. In each memory circuit 154–156, the data produced by the data writing AND gate circuit 157 is stored in a delay flip-flop circuit 169 via an OR gate circuit 168 and the stored memory is self-held through a self-holding AND gate circuit 170. When the data holding AND gate circuit 157 is enabled, the "1" output of the OR gate circuit 153 is inverted by an inverter 171 and a signal "0" is applied to a self-holding clearing line 172 thus disenabling the self-holding AND gate circuit 170 to rewrite the memories of respective memory circuits 154, 155 and 156.

AND gate circuits 148 through 151 and 157 for writing data is note code memory circuits 158 through 161 and octave code memory circuits 154, 155, 156 respectively are enabled only when the pedal detection signal PK is generated where the custom function is selected so that the data of the note code $N_1$ through $N_4$ and of the octave code $B_1$ through $B_3$ corresponding to a tone generated by a depressed key of the pedal keyboard 29 is stored in memory circuits 158 through 161 and 154 through 156, respectively.

In other words, during a custom function, the data of a tone acting as the root note of the bass tone which is selected by the key of the pedal actuated keyboard 29 are store respectively in the note code memory circuits 158 through 161 and the octave chord memory circuits 154, 155 and 156.

Bass Tone (Pedal Keyboard Tone) Generation Command

An exclusive OR gate circuit 173 for detecting the coincidence between previously stored data and the data to be subsequently written is provided for each one of the note code memory circuits 158 through 161. This is for utilizing the data stored in the note code memory circuits 158 through 161 as the data of a tone corresponding to the true root tone only when the data is stored in these circuits at least twice consecutively. When the same data is stored twice consecutively, a coincidence signal EQ is generated which disignates generation of a bass tone (pedal keyboard tone.) When the data is stored only once no coincidence signal EQ is generated so that the generation of the tone related to the data is cancelled.

The exclusive OR gate circuit 173 in each of the note code memory circuits 158 through 161 receives previous root tone data stored in the delay flip-flop circuit 163 (the output thereof) and new root tone data (input to the flip-flop circuit 163) from the OR gate circuit 162 and now to be stored in the delay flip-flop circuit 163. Where the data of the same note is stored twice in the memory circuits 158 through 161, the input and output data of the delay flip-flop circuit 163 coincide with each other so that the outputs of all exclusive OR gate circuits 173 of respective memory circuits 158 through 161 become "0". This outputs "0" are applied to the inputs of a NOR gate circuit 174 to generate a coincidence signal EQ but the NOR gate circuit 174 is enabled when the output of the inverter 166 (hence the self-holding clearing line 167) and the system off signal OFF are "0". This system off signal OFF "0" shows that the system is not off, that is, either one of the custom function, the single finger function and the finger chord function is being selected. The system off signal OFF becomes "1" when the AND gate circuit 175 of the function decoder 47 shown in FIG. 4 is enabled. The "0" output of the inverter 166 means that contents of the memory circuits 158 through 161 are renewed, and that new data corresponding to the coincidence detection by the exclusive OR gate circuit 173 is to be stored.

When all inputs to the NOR gate circuit 174 are "0", it produces an output "0" which is applied to the delay flip-flop circuit 178 via line 176 and an OR gate circuit 177 to act as a coincidence signal EQ. The coincidence signal EQ delayed by one bit time by the delay flip-flop circuit 178 is applied to a delay flip-flop circuit 181 via an AND gate circuit 179 and an OR gate circuit 180 and the memory in the delay flip-flop circuit 181 is self-held through an AND gate circuit 182. An inverted note code signal $\overline{SC}$ is applied to the inputs of the AND gate circuit 179 and 182 so that when the start code SC is applied by the key coder 26 at a predetermined time, the AND gate circuit 183 shown in FIG. 3 is enabled to detect the start code thereby supplying the inverted start code $\overline{SC}$ which is a signal "0" to one inputs of AND gate circuits 179 and 182 over an inverter 184 and line 185. Accordingly, when applied with the start code SC, the self-holding function of the delay flip-flop circuit 181 is released.

Generation of the coincidence signal EQ will now be described by taking as an example a case in which a pedal keyboard detection signal PK is generated corresponding to the note $G_2$ of the pedal keyboard as shown in FIG. 9*d*. Thus, in response to the first pedal keyboard detection signal PK, data representing the note G is stored in the note code memory circuits 158 through 161 (FIG. 9*g*) and at a next pedal keyboard detection signal PK, the data representing the note G is also applied so that a coincidence signal EQ will be generated as shown in FIG. 9*h*. When a coincidence signal $EQ_1$ delayed one bit time is stored in the delay flip-flop circuit 181 as shown in FIG. 9*i*, the output of the delay flip-flop circuit 181, or a stored coincidence signal EQM builds up one bit time later than the coincidence signal $EQ_1$ as shown in FIG. 9*j*.

A signal $\overline{EQM}$ produced by inverting the stored coincidence signal EQM by an inverter 186 is applied to one input of an AND gate circuit 187, and the coincidence signal $EQ_1$ is applied to the other input of the AND gate circuit 187. To the remaining input of this AND gate circuit 187 is applied the bass tone generation timing signal BT from the circuit shown in FIG. 4 over a line 188. The bass tone timing signal BT becomes "1" at a timing of automatically generating the bass tone irrespective of the type of tone interval (that is, root tone or subordinate tone).

For this reason, as shown in FIG. 9*k*, the AND gate circuit 187 is enabled during an interval in which the bass tone generation timing signal BT is generated and when both of the delayed coincidence signal $EQ_1$ and an inverted signal $\overline{EQM}$ of the stored coincidence signal EQM are applied to inputs of the AND gate circuit 187 as shown in FIG. 9*l*, it is enabled to produce an output signal "1" which acts as a bass tone (pedal keyboard tone) generation commanding signal PE. The memory coincidence signal EQM which becomes "1" one bit time later than the delayed coincidence signal $EQ_1$ is self-held until the start code SC is generated. Only when the first delayed coincidence signal $EQ_1$ is produced during one period of generating the start code SC, the signal $EQ_1$ and the inverted signal $\overline{EQM}$ enable the AND gate circuit 187. For this reason, while the bass tone generation timing signal BT is being generated, only one bass tone generating commanding signal PE is generated in one period of generation of the start code SC.

The bass tone generation commanding signal PE is generated one bit time later than the coincidence signal EW. The note code $N_1$ through $N_4$ which has generated the coincidence signal EQ is produced from the delay flip-flop circuit 163 of the memory circuits 158 through 161 one bit time later and, at the same time, octave code $B_1$, $B_2$, $B_3$ corresponding to the note code $N_1$ through $N_4$ is also produced from the delay flip-flop circuit 169 of the memory circuits 154, 155 and 156 one bit time later. Consequently, the note code memory circuits 158 through 161 and the octave code memory circuits 154, and 156 produce the data corresponding to the root tone of the bass tone stored therein (the key code data of the tone of the depressed key of the pedal keyboard 29) at the same timing as the bass tone generation commanding signal PE.

Processing of the Key Code

The data representing the note and octave of the tone corresponding to the root tone stored in the note code memory circuits 158 through 161 and the octave code memory circuits 154 through 156 is applied to adders 195 through 201 respectively through lines 189 through 195. Adders 195 through 199 are full adders of one bit while adders 201 and 201 are half adders of one bit and a carry signal CR of an adder of one bit lower order is applied to an adder of one bit higher order, thus constituting a 7 bit adder as a whole. The signals on the output lines 193, 194 and 195 of the octave code memory circuits 154, 155 and 156 are applied to adders 199, 200 and 201 via AND gate circuits 202, 203 and 204 respectively. AND gate circuit 205 is enabled when both of the custom function selection signal CA and the bass tone generation timing signal PE are "1" and the AND gate circuits 202 through 204 are enabled when the output "1" from the AND gate circuit 205 is applied to their inputs via an OR gate circuit 206.

The adders 195 through 201 add the key code data $N_1$ through $B_3$ corresponding to the root tone supplied by the note code memory circuits 158 through 161 and the octave code memory circuits 154 through 156 to the subordinate tone forming data $SD_1$ through $SD_5$ supplied from the subordinate tone forming data generator 40 shown in FIG. 4, thereby producing key code data corresponding to the subordinate tone. The least significant bit $SD_1$ of the subordinate tone forming data is applied to the adder 195 which corresponds to the least significant bit $N_1$ of the note code. The bits $SD_2$, $SD_3$ and $SD_4$ of the higher orders are applied to the adders 195 through 198 corresponding to higher order bits $N_2$, $N_3$ and $N_4$ of the note code while the most significant bit $SD_5$ is applied to the adder 199 which corresponds to the least significant bit $B_1$ of the octave code.

Ths subordinate tone forming data $SD_1$ through $SD_5$ have values corresponding to the interval of the subordinate tone to be produced by using these data relative to the root tone. This data is added to the bit data $N_1$–$B_1$ at the lower orders of the key code which corresponds to the bass tone for producing key code data corresponding to the subordinate tone. However, as can be noted from Table 1, the note codes $N_1$ through $N_4$ is not set such that difference between the note codes for the respective note directly correspond to the interval between these notes. Because the data of the note codes consist of four bits so that they can assume 16 values from "0000" to "1111" whereas the number of the notes of one octave is 12. As Table 1 clearly shows, in the note code $N_1$ through $N_4$, four data in which both bits $N_1$ and $N_2$ are "1", that is, "0011", "0111", "1011" and "1111" are not used and remaining 12 data are allocated for the 12 notes.

Since the number of the half tone interval of one octave is also 12, it is advantageous to set the values of the subordinate tone forming data $SD_1$ through $SD_4$ (except the bit $SD_5$ corresponding to one octave interval) corresponding to the above described values of the note code $N_1$ through $N_4$ More particularly, without using four data "0011", "0111", "1011" and "1111" respectively corresponding to decimal numbers 3, 7, 11 and 15, the remaining 12 data are allocated as shown in the following Table 4 in accordance with the values of the intervals.

Table 4

| note interval | Subordinate tone forming data $SD_4$ | $SD_3$ | $SD_2$ | $SD_1$ | decimal number |
|---|---|---|---|---|---|
| first (1) | 0 | 0 | 0 | 0 | 0 |
| minor second ($2^b$) | 0 | 0 | 0 | 1 | 1 |
| major second (2) | 0 | 0 | 1 | 0 | 2 |
| minor third ($3^b$) | 0 | 1 | 0 | 0 | 4 |
| major third (3) | 0 | 1 | 0 | 1 | 5 |
| perfect fourth (4) | 0 | 1 | 1 | 0 | 6 |
| false fifth ($5^b$) | 1 | 0 | 0 | 0 | 8 |
| perfect fifth (5) | 1 | 0 | 0 | 1 | 9 |
| minor sixth ($6^b$) | 1 | 0 | 1 | 0 | 10 |
| major sixth (6) | 1 | 1 | 0 | 0 | 12 |
| minor seventh ($7^b$) | 1 | 1 | 0 | 1 | 13 |
| major seventh (7) | 1 | 1 | 1 | 0 | 14 |
| one octave (oct) | ($SD_5$) 1 | 0 | 0 | 0 | 16 |

Again note codes $N_1$ through $N_4$ above are shown in the following Table 5.

Table 5

| Group | | Note | $N_4$ | $N_3$ | $N_2$ | $N_1$ | decimal number |
|---|---|---|---|---|---|---|---|
| | a | C# | 0 | 0 | 0 | 0 | 0 |
| I | b | D | 0 | 0 | 0 | 1 | 1 |
| | c | D# | 0 | 0 | 1 | 0 | 2 |
| | a | E | 0 | 1 | 0 | 0 | 4 |
| II | b | F | 0 | 1 | 0 | 1 | 5 |
| | c | F# | 0 | 1 | 1 | 0 | 6 |
| | a | G | 1 | 0 | 0 | 0 | 8 |
| III | b | G# | 1 | 0 | 0 | 1 | 9 |
| | c | A | 1 | 0 | 1 | 0 | 10 |
| | a | A# | 1 | 1 | 0 | 0 | 12 |
| IV | b | B | 1 | 1 | 0 | 1 | 13 |
| | c | C | 1 | 1 | 1 | 0 | 14 |

As shown in Table 5, the notes can be divided into four groups I, II, III and IV each consisting of three notes in which the values of the data N, through $N_4$ are continuous. It is also possible to divide the notes into three groups "a", "b" and "c" according to the values of the notes.

Consider now a case wherein the values of respective note codes $N_1$ through $N_4$ shown in Table 5 are added to the values of the subordinate tone forming data $SD_1$ through $SD_4$ respectively shown in Table 4. Then, it will be noted that the note codes $N_1$ through $N_4$ of the notes (C#, E, G, A#) of group "a" have values that can produce the note code data of predetermined subordinate tones having predetermined intervals with reference to all subordinate tone forming data $SD_1$ through $SD_4$. Accordingly, where any one of the tones of group "a" is utilized as the root tone, it is possible to form note code data $AN_1$ through $AN_4$ corresponding to a desired subordinate tone by merely adding the note code $N_1$ through $N_4$ of the tone of the group "a" which is supplied from the note code memory circuits 158 through 161 via lines 189 through 192 to the subordinate tone forming data $SD_1$ through $SD_4$ respectively by adders 195 through 198.

Where the note codes $N_1$ through $N_4$ of the tones (D, F, G#, R) of group "b" are added to the subordinate tone forming data $SD_1$ through $SD_4$ respectively corresponding to the tones of the major second, perfect fourth, minor sixth and major seventh the result of addition would be data (decimal number 3, 7, 11 or 15) which is not used for the note code $N_1$ through $N_4$. Where the subordinate tone forming data $SD_1$ through $SD_4$ corresponding to the intervals other than those described above are added together, subordinate tone note code data having a predetermined interval can be produced. For example, when a value [1] corresponding to note D is added to value [4] of the data of the minor third interval, the result of addition is [5] thus producing note code data of note F having an interval of minor third degree with respect to the note D. However, when value [2] of the data of the major second interval is added to value [1], the result of addition is [3] which is not used for the note code $N_1$ through $N_4$. Since a tone having the major second interval with respect to the tone D is the tone E, the result of addition must be [4]. This can be attained by adding [1] to the result of addition [3].

For this reason, where the tone of group "b" comprises a root tone, the value of the data is corrected, if necessary, in making addition by the adders 195 through 198. The value correction can be performed by adding a value [1] to the adder 195 from a value correction circuit 207 shown in FIG. 5 via line 208. More particularly, when the values of the note code $N_1$ through $N_4$ of a tone of the group "b" is added to the subordinate tone forming data $SD_1$ through $SD_4$ corresponding to the interval of the major second, perfect fourth, minor sixth or major seventh by adders 195 through 198, the result of addition would be a value [3], [7], [11] or [15] which are not used for note code $N_1$ through $N_4$. However, when a correction value [1] is added via line 208, the above results of addition are corrected to [4], [8], [12] or [0(16)] thus forming correct note code data of the tone having an interval of the major second, perfect fourth, minor sixth or major seventh with respect to the root tone.

A can be noted from Table 5, in a tone of group "b", the logical value of the least significant bit data $N_1$ of the note code is "1". For this reason, the signal on the output line 181 of the note code memory circuit 158 corresponding to bit $N_1$ is applied to one input of an AND gate circuit 209 of the value correction circuit 207 so as to enable this AND gate circuit when the root tone belongs to group "b". Furthermore, as shown in Table 4, the logical value of the data $SD_2$ of the second from the least significant bit of the subordinate tone forming data having intervals of the major second, perfect fourth, minor sixth and major seventh is "1", so that data $SD_2$ is added to the other input of the AND gate circuit 209. When this AND gate circuit 209 is enabled, 9 signal "1" is produced so that a value [1] is added to adder 195 via an OR gate circuit 210 and line 208 for correcting the value.

Where the values of the note codes $N_1$ through $N_9$ of the tones (D#, F#, A, C) of group "C" shown in Table 4 and the values of the subordinate tone forming data $SD_1$ through $SD_4$ corresponding to the interval of the minor seventh shown in Table 4 are added together, the results of addition would be data (decimal number 3, 7, 11 or 15) not used for the note code $N_1$ through $N_4$. In the same manner as above described, when the values of the note codes $N_1$ through $N_4$ of the tones of group "C" and the values of the subordinate tone forming data $SD_1$ through $SD_4$ corresponding to an interval of the major second, perfect fourth minor sixth or major seventh shown in Table 4 are added together, the results of addition would form a tone one half tone lower than the tone inherently having the above described relationship (major second, perfect fourth . . .).Accordingly, in the same manner as in group "b", it is necessary to add a value [1] to the adder 195 from the value correction circuit 207 via line 208 for effecting a value correction. However, the subordinate tone forming data of the tone interval (first, minor third, false fifth and major sixth) other than those described above are not required to be corrected.

As shown in Table 5, since the logical value of the data $N_2$ which is the second from the least significant bit of the note coder of the tones of group "c" is "1", the signal on the output line 190 of the note code memory circuit 159 is applied to one inputs of AND gate circuits 211 and 212 thus enabling these AND gate circuits when the tone belonging to the group "c" corresponds to the root tone. Furthermore, as shown in Table 4, the logical value of the least significant bit data $SD_1$ of the subordinate tone forming data corresponding to an interval of the minor second, major third, perfect fifth or minor seventh is "1", and the logical value of the data $SD_2$ which is the second from the subordinate tone forming data corresponding to an interval of the major second, perfect fourth, minor sixth or minor seventh is also "1". For this reason, the least significant bit data $SD_1$ of the subordinate tone forming data is applied to one input of the AND gate circuit 211 and the data $SD_2$ which is the second from the least significant bit is applied to one input of the AND gate circuit 212. Thus, either one of the AND gate circuits 211 and 212 is enalbed, so that a signal "1" is applied to line 208 via an OR gate circuit 210 thus adding a correction value [1] to the adder 195.

For example, when the root tone is tone D#, assuming now that data corresponding to the interval of the major third are given as the subordinate tone forming data $SD_1$ through $SD_4$ both $N_2$ and $SD_1$ on line 190 are "1" so that the AND gate circuit 211 is enabled to apply signal "1" to line 208. Accordingly, the addition operation of the adders 195 through 198 is [2+5+1=8] in terms of decimal number thereby obtaining the result of addition as the note code data of tone G having the tone interval of the major third rather than tone D#.

When the result of addition of the adders 195 through 190 corresponding to the note codes $N_1$ through $N_4$ exceeds a decimal [16], the adder 198 produces a carry signal CR which is applied to adder 199 corresponding to one octave interval. In adders 199 through 201 for processing the octave code, the carry signal CR from the adder 198 and the subordinate tone forming data $SD_5$ (see the bottom line of Table 4) corresponding to one octave interval are added to the octave code $B_1$, $B_2$, $B_3$ of the tone corresponding to the root tone stored in the octave code memory circuit 154, 155 and 156.

Generation of the Subordinate Tone Forming Data

The subordinate tone forming data $SD_1$ through $SD_5$ is applied to the adders 195 through 199 shown in FIG. 5 from the interval value memory circuit 213 shown in FIG. 4 via a delay flip-flop circuit 214. The interval value memory circuit 213 comprises an encoder constituted by five OR gate circuits corresponding to the respective bits of the data $SD_1$ through $SD_5$ whereby the subordinate tone forming data $SD_1$ through $SD_5$ having values as shown in Table 4 are read out in response to the output from the bass system subordinate tone selection gate circuit 129 or the chord system subordinate tone selection gate circuit 215. The bass system subordinate tone selection gate circuit 129 comprises a plurality of AND gate circuits corresponding to various note intervals. The AND gate circuits of the bass system subordinate tone selection gate circuit 129 are enabled by the bass pattern pulses $T_1$ through $T_{17}$ supplied from a bass pattern generator 41 shown in FIG. 6 whereby the subordinate tone forming data $SD_1$ through $SD_5$ is read from the interval value memory circuit 213. Normally, a NOR gate circuit 216 applies a signal "1" to the inputs of respective AND gate circuits in the subordinate tone selection gate circuit 129 which is applied with the bass pattern pulses $T_3$ through $T_{17}$ thus enabling to select the subordinate tone corresponding to the bass pattern pulses $T_3$ through $T_{17}$.

The minor detection signal $D_m$, seventh detection signal $D_7$, signal m+7 or signal $m\cdot\overline{7}$ applied to the bass system subordinate tone selection gate circuit 129 from the chord type detection circuit 109 via lines 122, 124 127 and 128 are used to select a chord type of major or minor for chords having a note interval of the third, sixth or seventh degree.

In response to the bass pattern pulses $T_3$ through $T_{17}$ and the chord type detection signals from lines 122, 124, 127 and 128, the bass system subordinate tone gate circuit 129 generates signals, 2, $3^b$, 3 . . . 7, oct, oct+$3^b$ and oct+3 which select the subordinate tones having various intervals according to the relationship to be described hereinafter. In the following description, the logical equations of respective AND gate circuits of the bass system subordinate tone selection gate circuit 129 are explained. To simplify the description, the output signal from the NOR gate circuit 216 is omitted from the conditions of the logical equations. The description starts from the AND gate circuit 217 on the lefthand side of the subordinate tone selection gate circuit 129 shown in FIG. 4.

$$2=T_3$$ (AND gate circuit 217)

The bass pattern pulse $T_3$ generates a subordinate tone selection signal 2 having a major second interval.

$$3^b=T_5\cdot Dm'$$ (AND gate circuit 218)

When the minor detection signal Dm (minor third interval signal $S3^b$) is being generated, the bass pattern pulse $T_5$ generates the subordinate tone selection signal $3^b$ having a minor third interval.

$$3=T_5\cdot\overline{Dm}$$ (AND gate circuit 219)

When the minor detection signal Dm is not generated, the bass pattern pulse $T_5$ generates a subordinate tone selection signal 3 having a major third interval.

$$4=T_6$$

The bass pattern pulse $T_6$ generates a subordinate tone selection signal 4 having a perfect fourth interval $$5^b=T_7$$

The bass pattern pulse $T_7$ produces a subordinate tone selection signal $5^b$ having a false fifth interval $$5=T_8$$

The pulse $T_8$ generates a subordinate tone selection signal 5 having a perfect fifth interval $6 = T_{10}$ The pulse $T_{10}$ generates a subordinate tone selection signal 6 having a major sixth interval.

$6^b = T_{10}' \cdot (m \cdot \overline{7})$ (AND gate circuit 220)

Where the seventh detection signal $D_7$ is not produced, and where the minor detection signal Dm is produced (that is when the minor chord detection signal $m \cdot \overline{7}$ having the fifth interval is "1"), pulse $T_{10}'$ generates a subordinate tone selection signal $6^b$ having a minor sixth interval.

$6 = T_{10}' \cdot (\overline{m \cdot 7})$ (AND gate circuit 221)

In cases other than a case wherein the seventh detection signal D7 is not produced and the minor detection signal Dm is produced (that is, the minor detection signal $m \cdot \overline{7}$ having the fifth interval is "0" or, alternatively stated, in the case where the major chord is a seventh chord or a minor seventh chord), the bass pattern pulse $T_{10}'$ produces a subordinate tone selection signal 6 having a major sixth interval.

$7^b = T_{11}$

The bass pattern pulse $T_{11}$ generates a subordinate tone selection signal $7^b$ having a minor seventh interval.

$7^b = T_{12} \cdot (m + 7)$ (AND gate circuit 222)

Where either one of the minor detection signal Dm and the seventh detection signal $D_7$ is generated (that is, the detection signal m+7 of the minor chord, or seventh chord or minor seventh chord is "1"), the bass pattern pulse $T_{12}$ produces a subordinate tone selection signal $7^b$.

$7 = T_{12} \cdot (\overline{m + 7})$ (AND gate circuit 223)

Where both the minor detection signal Dm and the seventh detection signal $D_7$ are not produced (that is the signal m+7 is "0") the bass pattern pulse $T_{12}$ produces a subordinate tone selection signal 7 having a major seventh interval.

$7^b = T_{12}' \cdot D_7$ (AND gate circuit 224)

Where the seventh detection signal $D_7$ is generated, the bass pattern signal $T_{12}'$ generates a subordinate tone selection signal $7^b$ having a minor seventh interval.

$7 = T'_{12} \cdot \overline{D_7}$ (AND gate circuit 225)

Where the seventh detection signal $D_7$ is not produced, the bass pattern pulse $T_{12}'$ produces a subordinate tone selection signal 7 having a major seventh interval.

$\text{oct} = T_{13}$

The bass pattern pulse $T_{13}$ produces a subordinate tone selection signal Oct having an interval one octave higher than the root tone.

$\text{oct} + 3^b = T_{17} \cdot D_m$ (AND gate circuit 226)

Where the minor detection signal Dm is generated, the bass pattern pulse $T_{17}$ generates a subordinate tone selection signal $\text{oct} + 3^b$ having a minor third interval one octave higher than the root tone $\text{oct} + 3 = T_{17} \cdot \overline{D_m}$ (AND gate circuit 227)

Where the minor detection signal Dm is not produced, the bass pattern pulse $T_{17}$ produces a subordinate tone selection signal oct+3 having a major third interval one octave higher than the root tone.

As can be noted from the foregoing description, the subordinate tone selection signal 2, $3^b$, 3 . . . oct+3 having various intervals and generated by various AND gate circuits of the bass system subordinate tone selection gate circuit 129 in response to bass pattern pulses $T_3$ through $T_{17}$ are combined and then applied to the inputs of various OR gate circuit of the interval value memory circuit 213 such that subordinate tone forming data having predetermined values as shown in Table 4 can be obtained. As can be noted from the connection of the interval value memory circuit 213, since the values $SD_5$, $SD_4$, $SD_3$, $SD_2$ and $SD_1$ of the subordinate tone forming data corresponding to the major second interval are "00010" (see Table 3 above), the subordinate tone selection signal 2 produced by the AND gate circuit 217 is applied to the input of only the OR gate circuit corresponding to the subordinate tone forming data $SD_2$ but not applied to the inputs of the other OR gate circuits.

Since the bass pattern pulse $T_1$ corresponds to the root tone, it is not used directly in the subordinate tone selection gate circuit 129. When this pulse $T_1$ is generated (and the other pulses $T_2$ through $T_{17}$ are also not produced), the subordinate tone forming data $SD_1$ through $SD_5$ is "00000" whereby the adders 195 through 201 shown in FIG. 5 produce, without any modification, the note and octave code data of the root tone which are applied to the adders via lines 189 through 195.

Outline of the Generation of the Bass Pattern

The bass pattern pulses $T_1$ through $T_{17}$ corresponding to the interval (the interval for the root tone) of a tone (a root tone or a subordinate tone) generated as a bass tone have such timings that predetermined pulses ($T_1$ through $T_{17}$) are generated at predetermined timing over predetermined duration in respective bass patterns. The player selects a predetermined bass pattern corresponding to a desired rhythm and the bass pattern generator 41 shown in FIG. 6 generates bass pattern signals ($T_1$ through $T_{17}$) that realize the selected bass pattern. One bass pattern not only corresponds to one rhythm, but a plurality of bass patterns are prepared for one rhythm, which are available for the player's selection. For example, where it is possible to select 6 types of the bass patterns for one rhythm and where it is possible to select 14 different rhythms, the bass pattern generator 41 will be constructed such that $14 \times 6 = 84$ types of the bass patterns can be selected.

Figure 12:
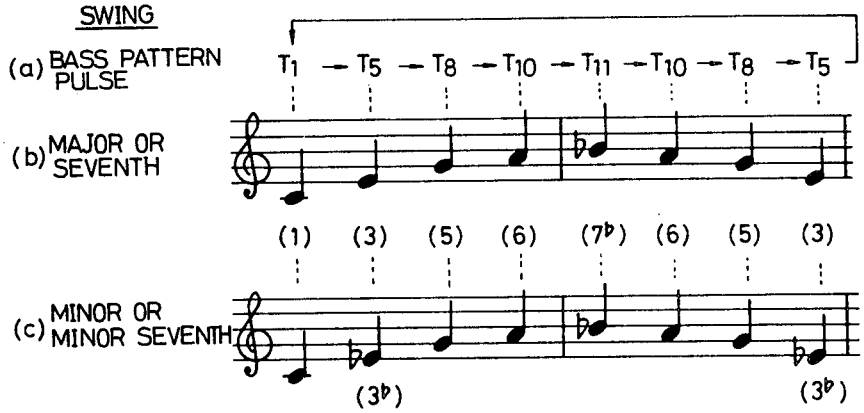
Figure 13:
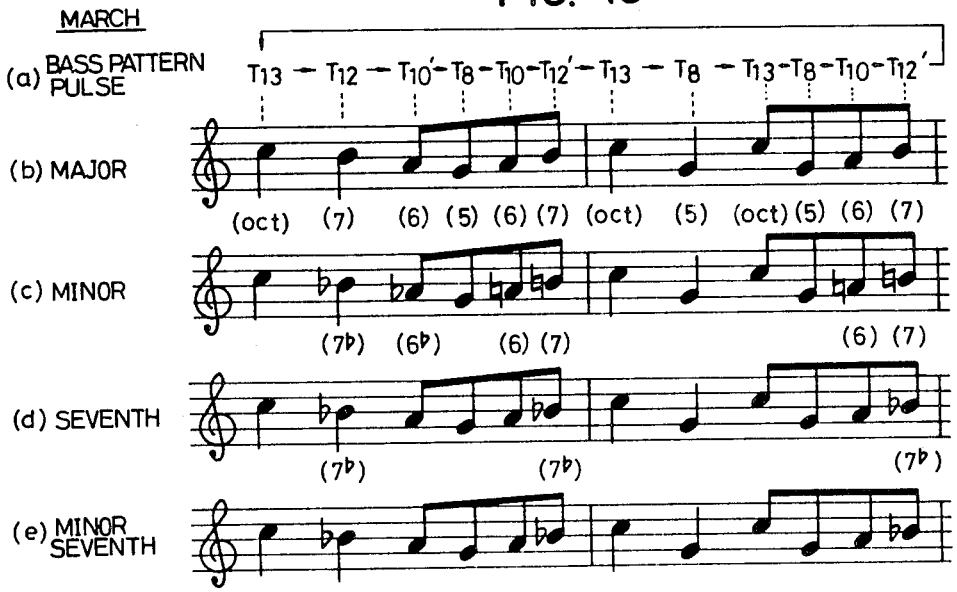

FIGS. 12 and 13 show one example of the bass pattern on the score. On the assumption that the position on the lowest line (position of the tone $C_4$ represents the root tone (the first degree), the interval relationship of respective subordinate tones are expressed on the score. The time length of the musical note corresponds to the timing length of a specific bass tone which corresponds to the interval of generation of the bass pattern pulses $T_1$ through $T_{17}$ which are generated in accordance with said specific note interval.

FIG. 12 shows one of the bass patterns which are selectable when swing has been selected as the desired rhythm, whereas FIG. 13 shows one of the bass patterns which are selectable when march has been selected as the desired rhythm.

Where the player has selected the bass pattern shown in FIG. 12, the bass pattern generator 41 shown in FIG. 6 generates, sequentially and repeatedly, pattern pulses $T_1$, $T_5$, $T_8$, $T_{10}$, $T_{11}$, $T_{10}$ $T_8'$ and $T_5$ as shown in FIG. 12*a*. In response to respective pulses $T_1$ through $T_{11}$, the bass system subordinate tone selection gate circuit 129 (shown in FIG. 4) sequentially produces subordinate tone selection signals 1 through $7^b$ having a predetermined interval. In the case of the major or seventh chord, the order of the selection signals is $1 \rightarrow 3 \rightarrow 5 \rightarrow 6 \rightarrow 7^b \rightarrow 6 \rightarrow 5 \rightarrow 3$ as shown in FIG. 12*b*, whereas in the case of a minor or minor seventh chord the order is $1 \rightarrow 3b \rightarrow 5 \rightarrow 6 \rightarrow 7^b \rightarrow 6 \rightarrow 5 \rightarrow 3^b$ as shown in FIG. 12*c*. While the bass pattern pulse $T_5$ is used to select a third interval, its interval varies to the major third or the minor third in accordance with the type of the chord. In the case of a minor chord or a minor seventh chord, the AND gate circuit 218 of the selection gate circuit 129 is enabled by a minor detection signal DM sent over line 122 (FIG. 4) thus supplying the subordinate tone selection signal $3^b$ having a minor third interval to the interval value memory circuit 213 in response to the pulse $T_5$. In the case of a major chord or a major seventh chord, the minor detection signal Dm is "0" so that the AND gate circuit 214 of the subordinate tone selection gate circuit 129 is enabled thereby applying the subordinate selection signal 3 having a major third interval to the interval value memory circuit 213 in accordance with the pulse $T_5$.

The bass pattern pulse $T_{12}'$ is used for the purpose of selecting the seventh interval which varies depending upon whether the chord is the seventh chord or not. More particularly, in the case of the seventh chord, AND gate circuit 224 of the subordinate tone selection gate circuit 129 is enabled by the seventh detection signal $D_7$ on line 128, thereby generating the subordinate tone selection signal $7^b$ having a minor seventh interval in accordance with the bass pattern pulse $T_{12}'$. For chords other than the seventh chord, the seventh detection signal $D_7$ is "0" so that the AND gate circuit 125 of the subordinate tone selection gate circuit 129 is enabled thus generating a subordinate tone selection signal 7 having a major seventh interval in accordance with the bass pattern pulse $T_{12}'$.

The bass pattern pulse $T_{11}$ is used for the purpose of selecting a minor seventh interval irrespective of the type of the chord. (see FIG. 12).

On the other hand, the bass pattern pulse $T_{12}$ is used for the purpose of selecting the seventh interval which varies depending upon whether the chord is the major chord or not. More particularly, in the case of a minor, minor seventh or seventh chord, the minor detection signal Dm or the seventh detection signal $D_7$ is "1" so that the output signal (m+7) of the OR gate circuit 123 is "1". Accordingly, the AND gate circuit 222 of the base system subordinate tone selection gate circuit 129 is enabled thus generating the subordinate tone selection signal $7^b$ having a seventh interval in accordance with the bass pattern pulse $T_{12}$. In the case of a major chord, since the output signal (m+7) of the OR gate circuit 123 is "0", the AND gate circuit 223 is enabled whereby a subordinate tone selection signal 7 having a major seventh interval is produced in accordance with the bass pattern pulse $T_{12}$.

The bass pattern pulse $T_{10}$, is used for the purpose of selecting a minor sixth interval only when the chord is the minor chord. More particularly, when the minor chord detection signal ($m \cdot \overline{7}$) having a fifth interval and produced by the AND gate circuit 126 is "1", the AND gate circuit 220 is enabled to generate a subordinate selection signal $6^b$ having the minor sixth interval in accordance with the bass pattern selection pulse $T_{10}'$. In the case of a major seventh of minor seventh chord the minor detection signal ($m \cdot \overline{7}$) is "0" so that the AND gate circuit 221 is enabled and a subordinate selection signal 6 having a major sixth interval is produced in accordance with the bass pattern pulse $T_{10}'$.

The bass pattern pulse $T_{10}$ is used for the purpose of selecting a major sixth interval irrespective of the type of the chord.

The bass pattern pulse $T_{17}$ is used for the purpose of selecting a third interval one octave higher than the root tone which varies in accordance with the type of the chord. In this case, the AND gate circuit 226 is enabled by the minor detection signal Dm thereby producing a subordinate tone selection signal (oct+$3^b$) having a minor third interval which is one octave higher than the root tone in accordance with the bass pattern pulse $T_{17}$. In a case where the minor detection signal Dm is "0", the AND gate circuit 227 is enabled so that a subordinate tone selection signal oct+3 having a major third interval which is one octave higher than the root note is produced in accordance with the bass pattern pulse $T_{17}$.

The bass pattern pulses utilized in the system not only include substantially all intervals necessary for one octave but also include intervals one octave higher. Moreover, even when subordinate tone selection signals of the same interval are to be generated, the circuit is constructed such that different pulses (for example $T_{10}$ and $T_{10}'$, $T_{11}$ and $T_{12}$, and $T_{12}'$) can be used for different purposes. Moreover, since these pulses enable the interval to change in accordance with the type of the chords, an extremely complicated use is possible in accordance with the bass patterns. For this reason, it is possible to automatically perform a bass performance whose note interval varies so intricately that it may be termed a "walking bass". The bass patterns shown in FIGS. 12 and 13 are of the walking bass type. With the prior art automatic bass performance system, it is only possible to generate intervals of the first, third, fifth and seventh degrees, and can not generate intervals of the second, fourth and sixth degrees thus resulting in a monotonous bass performance.

FIG. 13 shows one example of a bass pattern in which pulses $T_{10}'$, $T_{12}$, and $T_{12}'$ whose selection intervals very according to the type of the chords are used for performing a complicated bass performance. As shown in FIG. 13*a*, pattern pulses $T_{13}$, $T_{12}$, $T_{10}'$, $T_8$, $T_{10}$, $T_{12}'$, $T_{13}$, $T_8$, $T_{10}$ and $T_{12}'$ are sequentially and repeatedly produced. The bass system subordinate tone selection gate circuit 129 sequentially produces subordinate tone selection signals respectively having predetermined intervals in accordance with respective bass pattern pulses $T_{13}$, through $T_{12}'$ so that, as shown in FIG. 13, the interval value memory circuit 213 produces the subordinate tone forming data $SD_1$ through $SD_1$ through $SD_5$ of varying intervals.

In the case of a major chord, the bass pattern pulses $T_{10}'$, $T_{12}$ and $T_{12}'$ select the subordinate tone selection signals 6 and 7 having the major sixth and the major seventh intervals respectively so that the subordinate tone selection signal is produced in the order of oct→7→6→5→6→7→oct→5→oct→5→6→7 . . . as shown in FIG. 13*b*. In response to this signal, the subordinate tone forming data $SD_5$ through $SD_1$ is generated in the order of "10000"→"01110"→"01100"→"01001"→. . . , whereby the bass performance proceeds in the order of a tone one octave higher than the root tone→a tone which is major seventh degree higher than the root tone→a tone which is major seventh degree higher than the root tone→a tone which is major sixth degree higher than the root tone→and so on.

In the case of a seventh chord or a minor seventh chord, a flat symbol is added to a tone having a sixth interval corresponding to the bass pattern pulses $T_{12}$ and $T_{12}'$ to select a minor seventh interval $7^b$ thus enabling a bass performance to proceed as shown in FIGS. 13*d* and 13*e*.

In the case of a minor chord, a minor seventh interval $7^b$ is selected by the pulse $T_{12}$, a minor sixth interval $6^b$ by pulse $T_{10}$, a major sixth interval 6 by pulse $T_{10}$ and a major seventh tone 7 by pulse $T_{12}'$. For this reason, as shown in FIG. 13*c*, where the tone pitch falls, a flat sign is applie to the tones having the seventh and sixth intervals to form minor seventh and minor sixth intervals respectively, whereas when the tone pitch rises, a natural sign is applied thus resuming the original major seventh and the major sixth intervals respectively.

As above described, in the bass progress in which a flat sign is applied to the tones of the seventh and sixth intervals while the tone pitch falls during the proceeding of the bass tone of the minor chord for dropping the tone pitch by a semitone, and in which the tones of the seventh and sixth intervals are returned to the original major seventh and the major sixth intervals while the tone pitch is rising, is extremely effective for the bass performance of a certain type of rhythm, and extremely important for enhancing the bass performance effects. In this embodiment, the pulse pattern pulses $T_{12}$ and $T_{10}'$ are used to select the seventh and sixth intervals at the time of lowering the tone pitch, whereas pulses $T_{12}'$ and $T_{10}$ are used for the purpose of selecting the seventh and the sixth intervals at the time of rising the tone pitch, so that it is possible to perform an automatic performance in which the bass progress is made in an extremely complicated manner.

As shown in FIGS. 12 and 13, the spacing of generating respective bass pattern pulses $T_1$ through $T_{17}$ correspond to the duration of the tones having specific intervals of the bass pattern. In other words, the spacings correspond to the intervals of key depression when the player performs the bass tone by actually depressing the keys. The interval of generating a single pulse ($T_1$ through $T_{17}$) is much longer than the period of the system clock of the automatic bass chord performance control device 31 and sufficiently longer than the period of the start code SC.

Delivery of Key Code Data of Bass Tones

The bass pattern pulses $T_1$ through $T_{17}$ are applied to the inputs of an OR gate circuit 228 shown in FIG. 4 for producing a bass tone producing timing signal BT on line 188. A delay flip-flop circuit 229 inserted in the line 188 and a group of delay flip-flop circuit 214 for delaying the subordinate tone forming data $SD_1$ through $SD_5$ are used to synchronize with the one bit time delay of the key code data of the root tones caused by the note code memory circuits 158 through 161 and the octave code memory circuits 154, 155 and 156 shown in FIG. 5. As above described, the bass tone generation timing signal BT enables the AND gate circuit 187 shown in FIG. 5 thus establishing a condition in which the bass tone generation commanding signal PE can be produced.

The bass tone generation commanding signal PE (see FIG. 9L) generated by the AND gate circuit 187 is applied to one input of an AND gate circuit 231 via an OR gate circuit 230 shown in FIG. 5. The signal applied to the other input of the AND gate circuit 231 from an inverter 232 is normally "1" thus enabling the AND gate circuit 231. Accordingly, in response to the bass tone generation commanding signal PE the AND gate circuit 231 produces a signal "1" to supply a signal "1" to a processing data selection enabling line 234 of the key data selection gate circuit 233.

The key data selection gate circuit 233 is provided with a plurality of AND gate circuits and a plurality of OR gate circuits, and the AND gate circuits with their inputs connected to receive the outputs of the adders 195 through 201 are enabled by the signal "1" on the processing data selection enabling line 234 thus selecting processed key code data. On the other hand, the AND gate circuit of the key data selection gate circuit 233 having their inputs connected to respectively receive the key code data $N_1$-$N_4$ $B_1$-$B_3$, $K_1$, $K_3$ which is supplied from the key coder 26 via lines 266 through 274 in accordance with the depression of the keys of the keyboard are enabled by the signal "1" on an original data selection enabling line 235 thereby selecting key code data $N_1$ through $K_2$ corresponding to the keys depressed at that time.

The bass tone generation commanding signal PE is applied to one input of a NOR gate circuit 236 via an OR gate circuit 230 so that the signal on the original data selection enabling line 235 connected to the output of the NOR gate circuit 236 is changed to "0" thus inhibiting the selection of data $N_1$ through $K_2$ generated by the key coder 26 in accordance with the depressed keys. Then, the signal on a processed data selection enabling line 234 becomes "1" thus selecting the processed key code data $AN_1$-$AN_4$ and $AB_1$-$AB_3$ which is formed as a result of the addition. The bass tone generation commanding signal PE is also applied to one input of an AND gate circuit 237 of the key data selection gate circuit 233 for producing the first bit data $AK_1$ of the keyboard code in response to signal "1" on the processed data selection enabling line 234. In other words, when the signal PE is "1" the data $AK_1$ is also "1". Furthermore, the signal on the processed data selection enabling line 234 is used to act as the second bit data $AK_2$ of the keyboard code via an OR gate circuit 238 of the key data selection gate circuit 233. Consequently, when the signal on the line 234 is "1", the data $AK_2$ is also "1".

When the bass tone generation commanding signal PE is produced, the processed data of the keyboard code becomes "11" then producing data which represents the tone of the pedal keyboard, that is, a bass tone. For this reason, the processing key code data $AN_1$ through $AB_3$, produced by adders 195 through 201 are processed as the bass tone data in the subsequent circuits, for example the channel processor 30, etc. The selected output from the key data selection gate circuit 233 is synchronized with the system clock by the delay flip-flop group 239 and then applied to the channel processor 30.

As above described, key code data $AN_1$ through $AK_2$ corresponding to the root tone and the subordinate tone are formed as if predetermined keys were actually depressed according to a predetermined bass pattern with a predetermined timing, and this data is applied to the channel processor 30.

Consider a case where a custom function, for example, is selected. Assuming that a key of note $C_2$ of the pedal keyboard 29 has been depressed, that a major chord has been formed by depressing keys of the lower keyboard 28, and that a pattern as shown in FIG. 12 has been selected as the bass pattern, processed key code data $AN_1$ through $AK_2$ would be generated sequentially as shown in the following Table 6.

Table 6

| Pattern pulse | | (root tone $C_2$) $AK_2$ | $AK_1$ | $AB_3$ | $AB_2$ | $AB_1$ | $AN_4$ | $AN_3$ | $AN_2$ | $AN_1$ | note |
|---|---|---|---|---|---|---|---|---|---|---|---|
| → | $T_1$ | 1 | 1 | 0 | 0 | 0 | 1 | 1 | 1 | 0 | $C_2$ |
| ↑ | $T_5$ | 1 | 1 | 0 | 0 | 1 | 0 | 1 | 0 | 0 | $E_2$ |
| ↑ | $T_8$ | 1 | 1 | 0 | 0 | 1 | 1 | 0 | 0 | 0 | $G_2$ |
| Time | $T_{10}$ | 1 | 1 | 0 | 0 | 1 | 1 | 0 | 1 | 0 | $A_2$ |
| ↓ | $T_{11}$ | 1 | 1 | 0 | 0 | 1 | 1 | 1 | 0 | 1 | $A_{2\#}$ |
| ↓ | $T_{10}$ | 1 | 1 | 0 | 0 | 1 | 1 | 1 | 1 | 0 | $A_2$ |
| ↓ | . | | | | | | . | | | | . |
| → | . | | | | | | . | | | | . |

In Table 6, assume by way of example that the width of the pattern pulse is about 100 ms. Since the bass tone generation commanding signal PE is generated once during one period of generating the start code as has been described with reference to FIG. 9*l*, when the period of generation of the start code SC is selected to be about 5 ms, key code data $AN_1$ through $AK_2$ having the same value must be produced sequentially at an interval of above 5 ms and such generation would be repeated 20 times during an interval in which one pattern pulse ($T_1$, $T_5$, $T_5$, . . . ) is generated.

As above described, in the channel processor 30, when one key code data is supplied during the interval of generating one start code SC, it is judged that keys relating to the key code data have been depressed. Accordingly, the processed key code data $AN_1$ through $AK_2$ of the bass tone which is generated once during the interval of generating the start code SC is sequentially received by the channel processor 30 and assigned to and stored by predetermined tone generating channels.

The keyboard code $K_1$, $K_2$ supplied by the key coder 26 is applied to the inputs of an AND gate circuit 240 shown in FIG. 5 so as to produce therefrom a pedal keyboard detection signal PKE (="1") where the code is the key code of the pedal keyboard. The pedal keyboard detection signal PKE is applied to one input of the AND gate circuit 240 shown in FIG. 4. The other input of the AND gate 240 is connected to receive a signal $\overline{OFF}$ produced by inverting by inverter 242 the automatic performance OFF signal OFF produced by the AND gate circuit 175 of the function decoder 47. The output "1" from the AND gate circuit 241 is changed to an original key data inhibition signal INH by OR gate circuit 243 and then applied to one input of the NOR gate circuit 236 shown in FIG. 5. Consequently, the output of the NOR gate circuit 236 becomes "0" so that the signal on the original data selection enabling line 235 of the key data selection gate circuit 233 becoms "0" thereby inhibiting the selection of data $N_1$ through $K_2$ produced by the key coder 26. Consequently, when the automatic bass chord performance such as the custom function, the finger chord function or the single finger function is selected (in this case, signal OFF is "0") where key codes $N_1$ through $K_2$ of the keys actually depressed on the pedal keyboard 29 is supplied from the key coder 26, the original data inhibition signal INH is produced thereby inhibiting the key data selection key gate circuit 233 from selecting the original codes $N_1$ through $K_2$ identical to those produced by the depressed keys. In other words, only the processed key data ($AN_1$ through $AK_2$) of the bass tone is supplied to the channel processor 30.

Generation of the Chord Tone at Custom Function

In the case of the custom function (and the finger chord function), the key code data $N_1$ through $K_2$ of a chord tone, that is a tone produced by the depressed keys of the lower keyboard 28 is selected by signal "1" on the original data selection enabling line 235 produced by the key data selection gate circuit 233 without being modified in any way by the automatic bass chord performance control device 31 (FIG. 2) and then sent to the channel processor 30. This is because, at a time at which the key code $N_1$ through $K_2$ of the lower keyboard 28 is supplied from the key coder 26, the output of the OR gate circuit 230 (FIG. 5) and the original key data inhibition signal INH are "0", so that the output of the NOR gate circuit 236 is "1". However, where the single finger function is selected as will be described later, the original key data inhibition signal INH will be formed in response to the key code data of the lower keyboard.

In the channel processor 30, respective tones of depressed keys of the lower keyboard 30, that is, respective chord component tones are assigned to suitable tone generating channels. The musical tone signals of respective chord component tones are produced by the musical tone generation circuit 32 (FIG. 2). The amplitude envelopes of respective chord component tones are simultaneously and similarly controlled according to an envelope waveform signal produced by the envelope generation circuit 33 at each timing of the chord tone, thereby producing a chord tone. The timing of producing the chord tone is set by a chord tone generation timing signal CG supplied by a chord tone generation timing control device 43.

Finger chord Function

In the finger chord function, the chord tone is produced in the same manner as in the custom function described above. For the finger chord function, only the lower keyboard 28 is used and the pedal keyboard 29 is not used so that the method of generating the bass tone is somewhat different from that of the custom function described above.

Where the finger chord function has been selected, the finger chord function selection signal FC becomes "1" and a signal (FC+CA) on line 100 also becomes "1", whereby AND gate circuits 97 and 78 of the chord detection logic 96 (FIG. 3) are enabled. As has been described hereinabofe, the root tone detection signal RT is generated at a timing corresponding to the root tone of the detected chord. The root tone detection signal RT generated by the OR gate circuit 108 shown in FIG. 3 is applied to one input of an OR gate circuit 244 shown in FIG. 5 so as to be written into a root tone timing memory shift register 245 which is used to store the root tone with a switable timing. Since the timings for 12 tones are assigned to respective bit times on the time division basis, the applied root tone detection signal RT is delayed by 12 bit times and the output of the twelfth stage is applied to one input of an AND gate circuit 246 so as to cause it to circulate through the shift register 245 vai an OR gate circuit 244. In this manner, the note of the root tone is stored on the time divsion basis.

The root tone detection signal RT produced by the OR gate circuit 244 is applied to one input of an AND gate circuit 248 via line 247. To the other input of the AND gate circuit 248 is applied a signal produced by inverting the custom function selection signal CA by an inverter. Accordingly, in the case of the "finger chord function" and the "single finger function", the AND gate circuit 248 is enabled. Signal "1" produced by the AND gate circuit 248 in accordance with the timing of generating the root tone detection signal RT is applied to one inputs of OR gate circuit 165 and AND gate circuits 249, 250, 251 and 252.

The least significant bit data $N_1$* of respective note codes generated by the tone designation encoder 107 on the time division basis as shown in FIG. 10c is applied to one input of the AND gate circuit 249, and data $N_2$*, $N_3$* and $N_4$* are applied to one inputs of the AND gate circuits 250, 251 and 252 respectively. Accordingly, the note code data $N_1$* through $N_4$* corresponding to the note of the root tone selected by the AND gate circuits 249 through 252 at the timing of generating the root tone detection signal $RT_1$ and stored in the note code memory circuits 158 through 161 respectively. More particularly, old data previously stored in the delay flip-flop circuit 163 of the note code memory circuit will be cleared by the output "1" from the OR gate circuit 165 via a clear line 167 and AND gate circuit 164 so that the data $N_1$* through $N_4$* selected by the AND gate circuits 249 through 252 would be stored in the delay flip-flop circuit 163 of respective memory circuits 158 through 161. The output from the first to eleventh stages of the root tone timing memory shift register 245 is applied to the inputs of the NOR gate circuit 253 so that the output of the NOR gate circuit 253 is changed to "0" by a last root tone detection signal RT in case more than two note detection signals RT have been produced whereby the AND gate circuit 246 is disenabled for preventing a root tone detection signal for a different note that has been produced previously and has reached the twelfth stage from returning to the first stage. Thus, the shift register 245 preferentially stores the timing of generating the root tone detection signal RT which is generated later. A depressed key signal KO is applied to one input of the NOR gate circuit 253 from AND gate circuit 86 via an inverter 254 for the purpose of clearing the memory in the shift register 245 at the time of releasing the key. Two root tone detection signals RT for different notes are generated in the following case. For example, it is now assumed that three keys for tones $D_4$, $A_4$ and $C_5$ of the lower keyboard 28 are depressed to form a "D seventh chord". At the first timing of scanning of the scanning circuit 87, data for the note C is stored at the last stage 87-12 of the scanning circuit, data of the note D at the stage 87-10 and data of the note A at the stage 87-3. Then, the AND gate circuit 132 (FIG. 3) is enabled by the data of the note C so that the note code signal NC is generated and the root tone detection signal RT is generated through the OR gate circuit 108 at the timing of note C. Two bit times later, the data of the note D is applied to the stage 87-12 of the scanning circuit while the dta of the note C to the stage 87-2. Consequently, the AND gate circuit 98 is enabled to produce the chord detection signal CD thereby generating the root tone detection signal RT at the timing of the tone D. The root tone detection signal RT previously generated at the timing of note C is a false root tone detection signal but the signal RT subsequently generated at the timing of note D is a genuine root tone detection signal.

For this reason, the root tone timing memory shift register 245 is constructed to clear the memory of the false root tone detection signal previously generated.

Though in response to the false root tone detection signal RT previously generated, the note code data of the false root tone is stored in the note code memory circuits 158 through 161, these memories are immediately cleared by the genuine root tone detection signal RT produced later. Since the coincidence signal EQ will not be produced unless the same note code data is applied twice, no coincidence signal will be produced in response to the false root tone detection signal RT.

For the finger chord function, only the note code memory circuit 158 through 161 are used, but the octave code memory circuits 154, 155 and 156 are not used. Since the output of the OR gate circuit 206 shown in FIG. 5 is "0", AND gate circuits 202, 203 and 204 utilized to apply the signals on the output lines 193, 194 and 195 of the octave code memory circuit 154, 155 and 156 to the adders 199 through 201 will not be enabled. The OR gate circuit 206 produces an output "1" when the custom fucntion is selected as above described or the key code data of the chord tone are to be processed in the single finger function as will be described later whereas it produces an output "0" when the bass tone key code data of the finger chord function or the single finger function is to be processed. The output "0" of the OR gate circuit 206 becomes "1" by being inverted by the inverter, thereby enabling an AND gate circuit 255.

In the finger chord function or the single finger function, the tone range of the tone constituting the root tone of the automatic bass tone is limited to one octave covering the tone $C_2$ to the tone $B_2$. Then, the purpose of the AND gate circuit 255 is to form the octave data $B_1$, $B_2$, $B_3$ of the key code data corresponding to the root tone. The outputs of the note code memory circuits 159, 160 and 161 which store the note code data $N_2$, $N_3$, $N_4$ (or $N_2$*, $N_3$*, $N_4$*) of the upper three bits are applied to the inputs of a NAND gate circuit 256 via lines 190 through 196, and the output of the NAND gate circuit 256 is applied to the other input of the AND gate circuit 255. As above described, the note code of the tone C is "1110" so that all data of the upper three bits is "1". Accordingly, the NAND gate circuit 256 is enabled when the note code data corresponding to the root tone applied to the adders 195 through 195 from the note code memory circuits 158 through 161 is one for the C tone thus producing signal "0". In the case of the tones C# through B other than the tone C, the output of the NAND gate circuit 256 is "1".

The output from the NAND gate circuit 256 is applied to the adder 199 via the AND gate circuit 255, which corresponds to the least significant bit $B_1$ ($AB_1$) of the octave code. No data is applied to the adders 200 and 201 corresponding to the upper bits $B_2$ and $B_3$ ($AB_2$, $AB_3$). Accordingly, in the case of the note C, the input to the adder 199 is "0", and the inputs to the adders 200 and 201 are also "0" so that the octave code data $B_3$, $B_2$, $B_1$ becomes "000" and the key code data $B_3$ through $N_1$ becomes "0001110" which is the data for the tone $C_2$. Further, in the case of tones C# through B, since signal "b 1" is applied to the adder 199, the octave code $B_3$, $B_2$, $B_1$ becomes "001" and the seven bit data $B_3$ through $N_1$ constitutes tones $C_2$# through $B_2$. Accordingly, the tone range of the root tone is set in a range of one octave covering the tones $C_2$ to $B_2$.

The data $AN_1$ through $AB_2$ of the subordinate tones are formed by adding the subordinate tone processing data $SD_1$ through $SD_5$ to the key data of the root tone in said tone range so that when a carry signal CR is applied to the adder 99 or 200, a tone range one octave higher than said tone range can be reached.

As above described, in the case of the custom function, key code data $N_1$ through $B_2$ of the depressed keys of the pedal actuated keyboard 29 are stored in the note code memory circuit 158 through 161 and the octave code memory circuit 154, 155 and 156, and this key code data is utilized as the root tone data in the adders 195 through 201. Accordingly, the range of the tone serving as the root tone of the automatic bass tone in the custom function covers the whole key range of the pedal keyboard 29. Generally, since the whole key range of the pedal keyboard 29 covers more than two octaves (for example from tone $C_2$ to tone $C_4$), the tone region of the automatic bass tone is wider than that of the finger chord function or the signal finger code function. In some cases, the key data $AN_1$ through $AB_3$ formed by adding the subordinate tone processing data $SD_1$ through $SD_5$ may have higher tone range than does not exist in the pedal keyboard 29.

Single Finger Function

During the single finger function, the key code data of not only the bass tone but also that of the chord tone is formed by adding together the subordinate tone forming data $SD_1$ although $SD_5$ in the key code processor 42.

During the single finger function, since a signal (FC+CA) is "0", the AND gate circuit 97 and 98 of the code detection logic 96 (FIG. 3) are not enabled. Since no code detection signal CD is generated, the memory of the delay flip-flop circuit 138 is "0" and the AND gate circuit 137 is normally enabled. The note code data corresponding to a single depressed key of the lower keyboard (for providing the single finger function, usually only one key is depressed) is selected by AND gate circuit 132 in the order of the lowest tone to higher tones so that the AND gate circuit 137 produces a no-chord signal NC in accordance with the timing of a given note. The no-chord signal NC is applied to one input of the OR gate circuit 244 shown in FIG. 5 via OR gate circuit 108 to act as the root tone detection signal RT to be stored in the shift register 245. The no-chord signal NC is also applied to one inputs of AND gate circuits 249 through 252 via line 247 and AND gate circuit 248 thus enabling the AND gate circuits 249 through 252. Thus, the note code data $N_1$ through $N_4$* of the note code corresponding to the timing of generating the root tone detection signal is written in the note code memory circuits 158 through 161 from the note encoder 107.

When the key code $N_1$ through $K_2$ regarding the lower keyboard is supplied from the key coder 26 as a result of depression of the key of the lower keyboard 28, the AND gate circuit 59 (FIG. 3) generates the lower keyboard detection signal LK. This lower keyboard detection signal LK is applied to one input of NAND gate circuit 258 shown in FIG. 4 through line 257. The other input of the NAND gate circuit 258 is connected to receive a single finger function detection signals SF from the AND gate circuit 50 of the function decoder 47 so that the output signal $\overline{SF.LK}$ from the NAND gate circuit 258 becomes "0" when the key codes $N_1$ through $K_2$ of the lower keyboard are applied to the automatic bass chord performance control device 31 during the single finger function.

This signal SF.LK is inverted by an inverter to form a signal "1" which produces an original key data inhibit signal INH via an OR gate circuit 243 (FIG. 4). This signal INH changes the signal on the original data selection enabling line 235 of the key data selection gate circuit 233 shown in FIG. 5 to "0" thus inhibiting the key code $N_1$ through $K_2$ corresponding to the depressed key of the lower keyboard 28 and supplied from the key coder 26 via lines 266 through 274. For this reason, the original key code $N_1$ through $K_2$ generated by the key coder 26 corresponding to the depressed key of the lower keyboard 28 is not transmitted to the channel processor 30.

The signal $\overline{SF.LK}$ produced by the NAND gate circuit 258 is applied to one input of a NOR gate circuit 260 shown in FIG. 5 via line 259. Other inputs of the NOR gate circuit 260 are connected to receive the outputs of exclusive OR gate circuits 261 through 264 and the output of the delay flip-flop circuit 265. The exclusive OR gate circuits 261 through 264 operate to compare the note code data corresponding to the root tone stored in the note code memory circuits 158 through 161 with the note code data $N_1$ through $N_4$ supplied from the key coder 26 via lines 266 through 269 for producing an output "0" only when both data coincides with each other. Initially, the output of the delay flip-flop circuit 265 is "0" so that in the case of the single finger function, the NOR gate circuit 260 produces an output "1" when the note code data of the root tone stored in the note code memory circuit 158 through 161 coincides with the note code of the tone of the depressed key of the lower keyboard.

The output "1" from the NOR gate circuit 260 is applied through the OR gate circuit 153 to one input of AND gate circuit 157 provided for writing data in the octave code memory circuits 154 through 156 thus enabling the AND gate circuit 157. Accordingly, the octave code $B_1$ through $B_3$ supplied from the key coder 26 via lines 270 through 272 is stored in the respective memory circuits 154 through 156. In this manner, the note code and octave code data of the tone corresponding to the root tone corresponding to the root tone are stored in the memory circuits 158 through 161 and 154 through 156.

Figure 14:
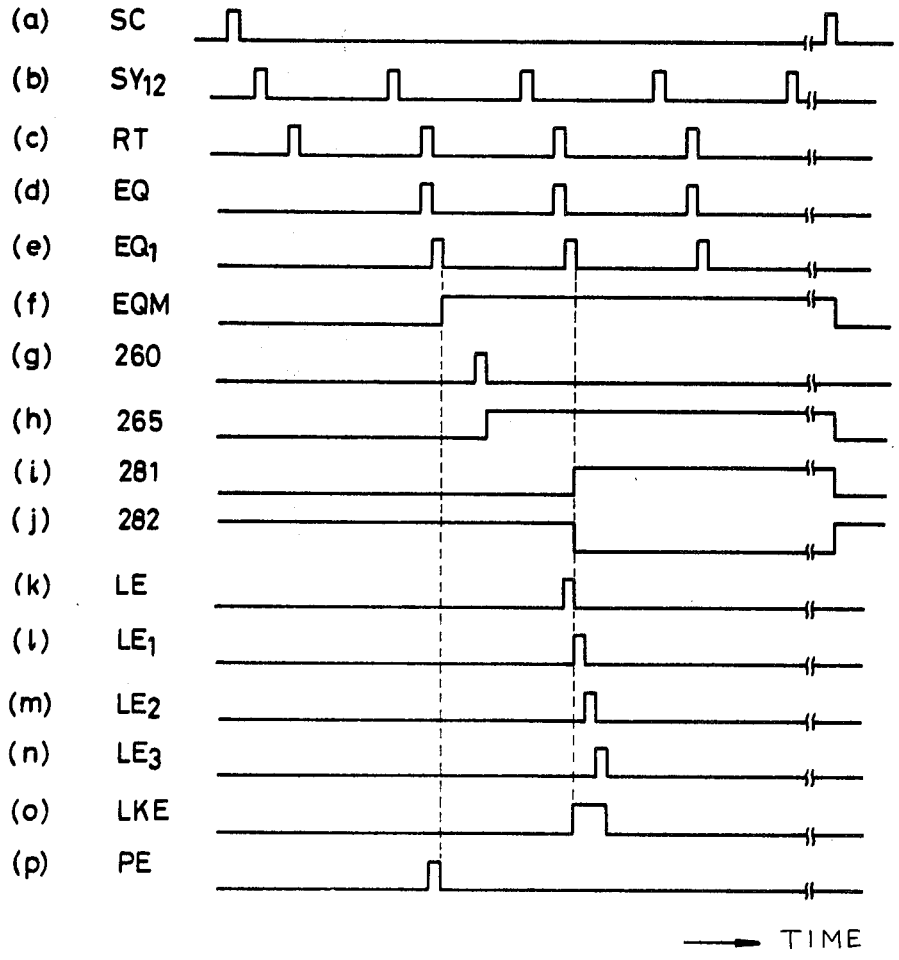
FIG. 14*a* through *p* are a timing chart showing one example of the operation of the circuit shown in FIG. 5 when a chord tone generation commanding signal LE is generated at the time of selecting a single finger function.

The output "1" of the NOR gate circuit 260 is stored in the delay flip-flop circuit 265 through line 275 and OR gate circuit 276. After one bit time, the output of the delay flip-flop circuit 265 becomes "1" thereby disenabling the NOR gate circuit 260. The memory in the delay flip-flop circuit 265 is self-held through AND gate circuit 277 but this AND gate circuit 277 is disenabled when the start code inverted signal $\overline{SC}$ becomes "0" at the timing of generating the start code SC (See FIG. 14*a*) thus clearing the memory. FIG. 14*g* shows one example of the output of the NOR gate circuit 260, whereas FIG. 14*h* shows one example of the output of the delay flip-flop circuit 265. The output of the delay flip-flop circuit 265 is applied to one input of AND gate 278 and also to one input of an AND gate circuit 280 via an OR gate circuit 279. A delay coincidence signal $EQ_1$ from the AND gate circuit 279 and memory coincidence signal EQM stored in the delay flip-flop circuit 181 are applied to the other inputs of AND gate circuits 279 and 280 respectively. When one shot of the root tone detection signal RT is generated during one period of generation of the load pulse $SY_{12}$ (See FIG. 14*b*) as shown in FIG. 14C, a coincidence signal EQ is generated as shown in FIG. 14*d*. Consequently, the delay coincidence signal $EQ_1$ and the memory coincidence signal EQM are generated as shown in FIGS. 14*e* and 14*f*. When the AND gate circuit 278 is enabled, signal "1" is stored in the delay flip-flop circuit 281 (see FIG. 14*i*). Since a signal produced by the delay flip-flop circuit 251 and inverted by inverter 282 is applied to one input of the AND gate circuit 280 (see FIG. 14*j*), when the AND gate circuit 278 is firstly enabled during one period of the generation of a start code SC, the AND gate circuit 280 is enabled to produce one shot of the chord tone generation command signal LE as shown in FIG. 14*k*. When a signal "1" is once stored in the delay flip-flop circuit 281 the storage of the signal "1" is not cleared until a holding AND gate circuit 283 is disenabled at the timing of generating the start doce SC. Accordingly, the chord tone generation command signal LF is generated only once during one period of generation of the start code SC.

The chord tone generation command signal LE produced by the AND gate circuit 280 is applied to a three stage shift register 284 for generating chord tone data generation timing signals $LE_1$, $LE_2$ and $LE_3$ which are sequentially delayed one bit time from the first, second and third stages of the shift register 284. (see FIGS. 14*l*, 14*m* and 14*n*). The shift register 284 is provided for the purpose of generating on the time division basis key code data corresponding to respective component tones of the chord tone. The timing signal $LE_1$ shows the timing of producing key code data corresponding to the first degree interval, that is, the root tone, whereas the signals $LE_2$ and $LE_3$ show the timing of forming the key code data of the subordinate tones.

The outputs $LE_1$, $LE_2$ and $LE_3$ from respective stages of the shift register 284 are applied to respective inputs of an OR gate circuit 285 and the output LKE (see FIG. 140) thereof is applied to one inputs of OR gate circuit 206 and AND gate circuit 286, respectively. As a consequence, in response to the chord tone data generation timing signals LKE ($LE_1$ through $LE_3$) the AND gate circuits 202, 203 and 204 are enabled so that the octave code $B_1$ through $B_3$ that have been stored in the octave code memory circuits 154, 155, and 156 is supplied to the adders 199 through 201 respectively. Furthermore, in response to the chord tone data generation timing signal LKE ($LE_1$ through $LE_3$), the AND gate circuit 286 produces a signal "1" which is applied to the processed data selection enabling line 234 of the key data selection gate unit 233 via OR gate circuit 230 and AND gate circuit 231 whereby the outputs of the adders 195 through 201 are selected by the selection gate unit 233.

When the data generation timing signal $LE_1$ of the root tone is generated by the shift register 284, the note code data and the octave code data of the root tone respectively stored in the note code memory circuits 158 through 161 and the octave code memory circuits 154 through 156 is applied to the adders 195 through 201 respectively. At this time, all subordinate tone forming data $SD_1$ through $SD_5$ is "0" so that the adders 195 through 201 deliver out the key code data provided by the memory circuits 158 through 161 and the memory circuits 154, 155 and 156 and corresponding to the root tone without any modification and the key code data is applied to the channel processor 30 via the selection gate unit 233 and delay flip-flop circuits 239.

The signal $LE_1$ produced by the first stage of the shift register 264 is applied to the chord system subordinate tone selection gate unit 215 shown in FIG. 4 via line 287 for enabling the AND gate circuits 288 and 289. As above described, in the case of the single finger function, the type of the chord is designated by the minor chord signal m or the seventh chord signal $7^b$ produced by the function decoder 47 through line 54 or line 57. The minor chord signal m on line 54 is applied to one input of the AND gate circuit 288 of the chord system subordinate tone selection gate unit 215, and the inverted signal $\overline{m}$ obtained by inverting signal m by an inverter 290 is applied to one input of the AND gate circuit 290. Consequently, where the minor chord is selected, the AND gate circuit 288 is enabled at the timing of the signal LE, for applying a minor third interval selection signal $3^b$ to the interval data memory circuit 213. On the other hand, where a minor chord is not selected, the AND gate circuit 289 is enabled at the timeing of the signal $LE_1$ for applying a major third interval election signal 3 to the interval data memory circuit 213.

In response to the interval selection signal $3^b$ or 3, the interval data memory circuit 213 produces subordinate tone forming data $SD_5$ through $SD_1$ having a value "00100" corresponding to the minor third interval or a value "00101" corresponding to the mjaor third interval. These data $SD_5$ through $SD_1$ is delayed one bit time by the delay flip-flop circuits 214 and then applied to respective adders 195 through 199 in synchronism with the timing of producing the subordinate tone data generation timing signal from the second stage of the shift register 284. Consequently, the subordinate tone forming $SD_1$ through $SD_3$ for the minor third or the major thrid is added to the key code data of the root tone at the timing of generating signal $LE_2$, thus producing key code data $AN_1$ through $AB_3$ of the subordinate tone having the minor third or the major third interval with respect to the root tone. The outputs of the adders 195 through 201 are selected by the selection gate unit 233 at the timing of signal $LE_2$ and then supplied to the channel processor 30.

The signal $LE_2$ produced by the second stage of the shift register 284 is applied to the chord system subordinate tone selection gate unit 215 shown in FIG. 4 over line 291 for enabling AND gate circuits 292 and 293. Where the seventh chord is selected, the seventh chord signal $7^b$ on line 57 becomes "1" so that the AND gate circuit 293 is enabled to apply the minor seventh interval selection signal $7^b$ to the interval data memory circuit 213. Where the seventh chord signal $7^b$ is "0" its inversion $\overline{7^b}$ is "1" so that the AND gate circuit 292 is enabled to apply a perfect fifth interval selection signal 5 to the interval data memory circuit 213.

In response to the interval selection signal 5 or $7^b$ the interval data memory circuit 213 produces subordinate tone forming data $SD_3$ through $SD_1$ having a value "01001" corresponding to the perfect fifth interval or a data "01101" corresponding to the minor seventh interval. The output of the memory circuit 213 is delayed one bit time by the delay flip-flop circuits 214 and then added to the adders 195 through 199 in synchronism with the timing of generating the data generation timing signal $LE_3$ from the third stage of the shift register 284. Consequently, key code data $AN_1$ through $AB_3$ of the subordinate tone of the perfect fifth or the minor seventh are generated in synchronism with the signal $LE_3$.

When the signal on the processed data selection enabling line 234 becomes "1" in response to the chord tone data generation timing signal LKM, the output of the OR gate circuit 238 of the key data selection gate unit 233 becomes "1" whereby the data $AK_2$ becomes "1". This time, since the data $AK_1$ is "0", the keyboard code data $AK_2$, $AK_1$ becomes "10" thus forming a lower keyboard code. In this manner, the key code data $AN_1$ through $AK_2$ of the lower keyboard, that is, the chord tone, is generated.

The other input of the AND gate circuit 286 having one input connected to receive the chord tone data generation timing signal LKE is connected to receive the output of a NAND gate circuit 294.

As shown in Table 1, the upper limit of the octave code $B_3$ through $B_1$ is "101" but the output of the adders 201, 200 and 197 may become "110" as the result of addition. When the value of the octave code exceeds the upper limit, the musical tone generating circuit 32 would not form a tone. In a certain case, a click may be generated, and it is not suitable to assign one channel to such click. Accordingly, the AND gate circuit 286 is disenabled by applying to its inputs the inverted output of the adder 199 and a signal "0" which is produced by the output of "110" of the NAND gate circuit 294 which is applied to its inputs the outputs of the adders 200 and 201. This prevents application of the processed key code $AN_1$ through $AK_2$ to the channel processor 30.

During the single finger function operation, the key code data of the bass tone is processed in the same manner as the finger code function operation. As shown in FIG. 14*p*, the bass tone generation command signal PE generated by the AND gate circuit 187 (FIG. 5) is generated at the same timing as the delay coincidence signal $EQ_1$, whereas the chord tone data generation timing signal LKE is generated one bit time later than the delayed coincidence signal $EQ_1$. Consequently, overlapping in generation of the key code data of the bass tone and that of the chord tone is prevented.

The chord tone generation command signal LE generated by the AND gate circuit 280 and the chord tone data generation timing signal LKE generated by the OR gate circuit 285 are applied to the inputs of an OR gate circuit 296 and the output LN thereof is applied to one input of the NOR gate circuit 216 via line 296 shown in FIG. 4. Consequently, during an interval in which the key code data of the chord tone is being produced by the key code processing unit 42, the output of the NOR gate circuit 216 is "0" thereby disenabling respective AND gate circuits of the bass system subordinate tone selection gate unit 217. As a consequence, formation of the subordinate tone forming data of the bass tone is prohibited.

Change in the Bass progress

Where the chord detection logic 96(FIG. 3) fails to detect a chord, the outputs on the output lines 122, 124, 127 and 128 of the chord type detection circuit 109(FIG. 4) are all "0" and these signals are processed as a major chord in the bass system subordinate tone selection gate unit 129. In other words, the bass pattern proceeds in the form of a major chord. However, since the chord tone (the tone of the lower keyboard) is not a major chord, the chords for the bass tone and the chord tone are different. Since the custom function makes it a prerequisite that the chords of the bass tone and the chord tone are different, there is no trouble. In the case of the finger chord function however, it is advantageous to provide a certain degree of harmony between the bass tone and the chord tone. Thus, when the chord detection logic 96 fails to detect a chord at the time of selecting the finger chord function, the bass system subordinate tone selection gate unit 129 is rendered inoperative for preventing generation of various subordinate tone selection signals 2 through $oct+3^b$ in response to bass pattern pulses $T_3$ through $T_{17}$ and, instead, a tone of the first beat of the bass pattern is generated at the time of generating each bass pattern pulse.

When no chord is detected, the output of the delay flip-flop circuit 138 which is provided for storing the chord detection signal CD is "0" and the output of the inverter 144 is "1". This output enables the AND gate circuit 137 to make it possible to generate the no-chord signal NC and is also applied to one input of the AND gate circuit 298 shown in FIG. 4 via line 297 to act as a bass progress changing signal BMD. To the other input of the AND gate circuit 298 is applied the finger chord function selection signal FC from the function decoder 47, so that when this AND gate circuit is enabled, it applies signal "1" to the inputs of the NOR gate circuit 216 and the OR gate circuit 299.

Then, the output of the NOR gate circuit 216 becomes "0" thereby disenabling respective AND gate circuit 217, 218 . . . of the bass system subordinate tone selection gate unit 129. On the other hand, the output of the OR gate circuit 299 becomes "1" thus enabling an AND gate circuit 300. When the bass system subordinate tone selection gate unit 129 is disenabled, all subordinate tone forming data $SD_1$ through $SD_5$ of various intervals becomes "0" but the bass tone generation timing signal BT is applied to one input of the AND gate circuit 187 shown in FIG. 5 via the OR gate circuit 228 and the line 188 at the timing of generation of the bass pattern pulses $T_1$ through $T_{17}$. Consequently, the bass tone generation command signal DE is generated corresponding to a bass pattern selected by the bass pattern generator 41. However, since the subordinate tone forming data $SD_1$ through $SD_5$ is all "0", only a key code data corresponding to the root tone will be repeatedly supplied to the channel processor 30 each time the signal DE is generated. Since the root tone is the tone of the first beat of the bass pattern, only the tone produced at the first beat will be generated at the timing of forming tones of the second and the following beats of the given bass pattern. More particularly, the tone pitch of the bass tone does not vary but only the timing of generation thereof is varied in accordance with a desired bass pattern selected.

As shown by one example in FIGS. 12 and 13, the tone utilized as the tone of the first beat of the bass pattern is not limited to the root tone, a tone one octave above the root tone is also used. Consequently, as above described, the key code data stored in the note code memory circuit 158 through 161 (and the octave code memory circuits 154 through 156) are repeatedly generated by the key code processor 42 in a bass pattern in which the tone of the first beat comprises the root tone. The bass pattern shown in FIG. 12 illustrates such case. More particularly, the bass pattern generator 41 repeatedly generates bass pattern pulses $T_1$, $T_5$, $T_8$, $T_{10}$, $T_{11}$ . . . as shown in FIG. 12*a* but these pulses are blocked by the subordinate tone selection gate unit 129 so that the subordinate tone forming data $SD_1$ through $SD_5$ would not be formed. Instead, only the key code data $AN_1$ through $AK_2$ of the root tone (first degree interval) would be generated repeatedly at the timing of generating these pulses $T_1$, $T_5$, $T_8$ . . .

Where the tone of the first beat is one octave higher than the root tone as in a bass pattern shown in FIG. 13, an octave interval signal To is constantly supplied to one input of an AND gate circuit 300 shown in FIG. 4 from the bass pattern generator 41 independently of the bass pattern pulses $T_{13}$, $T_{12}$, $T_{10'}$, $T_8$ . . . (see FIG. 13*a*). This octave interval signal To is utilized only when the AND gate circuit 300 is enabled by the output "1" of the OR gate circuit 299, but is not utilized in the other cases. Where the tone of the first beat corresponding to the bass pattern of the root tone signal To is not produced. When the AND gate circuit circuit 300 is enabled, an octave interval selection signal oct is stored in the interval data memory circuit 213 so that the subordinate tone forming data $SD_5$ through $SD_1$ assumes a value "10000" which represents a tone one octave higher. Consequently, the adders 195 through 201 constantly change the key code data of the root tone supplied by the memory circuit 158 through 161 (and memory circuits 154 through 156) to data one octave higher. In this manner, the bass tone generation command signal PE is repeatedly generated in accordance with the bass pattern pulses $T_{13}$, $T_{12}$, $T_{10'}$, $T_8$, $T_{10}$ . . . which are sequentially generated as shown in FIG. 13*a*, but the key code data $AN_1$ through $AK_2$ produced by the key code processor 42 in responce to the signal PE is the data always one octave higher than the root tone.

As above described, by the output "0" from the NOR gate circuit 216 the bass system subordinate tone selection gate circuit 129 is disenabled and when the AND gate circuit 300 is enabled by the output "1" from the OR gate circuit 299, a tone of the first beat of the bass pattern which is selected at that time (the root tone or a tone one octave higher than the root tone) will be repeatedly generated in accordance with the timing of generating the bass tone. Accordingly, the chord tone and the bass tone are not different but are in a good harmony. Moreover, since the interval of the bass pattern alone is varied and the timing of the bass pattern is not varied the effect of the bass tone would not be imparied.

Processing at the Time of Changing the Root Tone (chord Change) of the Bass Tone Chord change (root tone change) is often made at an intermediate point of a measure. In such a case, it is desirable to terminate the bass pattern which has continued until that point and to produce a chord tone in which the tone (root note) of the first beat of the bass pattern has been changed, because with this measure it is possible to give an impression that the chord has been changed during playing of a measure.

Suppose now that a bass pattern corresponding to swing as shown by FIG. 15*a*, for example, has been selected in which the interval relation is represented on a score with the root tone represented by the under first line. In such a case, as shown in FIG. 15*b*, bass pattern pulses $T_1$ and $T_8$ are generated and generally tones C and G are sequentially generated in a measure of a chord comprising the tone C as the root tone, whereas tones A and E are sequentially generated in a measure comprising the tone A as the root tone as shown in FIG. 15*c*. Where the chord comprising tone c as the root tone is changed to the chord comprising tone A as the root tone during playing of a measure as shown in FIG. 15*d*, if the bass tone were produced as the bass pattern proceeds without any modification, tone E which is a fifth degree subordinate tone of the "A major chord" would be produced at the timing of generation of the pattern pulse $T_8$ of the perfect fifth interval as shown in FIG. 15*e*, thus giving an undesirable impression as if the chord had changed to a chord having the tone E as a root tone. For this reason, this embodiment is constructed such that when the chord (root tone) is changed a bass tone corresponding to the first beat (the tone of the first beat of the new chord) of the bass pattern will be generated as shown in FIG. 15*f*. As shown, since the tone of the first beat, that is the root tone A, is generated at the timing of the pulse $T_8$ which firstly produces a tone when the chord is changed to "a major", the change of the chord progress to "A major" is adequately expressed during the bass performance.

In this embodiment, change of the root tone of the automatic bass tone (that is the change of the chord progress) means the change of the depressed keys of the pedal keyboard in the case of the custom function, whereas in the case of the finger chord function, it means that the depressed keys have been changed such that the chord formed by the depressed keys of the lower keyboard 28 will be changed to another chord, and in the case of the single finger function, it means that the depressed key(usually a single key) of the lower keyboard has been changed to another key. In each case, the change of the root tone of a bass tone can be detected by a condition in which the content of the note code stored in the note code memory 158 through 161 circuit 158 through 161 does not coincide with the content of the node code to be newly stored when a signal commanding the "renewal of the memory of the note code memory circuits 158 through 161" is sent from the AND gate circuit 146 or 248 (FIG. 5). Whether this condition is satisfied or not is judged by the AND gate circuit 301 shown in FIG. 4 The root tone rewriting signal KCH applied to one input of AND gate circuit 301 is sent from the AND gate circuit 146 and 248 via the OR gate circuit 165, inverter 166, line 167 and inverter 302(FIG. 5). A noncoincidence signal $\overline{EQ}$ applied to the other input of the AND gate circuit 301 is produced by inverting the coincidence signal EQ on line 176 (FIG. 5). Accordingly, when the coincidence signal EQ is "0" ($\overline{EQ}$="1") and the root tone rewriting signal KCH is "1", the aforementioned condition is fulfilled so that the output of the AND gate circuit 301 becomes "1" which is stored in a delay flip-flop circuit 303 and self-held by an AND gate circuit 304.

The output "1" of the delay flip-flop circuit 303 is applied to one inputs of the NOR gate circuit 216 and the OR gate circuit 299 for disenabling respective AND gate circuits 217, 218 . . . of the bass system subordinate tone selection gate unit 129 and for enabling AND gate circuit 300 supplied with the octave interval signal To. Under these conditions, a tone of the first beat of the bass better (the root tone or a tone one octave higher than the root tone corresponding to the signal To) will be generated as has already been described in the paragraph of the "change in the bass progress".

Figure 15:
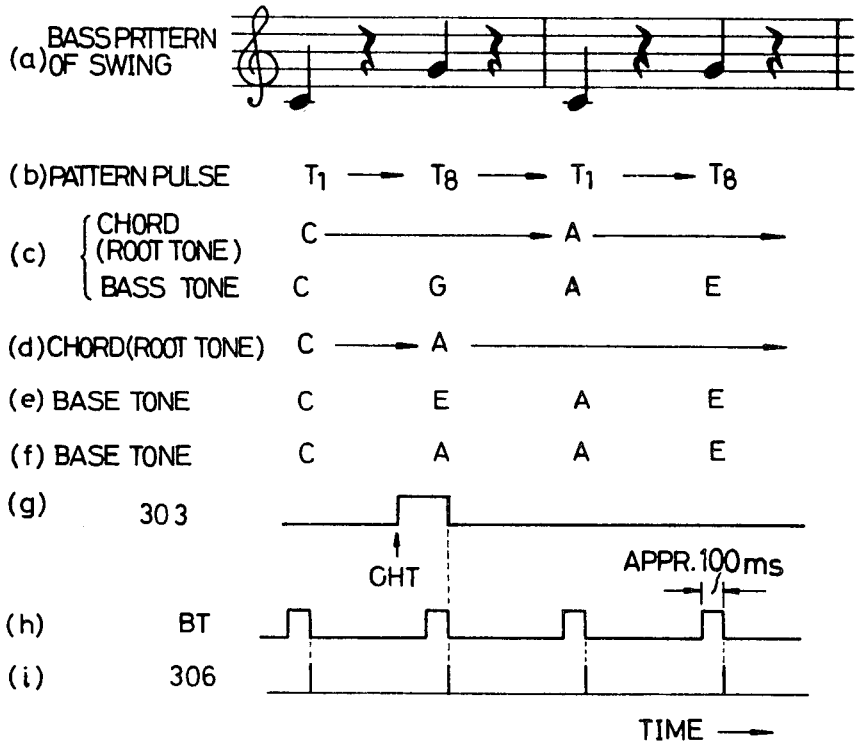
FIG. 15 is a graph showing variation in the bass pattern progress when a chord (root note) varies in a measure.

Suppose now that the AND gate circuit 301 is enabled at an instant CHT shown in FIG. 15. The output of the delay flip-flop circuit 303 becomes "1" as shown in FIG. 15*g*, thus enabling to produce a tone of the first beat of the bass pattern. When a bass pattern pulse (in the example shown in FIG. 15, pulse $T_8$) is applied immediately after the output of the delay flip-flop circuit 303 has became "1" (that is immediately after chord change), the key code data $AN_1$ through $AK_2$ of a tone (the root tone or a tone one octave higher) of the first beat of the bass pattern is applied to the channel processor 30. Bass pattern pulses $T_1$ through $T_{17}$ are applied to the inputs of the OR gate circuit 228 and its output BT(see FIG. 15*h*) is applied to a delay flip-flop circuit 305 which is used for matching the timing. The output of the delay flip-flop circuit 305 is inverted by an inverter and then applied to a differentiation circuit 306. Although this circuit differentiates the building up portion of a pulse, since signal BT(bass pattern pulse train) is applied thereto through the inverter, the building down portion of the bass pattern pulse is actually differentiated. Accordingly, the differentiation circuit 306 produces an output as shown in FIG. 15*i*, which is applied to one input of an AND gate circuit 304 through an inverter for disenabling the AND gate circuit 304 whereby the self-holding action of the delay flip-flop circuit 303 is released.

Accordingly, at the time of changing the chord (change of the root tone), only one tone of the first beat of the bass pattern is produced. Thereafter the bass tone progresses according to the bass pattern because the output of the NOR gate circuit 216 becomes "1" and the output of the OR gate circuit 299 becomes "0" thus enabling the bass system subordinate tone selection gate unit 129.

Memory Function

Generally, in the automatic bass chord performance when the depressed keys of the lower keyboard 28 or the pedal keyboard 29 have been released, the performance terminates. The term "memory function" used herein means a function to continue the automatic bass chord performance even after the depressed keys of the lower keyboard or the pedal keyboard have been released by memorizing the depressed key information existing immediately before such key releases.

To use the memory function, a memory switch 307 shown in FIG. 4 is closed. Then, signal "1" is applied to one input of an AND gate circuit 309 via an inverter 308. Where an automatic bass chord performance is selected, the automatic performance stop signal OFF produced by the function decoder 47 is "0" so that a signal $\overline{OFF}$ produced by inverting the signal OFF is applied to the input of the AND gate circuit 309. The following description is made on the assumption that the other input MCON of the AND gate circuit 309 is "1".

The memory signal M produced by the AND gate circuit 309 is applied to one input of an AND gate circuit 310 shown in FIG. 3 and to one inputs of OR gate circuit 73 and 312 of the memory control unit 72 via an inverter 311. As above described, the output of the OR gate circuit 73 controls the rewriting or renewal of the memories of the lower keyboard note secondary memory circuit 75 and the delay flip-flop circuit 83 acting as the secondary memory circuit for storing the depressed keys of the lower keyboard. When the output of the OR gate circuit 73 is "1", the renewal of the memories is made at the timing of generating the start code SC. While the keys of the lower keyboard 28 are being depressed, since the output "1" of the delay flip-flop circuit 71 which acts as the primary memory circuit is applied to the input of the OR gate circuit 73, the memories of the secondary memory circuits 75 and 83 are renewed. However, since all depressed keys of the lower keyboard 28 are released, the output of the delay flip-flop circuit 71 becomes "0". When the memory function is provided at this time, the memory signal M is "0" and the output "1" of the inverter 311 is applied to the input of the OR gate circuit 73 so that the memories of the secondary memory circuits 75 and 83 are rewritten. However, since the data supplied from the primary memory circuits 62 and 71 to the secondary memory circuits 75 and 83 is all "0" (due to the release of the keys), the note memory and the depressed key memory in the secondary memory circuits 75 and 83 are cleared.

However, when the memory function is provided, the memory signal M becomes "1" and the output of the inverter 311 becomes "0". Consequently, when the output of the delay flip-flop circuit 71 acting as the primary memory circuit is changed to "0" due to the release of the keys, the output of the OR gate circuit 73 is "0" and the output of the AND gate circuit 74 remains at "0" at the time when the start code is applied to the AND gate circuit 74. As a consequence, the output of the inverter 77 is maintained at "1" so that the memories of the secondary memory circuits 75 and 83 are self-held. Consequently, the note data of the tone produced by the keys of the lower keyboard which have been depressed before release is stored in the secondary memory circuit 75. For this reason, it is possible to detect the chord and the root tone after the key release, for generating chord detection signals CD and root tone detection signals RT.

During the finger chord function and the single finger function since the note codes $N_1^*$ through $N_4^*$ generated by the note encoder 107 (FIG. 5) is stored in the note code memory circuit by the root tone detection signal RT which is generated even after the release of the keys of the lower keyboard as above described, generation of the automatic base tones is continued.

Furthermore, when all keys of the lower keyboard 28 have been released during the single finger function, the signal $\overline{SF.LK}$ applied to the NOR gate circuit 260 becomes "1" whereby this NOR gate circuit is disenabled and the signal on the self-hold clear line 172 for the octave code memory circuits 154 through 156 remains at "1" state. For this reason, the octave code $B_1$ through $B_2$ which has been stored in the octave code memory circuits 154 through 156 is self-held after releasing of the keys. The memory signal M produced by the AND gate circuit 309 shown in FIG. 4 is applied to one input of AND gate circuit 280 via OR gate circuit 279. Consequently, even when the delay flip-flop circuits 265 and 281 cleared after the release of the keys of the lower keyboard, the AND gate circuit 280 is enabled by the memory signal M thereby generating a chord tone generation command signal LE. For this reason, when the memory circuits are operated under the single finger function condition, the generation of the chord tones is continued after releasing the keys of the lower keyboard.

During the custom function, the custom function selection signal CA on line 147 is inverted by inverter 321 whereby signal "0" is applied to one input of the OR gate circuit 312 of the memory control unit 72 shown in FIG. 3. When the memory signal M becomes "1" all input to the OR gate circuit 312 at the time of release of the key on the pedal keyboard become "0" and, since the initial clear signal IC is also "0", the AND gate circuit 322 will be disenabled. Since the output of the AND gate circuit 322 controls the renewal of the memory in the secondary memory circuit (delay flip-flop circuit) 320 of the pedal keyboard, the AND gate circuit 322 is disenabled and the memory of the depressed key data "1" is self-held in the delay flip-flop circuit 320 even after the keys of the pedal keyboard have been released in the same manner as the secondary memory circuit (delay flip-flop circuit) 83 of the lower keyboard above. As has been described hereinabove, when the automatic bass chord is not performed, the memories of the depressed keys of the pedal keyboard are stored in the primary memory circuit (delay flip-flop circuit) 315 and the secondary memory circuit (delay flip-flop circuit) 320 by a signal CAO on line 317 during the depression of the keys. At this time, however, since the function selection signal CA is "0", even when the memory signal M becomes "1", the output of the OR gate circuit 312 is "1" so that the AND gate circuit 322 is enabled whereby no memory function is provided. Accordingly, the depressed key memory of the pedal keyboard is held even after releasing the keys only when the memory signal becomes "1" in the custom function.

In the case of the custom function, the note code data $N_1$ through $N_4$ supplied from the key coder 26 is written into the note code memory circuits 158 through 161 without using the outputs $N_1^*$ through $N_4^*$ of the note encoder 107(FIG. 5). Consequently, after the keys have been released, the note code data $N_1$ through $N_4$ regarding the pedal keyboard is not supplied with the result that the coincidence signal EQ which is necessary to generate the bass tone generation command signal PE is not generated. However, since the note code memory circuits 158 through 161 are not cleared, the note code data immediately before the key release is held in these memory circuits. When the memory function is provided at the time of selecting the custom function, the AND gate circuit 310 (FIG. 3) produces a quasi coincidence signal PEQ which is applied to one input of the OR gate circuit 177 over a line 323.

The AND gate circuit 310 is enable to produce an output "1" when the output of the delay flip-flop circuit 320 which acts as the secondary memory circuit for storing the depressed keys of the pedal keyboard, the custom function selection signal CA and the memory signal M are all "1" and further when the start code signal SC is supplied thereto from the AND gate circuit 66 over line 324. This output "1" constitutes the quasi coincidence signal PEQ. For this reason, even after the release of the keys of the pedal keyboard, the quasi coincidence signal PEQ is generated each time the start code SC is generated, whereby after one bit time, the delayed coincidence signal $EQ_1$ is applied to one input of the AND gate circuit 187 from the AND gate circuit 179 shown in FIG. 5 with the result that the bass tone generation command signal PE is generated. Consequently, in the case of the custom function also, the desired memory function is provided so that the automatic bass performance can be continued after the key release of the pedal keyboard.

When the memory holding signal MCON applied to one input of AND gate circuit 309 shown in FIG. 4 becomes "0" as will be described later, the memory signal M becomes "0" to clear various data which has been self-held after the key release so that the automatic bass tone or the chord tone that has been performed after the key release will be terminated automatically.

Generation of the Bass Pattern

Figure 16:
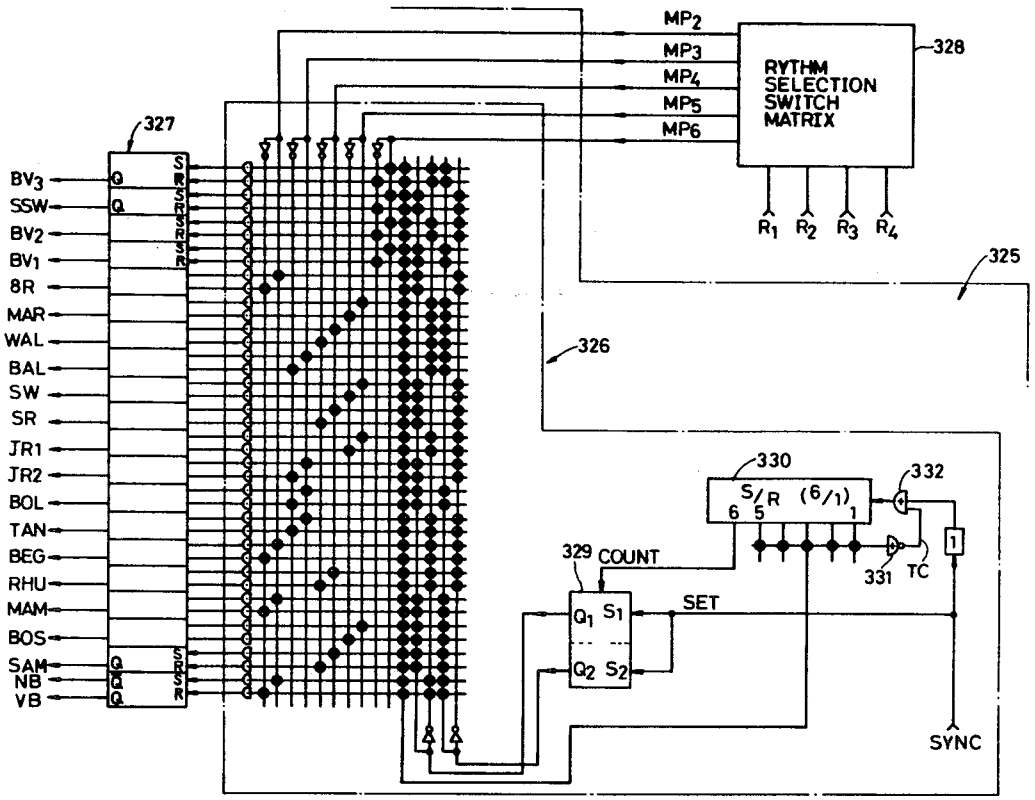
FIG. 16 is a connection diagram showing details of a selected rhythm detector shown in FIG. 16.

In the bass pattern generating unit 41 shown in FIG. 6, the purpose of a selected rhythm detection unit 325 is to detect the rhythm selected by the player. Since rhythm selection signals $MP_2$ through $MP_6$ are supplied in a time division multiplexed manner, multiplex signals $MP_2$ through $MP_6$ are decoded by a multiplex signal detection circuit 326 into the selected rhythm signal and provided on one of lines corresponding to respective rhythms. A memory circuit 327 is provided for holding the rhythm selection signal. The detail of the multiplex signal detection circuit 326 is shown in FIG. 16. When the player closes switches corresponding to desired rhythms of a rhythm selection switch matrix 328 shown in FIG. 61, rhythm selection signals $MP_2$ through $MP_3$ corresponding to the selected rhythms are produced. Time shared clock pulses $R_1$, $R_2$, $R_3$ and $R_4$ applied to the matrix 328 are generated in the order shown in FIG. 17*a*. The switches of the switch matrix 328 corresponding to respective rhythms are arranged as shown in the following Table 7.

Table 7

| | $R_1$ | $R_2$ | $R_3$ | $R_4$ |
|---|---|---|---|---|
| $MP_2$ | MAM | BEG | 14R | VB |
| $MP_3$ | BOL | TAN | JR2 | BAL |
| $MP_4$ | SAM | RHU | SR | WAL |
| $MP_5$ | BOS | JR1 | SW | MAR |
| $MP_6$ | $BV_1$ | $BV_2$ | SSW | $BV_3$ |

In this table, MAM represents mambo, BEG bequine, BOL bolero, TAN tango, SR slow rock, WAL waltz, BAL ballade, $JR_1$ and $TR_2$ jazz rocks, SAM samba, RHU rhumba, BOS bossanova, SW swing, and MAR march. Symbol "14R" means a function which enables to select all of 14 types of rhythms shown in Table 7. When a switch corresponding to 14R is opened, only 8 rhythms can be selected.

In this embodiment, for a given rhythm, it is possible to select either one of the bass pattern (NB) of a normal mode and the bass pattern (VB) of a variation mode, thereby enabling three variation bass patterns ($BV_1$, $VB_2$, $BV_3$) to be selected in each case. Thus, there are six selectable bass patterns for each rhythm. For example, when the first variation bass pattern ($BV_1$) of the normal bass pattern (NB) in selected for march, switch MAR of Table 7 is ON, switch VB is OFF, and switch $BV_1$ is ON. Accordingly, the rhythm selection signals $MP_2$ through $MP_6$ are produced as "00001" at the timing of the pulse $R_1$ but as "00010" at the timing of pulse $R_4$.

Figure 17:
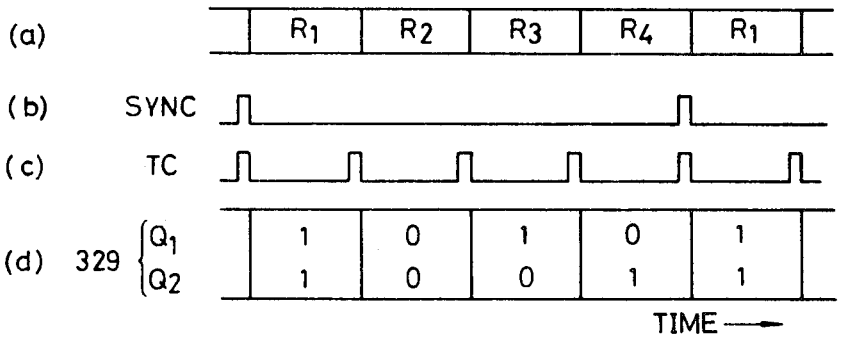
FIG. 17 is a timing chart useful to explain the time division multiplex signal detection operation of the circuit shown in FIG. 16.

In the multiplex signal detection circuit 326, the rhythm selection signals $MP_2$ through $MP_6$ are decoded in synchronism with time shared clock pulses $R_1$ through $R_4$ for detecting the closed switches of the switch matrix 328. Although it is possible to use pulses $R_1$ through $R_4$ in the multiplex signal detection circuit 326, where it is impossible to apply four pulses $R_1$ through $R_4$ from the stand point of the number of pins of integrated circuits, a synchro-clock pulse SYNC (FIG. 17*b*) is used. The synchro-clock pulse SYNC is synchronous with the build donw portion of the clock pulse $R_4$ and is used to set a counter 329 of modulo $2^2$ to "11" and is delayed by a shift register 330. When the pulse SYNC is shifted to the sixth stage of the shift register 330, a count pulse is applied to a counter 329. At the same time, a NOR gate circuit 331 generates a pulse TC and signal "1" is applied again to the shift register 330 via an OR gate circuit 332. In response to the generation of pulse TC(FIG. 17*c*), the contents $Q_1$ and $Q_2$ of the counter 329 vary (FIG. 17*d*). These contents $Q_1$ and $Q_2$ of the counter 329 vary corresponding to the timings of the time shared clock pulses $R_1$ through $R_4$. Accordingly, the timing of the time shared decoding operation of the multiplexed rhythm selection signals $MP_2$ through $MP_6$ is controlled by the output of the counter 329.

The memory circuit 327 comprises a plurality of set-reset type flip-flop circuit corresponding to respective switches (see Table 7) of the rhythm selection matrix circuit 328.

The reason for processing the rhythm selection information and the variation selection information of the bass pattern on the time division basis as above described lies in that the number of pins is limited in the integrated circuits when the circuit of this embodiment is fabricated with integrated circuits. Where there is no limit caused by the number of pins, it is not necessary to use the complicated switch matrix 328 and selected rhythm detection unit 325. In such a case, it is possible to apply the outputs of the select switches corresponding to various rhythms and variation bass pattern directly to the bass pattern generating unit 41 (the bass pattern generating read only memory circuit 333 shown in FIG. 6).

Figure 18:
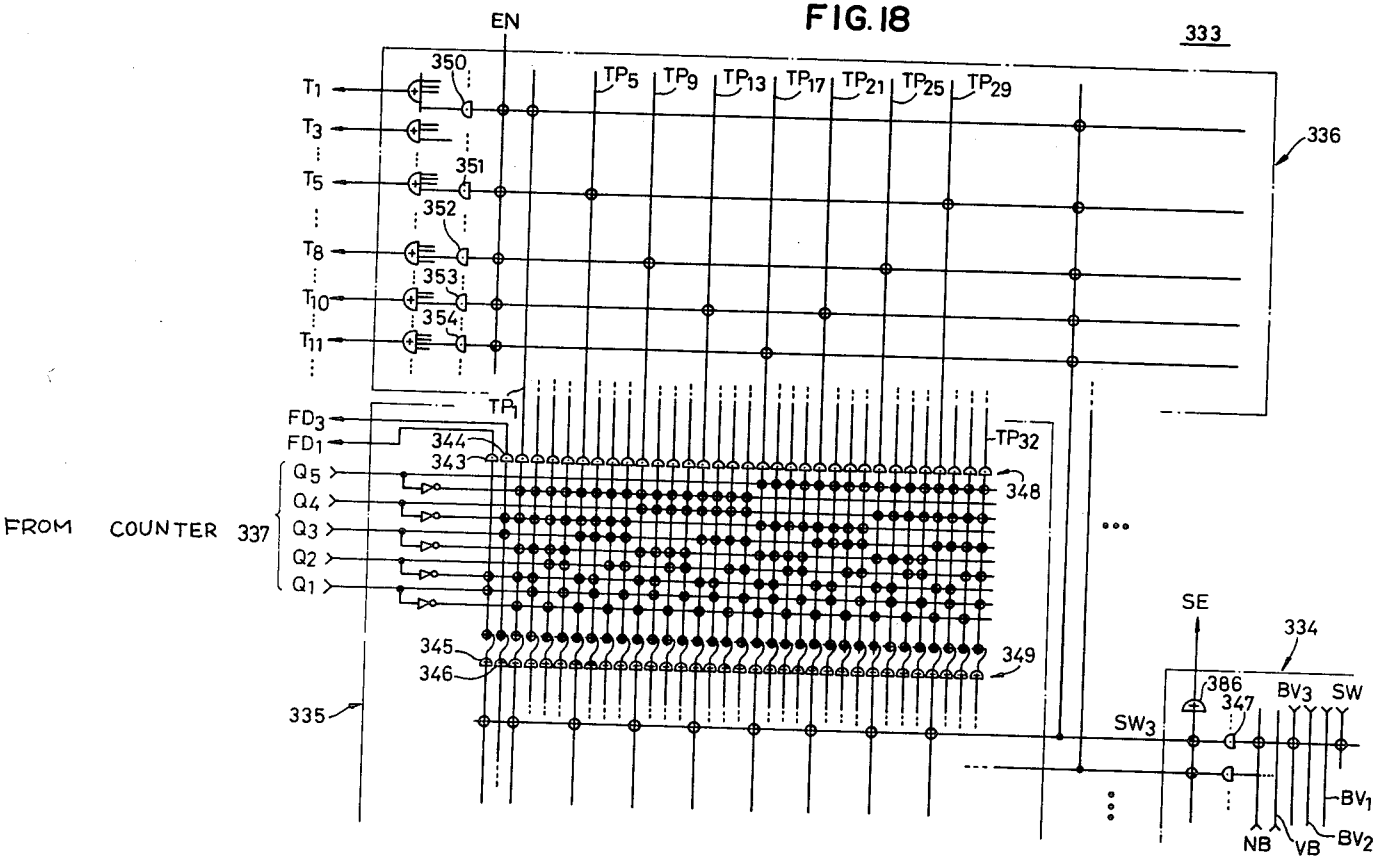
FIG. 18 is a connection diagram showing details of one example of a read only memory circuit for generating the bass pattern shown in FIG. 6, and FIG. 19*a*, *b* and *c* show one example of a chord pattern generated by the circuit shown in FIG. 7 and one example of a chord tone generating timing signal generated corresponding to the chord pattern.

The bass pattern generating read only memory circuit 333 shown in FIG. 18 is provided for the purpose of generating bass pattern pulses $T_1$ through $T_{17}(T_0)$ in accordance with the selected rhythm and the bass pattern variation. A bass pattern designation circuit 334 functions to combine signals supplied from the selected rhythm detection unit 325 and representing the selected rhythms and the bass pattern variation for producing an output corresponding to a predetermined bass pattern. The bass pattern designation circuit 334 comprises a plurality of AND gate circuits that detect combinations of three types of signals, i.e. rhythm types MAR through SAM, variation types $BV_1$ through $BV_3$ and modes NB and VB. Since there are 14 types of rhythms, three types of variations, and 2 types of modes, the bass pattern designation circuit is provided with 84 output lines and 84 AND gate circuits corresponding to $14\times3\times2=84$.

The outputs of the bass pattern designation circuit 334 corresponding to respective bass patterns are applied to a timing pattern memory circuit 335 and an interval pattern memory circuit 336 to act as address signals. The purpose of the timing pattern memory circuits 335 is to determine the timing of generating the pattern pulses of respective patterns (bass tone generating timing) in accordance with the output of a fibe bit binary counter 337, thus producing timing pulses ($TP_1$ through $TP_{32}$) of the bass patterns corresponding to the outputs from the bass pattern designation circuit 334. The interval pattern memory circuit 336 produces bass pattern pulses $T_1$ through $T_{17}(To)$ by assigning the timing pulses $TP_1$ through $TP_{12}$ produced by the timing pattern memory circuit 335 to predetermined intervals in accordance with the bass pattern designated by the output of the bass pattern designation circuit 334.

The counter 337 counts the number of the basic tempo clock pulses TCL and supplies its counted output to the timing pattern memory circuit 335. The basic tempo clock pulse TCL is applied to the count input of the counter 337 via a delay flip-flop circuit 338, an OR gate circuit 339, a differentiation circuit 340 and a delay flip-flop circuit 341. The basic tempo clock pulse TCl sets the basic tempo of the rhythm and the tempo is adjusted by a circuit not shown. Since it is advantageous to match the tempo of the automatic bass chord performance and that of the automatic rhythm performance, the automatic rhythm performance device 342 (FIG. 2) also utilizes the same basic tempo clock pulse TCL.

The counter 337 is constructed to switch the ratio of frequency division (modulo) in accordance with the type of the rhythm and to be controlled by the frequency dividion ratio switching signals $TD_1$ and $TD_3$ supplied from the timing pattern memory circuit 335. Signal $FD_1$ is applied to the first stage (having a weight of 2) of the counter 337, whereas signal $FD_3$ to the third stage of the counter (having a weight of $2^2$). When both signals $FD_1$ and $FD_3$ become "1", values "1" are added to the corresponding stages of the counter. When both signals $FD_1$ and $FD_3$ are "0", the counter 337 operates as a modulo $2^5=32$ counter. When signal $FD_1$ is "1" and signal $FD_3$ is "0", the counter 337 operates as a counter of modulo 24, whereas when both signals $FD_1$ and $FD_3$ are "1" the counter acts as a counter of modulo 18. FIG. 18 shows the detail of a position of the timing pattern memory circuit 335. An AND gate circuit 343 adapted to generate the signal $FD_1$ is enabled when the data $Q_2$ and $Q_1$ of the two least significant bits of the counter 337 are "01", while an AND gate circuit adapted to generate signal $FD_3$ is enabled when the data $Q_4$ and $Q_3$ of the counter 337 is "01". To the other input of the AND gate circuit 343 is applied a signal from the bass pattern designation circuit 334 via an OR gate circuit 345 which selects a predetermined bass pattern(a bass pattern corresponding to modulo 24 or 18). The other input of the AND gate circuit 344 is connected to receive from the bass puttern designation circuit 334 via an OR gate circuit 346 a signal which selects a bass pattern corresponding to modulo 18.

Consequently, in the case of modulo 24, when the two least significant bit data $Q_2$, $Q_1$ of the counter 337 becomes "01", signal $FD_1$ at once becomes "1" so that 1 is added to the bit of data $Q_1$ whereby the data $Q_2$, $Q_1$ becomes "10". At the timing of the next pulse $TLL_1$ data $Q_2$, $Q_1$ becomes "11". In this manner, the timing decimals 3, 7, 11, 15, 19, 23, 27 and 31 at which the data $Q_2$, $Q_1$ becomes "10" are jumped so that actually the counter 337 of modulo 32 operates as a counter of modulo 24. In the case of modulo 18, when the data $Q_2$, $Q_1$ of the counter 337 becomes "01", and when data $Q_4$ $Q_3$ becomes "01", signal $TD_1$ or $TD_3$ immediately becomes "1" whereby 1 is added to the bit of the data $Q_1$ or $Q_3$ Consequently, the timing at which data $Q_4$, $Q_3$ becomes "10" and the timing (decimal 3, 7, 9, 10, 11, 12, 15, 19, 23, 25, 26, 27, 28 and 31) at which data $Q_2$, $Q_1$ becomes "10" are jumped so that actually the counter 337 of modulo 32 operates as a counter of modulo 18.

The rhythms that operate the counter 337 as a counter of modulo 32 are march, jazz rocks, tango, bequine, rhumba, mambo, bossanova and samba, for example, and the rhythms that operate the counter 337 as a counter of modulo 24 are waltz, ballade, swing, slow rock and bolero, for example.

Furthermore, the rhythm that operates the counter 337 as a counter of modulo 18 is a variation mode of waltz.

In this embodiment, since the bass pattern comprises two measures, when the counter 337 is operated as a counter of modulo 32, the two measures are divided by 32 timing pulses whereas when the counter is operated as a counter of modulo 24 the two measures are divided by 24 timing pulses. When one measure is divided by using the triplets of a quadruple note, it is divided by 12 timing pulses. In the case of a rhythm comprising triplets, the counter 337 is operated as a counter of modulo 24 whereas when the rhythm does not comprise triplets, the counter is operated as a counter of modulo 32 or 16.

FIG. 18 shows the detail of one example of the bass pattern generating read only memory circuit 333 in which only the circuits for generating bass pattern (FIG. 12) are shown. Assume now that the bass pattern shown in FIG. 12 is the bass pattern of the third variation of the normal bass pattern mode of swing, the AND gate circuit 347 contained in the bass pattern designation circuit 334 and applied with the swing selection signal SW, the normal mode selection signal NB and the third variation selection signal produces a signal $SW_3$ that selects the bass pattern shown in FIG. 12. The bass pattern selection signal $SW_3$ of swing enables the AND gate circuit 343 via the OR gate circuit 345 thus switching the frequency division ratio of the counter 337 to 24 bits.

The outputs $Q_1$ through $Q_5$ of the counter 337 are applied to the AND gate circuits 348 of the timing pattern memory circuit 335 so as to decode the counted values for generating timing pulses $TP_1$ through $TP_{32}$ corresponding thereto. The signal $SW_2$ for selecting the bass pattern shown in FIG. 12 enables a predetermined one of the AND gate circuits 348 via one of the OR gate circuits 349 thereby generating timing pulses $TP_1$, $TP_5$, $TP_9$, $TP_{13}$, $TP_{17}$, $TP_{21}$, $TP_{25}$ and $TP_{29}$ at an equal spacing. This is because only a quarter note is used in the pattern shown in FIG. 12. Furthermore, the signal $SW_3$ enables predetermined AND gate circuits 350, 351, 352, 353 and 354 of the interval pattern memory circuit 336. These AND gate circuits 350 through 354 correspond to the intervals (first, third, perfect fifth, major sixth and minor seventh) of the intervals of the root tone and subordinate tone utilized in the pattern shown in FIG. 12. Predetermined timing pulses $T_1$, $T_5$ . . . $T_{29}$ are applied to predetermined AND gate circuits 350 and through 354 and the outputs thereof are applied to OR gate circuits corresponding to respective intervals thereby producing bass pattern pulses $T_1$, $T_5$, $T_8$, $T_{10}$, $T_{11}$ . . . at predetermined timings.

Although in FIG. 18 only one path for generating one bass pattern is shown, as the circuit is constructed to generate other bass patterns by the same principle in accordance with their timings and intervals, the construction and operation of the bass pattern generating read only memory circuit 339 will readily be understood without showing the entire circuit construction.

An enabling signal EN which enables the AND gate circuits 350, 351 . . . of the interval pattern memory circuit 336 is generated by the AND gate circuit 355 shown in FIG. 6 in synchronism with the basic tempo clock pulse TCL. When adjacent timing pulses $TP_1$ through $TP_{12}$ produced by decoding the outputs of the counter 337 are applied to the inputs of an OR gate circuit for converting them a continuous signal, the outputs of the OR gate circuit become continuous so that it is necessary to divide or separate the outputs with the clock pulse TCL(having a duty of ½ for example.)

Relative Reset Control of Automatic Performance Devices

The automatic bass chord performance control device 31, the automatic rhythm performance device 342 and other automatic performance devices are associated with each other to control the start or stop of the performances. Such control is made possible by closing a synchro-start switch (not shown) of the rhythm selection switch matrix 328 shown in FIG. 16. When the synchro-start switch is closed, the selected rhythm detection unit 325 (FIG. 6) produces a synchro-start signal SSW which enables an AND gate circuit 357 via a line 356. The other inputs of the AND gate circuit 357 are connected to receive the inverted signal $\overline{OFF}$ of the automatic performance OFF signal OFF which is supplied from the function decoder 47 shown in FIG. 4 over line 358 and a signal $\overline{KO}$ obtained by inverting by an inverter 359 a depressed key signal KO generated by the AND gate circuit 86 shown in FIG. 3. Consequently, when an automatic bass chord performance is selected ($\overline{OFF}$="1") at the time of synchro-start (SSW="1"), release of all keys of the lower keyboard and the pedal keyboard (KO="0") enables the AND gate circuit 357 thereby supplying signal "1" on line 360 which turns on a field effect transistor 361 with the result that the reset signal $\overline{RC}$ becomes "0". This "0" reset signal $\overline{RS}$ is applied to the automatic rhythm performance device 342 (FIG. 2) and to other automatic performance device thus terminating the automatic rhythm performance. When the depressed key signal KO becomes "1" as a result of key depression, the output of the AND gate circuit 357 becomes "0" so that transistor 361 is turned off and the reset signal $\overline{RS}$ is inverted to "0" from "1". The automatic rhythm performance device 342 and other automatic performance devices, for example an automatic arpeggio device, detect the inversion of the reset signal $\overline{RS}$ to "1" from "0" thus starting their own automatic performance in synchronism with the starting of the automatic bass chord performance. During the performance, the automatic performance is made from its starting. This is the sychro-start.

The reset signal $\overline{RC}$ is also applied to the automatic bass chord performance control device 31 over the same line from the automatic rhythm performance device 342 and the other automatic performance devices. For example, when the automatic rhythm performance device 342 stops its automatic rhythm performance, the reset signal $\overline{RS}$ becomes "0" whereas when the automatic rhythm performance is started, the reset signal $\overline{RS}$ changes to "0" from "1".

In the automatic bass chord performance control device 31, when the reset signal $\overline{RS}$ becomes "0", the automatic performance according to the bass pattern is terminated and the progress of the bass pattern is started in synchronism with the inversion of the reset signal $\overline{RS}$.

In FIG. 6, the reset signal $\overline{RS}$ is suitably delayed by a shift register 362 which is provided for matching the timing, then inverted by an inverter 363 and applied to the all data set line 360 of the counter 337 via an OR gate circuit 364. When the reset signal $\overline{RS}$ is "0", the signal on the all data set line 365 becomes "1" and all counts $Q_1$ through $Q_5$ of the counter 337 become "1". Accordingly, even when the clock pulse TCL is supplied, the contents $Q_1$ through $Q_5$ of the counter does not vary whereby the bass pattern is not varied. The reset signal $\overline{RS}$ is also applied to one input of the AND gate circuit 355 over line 366 thus changing the output EN of the AND gate circuit to "0". Consequently, the bass pattern pulses $T_1$ through $T_{17}$ are also not produced thus stopping the automatic performance according to the bass pattern. When the signal $\overline{RS}$ changes to "1" from "0", a differentiation circuit 388 produces a single shot of a differentiated pulse which is applied to the counter 337 via OR gate circuit 339 and counted by the counter. At this time, since the signal on line 365 is "0", the contents of the counter 337 overflow to become "0". As a consequence, the bass pattern starts from the first timing (the timing of the first beat) in synchronism with the build up of the reset signal $\overline{RS}$. Signal CS applied to the other input of the OR gate circuit 364 is generated as a "1" signal when the contents of a counter (not shown) contained in the automatic rhythm performance device 342 and counting the number of basic tempo clock pulse TCL become "1", the signal CS being used to synchronize the counter 337 for the automatic bass chord performance with the counter mentioned above. When the operation enabling signal EN becomes "0", pulses $T_1$ through $T_{17}$ are inhibited but the DC like octave interval signal To is not inhibited.

Reset signal $\overline{RS_1}$ derived out on line 367 from an intermediate stage of the shift register 362 is inverted by an inverter and then applied to one input of an AND gate circuit 368. Consequently, when the reset signal $\overline{RS}$ becomes "0", the AND gate circuit 368 is enabled. So long as a key of the lower keyboard or the pedal keyboard is being depressed, the output of the AND gate circuit 357 is "0" and a signal "1" which has been inverted by a time matching delay flip-flop circuit 367 and an inverter is applied to an input of the AND gate circuit 368. Consequently, when the reset signal $\overline{RS}$ becomes "0" while a key is being depressed, the AND gate circuit 368 produces a "1" output which is applied to an OR gate circuit 370 to produce a sustained tone signal Y which is applied to one inputs of OR gate circuits 228 and 299. As a result, when the sustained tone signal Y containues its "1" state, the bass tone generating timing signal BT also becomes continuous "1" so that the bass tone generation command signal PE generated by the AND gate circuit 187 shown in FIG. 5 will be repeatedly generated in synchronism with the start code SC so long as a key of the pedal keyboard is depressed (or so long as the memory function is provided). Furthermore, the sustained tone signal Y enables AND gate circuit 300(see FIG. 4) through OR gate circuit 299 thereby passing the octave interval signal To. Accordingly, when the tone of the first beat of the bass pattern has an interval one octave above that of the root tone a tone one octave higher will be generated as the sustained tone. In other words, where the sustained tone signal Y is generated, a tone of the first beat of the bass pattern being selected at that time will be generated continously as the bass tone (pedal keyboard tone).

The sustained tone signal Y is produced as a sustained tone gate signal NG via the OR gate circuit 371 shown in FIG. 6. The sustained tone gate signal NG is a signal for generating the chord tone (lower keyboard) tone) as a sustained tone, and similar to the chord tone generation timing signal CG applied to the envelope generation circuit 33 for generating the lower keyboard tone as a sustained tone. Since the signal OFF is applied to one input of the OR gate circuit 371 after being inverted by an inverter, even when the automatic bass chord performance is terminated ($\overline{OFF}$="0"), the sustained tone gate signal NG is generated. When the automatic bass chord performance is not made, the lower keyboard tone (chord tone) is made to be a sustained tone so as to automatically prevent interruption of the rhythm.

Where the lower keyboard tone is generated by a sustained tone by the action of the sustained tone gate signal NG, it is advantageous to produce it at a somewhat lower level than in a case where the chord tone is produced in synchronism with the chord tone generation timing signal CG. By this arrangement an auditory correction is made so that the listner can hear a sustained tone and an intermittently produced chord tone at about the same level. While in this embodiment, the envelope generating circuit 33 is controlled by the chord tone generating timing signal CG and the sustained tone gate signal NG, it will be clear that the invention is not limited to this circuit connection. For example, an analogue gate circuit may be connected between the tone color circuit 37 and the second system 38 shown in FIG. 2 so as to control the analogue gate circuit by the chord tone generating timing signal CG and the sustained tone gate circuit NG only for the lower keyboard tone.

When the depressed key signal KO becomes "0" as the result of key release, the output of the AND gate circuit 357 becomes "1" (provided that the synchro-start signal SSW is "1" and the signal $\overline{OFF}$ is also "1") thereby disenabling AND gate circuit 368. As a consequence, the sustained tone signal Y disappears.

Accordingly, during the automatic bass chord performance with the synchro-start, when the reset signal becomes "0", the automatic bass performance based on the bass pattern will be determined, but so long as the key depression is continued, a sustained tone will continue to be generated.

The reset signal $\overline{RS}$ is applied to one input of an AND gate circuit 372 shown in FIG. 4 over line 366. Since the signal $\overline{OFF}$ is applied to the other input of this AND gate circuit 372, it is enabled only when the automatic bass chord performance is selected. When the reset signal $\overline{RS}$ is "0", the output of the AND gate circuit 372 is also "0" and the output of the inverter 373 is "1". This "1" signal is applied to delay flip-flop circuits 375 and 377 respectively thorugh AND gate circuits 374 and 376 and held by these delay flip-flop circuits. At this time, AND gate circuits 378 is enabled by a "0" RSC signal is produced via an inverter 379. This signal RSC is applied to one input of an AND gate circuit 380 and is utilized to control the key data selection gate circuit 233 shown in FIG. 5. When the signal RSC is "0", the output of the AND gate circuit 380 is also "0" so that the output of the inverter 232 becomes "1" thereby enabling the AND gate circuit 231. As a consequence signal "1" produced by the OR gate circuit 230 in response to the bass tone generation command signal PE or the chord tone data generation timing signal LKE is applied on the processed data selection enabling line 234.

When the reset signal $\overline{RS}$ rises to "1" from "0" the output of the AND gate circuit 372 shown in FIG. 4 becomes "1" and the differentiating circuit 381 generates a pulse at the time of build up. The output of the inverter 373 becomes "0" only during the duration of such single pulse whereby the memories of the delay flip-flop circuits 235 and 377 becomes "0". Accordingly, the AND gate circuit 378 is disenabled thus changing the signal RSC to "1". Then the AND gate circuit shown in FIG. 5 is enabled, so that when the bass tone generation command signal PE is applied to one input of the AND gate circuit 380 from the AND gate circuit 187, the output of the AND gate circuit 380 becomes "1" thus disenabling the AND gate circuit 231. Whereupon, supply of the key code data $AN_1$ through $AK_2$ of the bass tone to the channel processor 30 will be terminated.

When a first start code signal SC which is produced after the memory of the delay flip-flop circuit 375 shown in FIG. 4 has changed to "0" is supplied to one input of OR gate circuit 382 from the AND gate circuit 66 shown in FIG. 3 through line 324, the OR gate circuit 382 produces an output "1" which enables the AND gate circuit 374 (since the differentiated pulse has already been extinguished, the output of the inverter 373 is "1") thus applying signal "1" to the delay flip-flop circuit 375. One bit time later, the output of this flip-flop circuit 375 becomes "1" which is applied to one input of an AND gate circuit 376. However, since the start code signal SC has already changed to "0", this AND gate circuit 326 is not enabled so that the memory of the delay flip-flop circuit 377 remains at "0". When the next start code signal SC="1" is generated, since signal "1" is applied to one input of the AND gate circuit 376 via an OR gate circuit 383, the AND gate circuit 376 is enabled and its output "1" is stored in the delay flip-flop circuit 377. When the memories of both circuits 375 and 377 becomes "1", the AND gate circuit 378 is enabled whereby the signal RSC becomes "0". As a consequence, the AND gate circuit 380 shown in FIG. 5 in disenabled whereas the AND gate circuit 231 is enabled.

Accordingly, until the start code signal SC has been generated twice after the reset signal $\overline{RS}$ has changed to "1" from "0", the generation of the automatic bass tone is inhibited. In other words, the bass tone which was generated as a sustained tone when the reset signal $\overline{RS}$ changed to "0" is terminated in synchronism with the building up of the reset signal $\overline{RS}$ (since the signal Y becomes "0") thus enabling the automatic bass performance according to the bass pattern. But generation of the automatic bass tone is prohibited for a predetermined interval (until the start code signal SC has been generated twice after the building up of the signal $\overline{RS}$). As a consequence, termination of the sustained tone can accurately be perceived. As above described, when the same key code data is not supplied during one period of generation of the start code signal SC, since the channel processor 30 is constructed such that it judges that a key relating to the key code has been released by inhibiting the generation of the key code data $AN_1$ through $AK_2$ of the bas tone system, the channel processor 30 judges that the key of the perdal keyboard has been released thus stopping the generation of the bass tone.

As above described, when the sychro-start signal SSW is "1", the automatic rhythm, the automatic arpeggio or other automatic performances and the automatic bass chord performance exchange reset signals $\overline{RS}$ so as to synchronize the starting or stopping of the performance.

Generation of the Sustained Tone

A constant signal CON applied to the OR gate circuit 385 through lined 384 shown in FIG. 6 generates a signal "1" when the performance by a bass pattern at the time of the automatic bass chord performance is inhibited and when the bass tone (pedal keyboard tone) is generated as a sustained tone. Such constant signal CON is generated when the player manipulates a switch. When signal CON becomes "1", the sustained tone signal Y is generated through the OR gate circuits 385 and 370 so that the sustained tone signal is generated in a manner as above described.

Supoorse now that any one of the rhythms and variation bass patterns ($BV_1$ through $BV_3$) has been selected. Then at least one output line of the bass pattern designation circuit 334 will be applied with signal "1". LAs shown in FIG. 18, in the bass pattern designation circuit 334, signals of all output lines are applied to the inputs of the OR gate circuit 385 thus obtaining a bass pattern selection display signal SE. The bass pattern selection display signal SE is inverted by an inverter 387 shown in FIG. 6 and then applied to one input of the OR gate circuit 385. As a consequence, where no bass pattern is selected, the signal SE is "0" and an output "1" of the inverter 387 is applied to the OR gate circuit 385 thus generating the sustained tone signal Y. For this reason, during the automatic bass tone performance, where the player does not select any bass pattern, the sustained tone is generated.

When the sustained tone signal Y is generated by the output "1" of the OR gate circuit 385, signal MCON generated through an OR gate circuit 389 becomes "1" and this signal MCON is applied to one input of the AND gate circuit 309. The reset signal RS is applied to one input of the OR gate circuit 389 via line 366. As a consequence, when the reset signal RS is "1", the signal MCON is also "1" whereby one of the conditions that enable the AND gate circuit 309 is established. When the reset signal RS becomes "0", the signal MCON also becomes "0" so that the AND gate circuit 309 becomes disenabled thus changing the memory signal M to "0". with the result that the memory function is stopped.

When only the rhythm type is selected and the bass pattern variation ($BV_1$ through $BV_3$) is not selected, the first variation $BV_1$ will automatically be designated. The variation selection signal $BV_1$ through $BV_3$ produced by the selected rhythm detection unit 325 shown in FIG. 6 is applied to a NOR gate circuit 398. Where no variation is selected, all signals $BV_1$ through $BV_3$ are "0" and the output XX of the NOR gate circuit 398 becomes "1", which is applied to the bass pattern designation circuit 338 through an OR gate circuit 399 to act as the first variation selection signal $BV_1$. Consequently, the bass pattern (pattern pulses $T_1$ through $T_{17}$, $T_0$) of the first variation of the selected rhythm is generated by the bass pattern generating unit 41. The output signal XX of the NOR gate circuit 398 is applied to the inputs of the NOR gate circuit 216 and the OR gate circuit 299 thus disenabling respective AND gate circuits 217, 218 . . . of the bass system subordinate tone selection gate unit 129 and enabling the AND gate circuit 300. Consequently, the tone of the first beat root tone or a tone one octave higher of the bass pattern of the first variation will be generated repeatedly in accordance with the timing of generating the bass tone of that bass pattern.

Control of the Chord Tone Generation Timing

The chord tone generation timing control unit 43 shown in FIG. 7 has substantially the same construction as the bass pattern generating unit 41 shown in FIG. 6. In FIG. 7, circuit elements designated by primed reference characters 329', 330', 331', 332', 337', 338', 339', 340', 341', 355', 362', 364', 365', 384', 385', and 388', shown circuit elements designated by not-primed reference characters 329–332, 227–341, 355, 362, 363, 364, 365, 384, 385, and 388 shown in FIGS. 6 and 16 and have the same function so that the former elements will not be described.

The selected rhythm detection unit 390 has substantially the same construction as the selected rhythm detection unit 325 shown in FIGS. 16 of the bass pattern generating unit 41 except that a circuit regarding the chord pattern is not provided since it has no variation $BV_1$ through $BV_3$ at the bass pattern. The data regarding the variations $BV_1$ through $BV_3$ is contained in a bit $MP_6$ of the rhythm selection signal (see Table 7 above) and since the chord pattern does not use such data, only the data $MP_2$ through $MP_5$ is applied as the rhythm selection signal.

The chord pattern generation read only memory circuit 391 has also substantially the same construction as the bass pattern generation read only memory circuit 333 (FIG. 6 and 18), whereas the chord pattern generation read only memory circuit 391 is provided with only timing pattern memory circuit 372 and a chord pattern designation circuit 393 and not provided with any interval pattern memory circuit. More particularly, the chord pattern is required to designate the timing of the chopping of the chord so that it is not required to discriminate intervals as in the case of a bass pattern. The timing pattern memory circuit 392 and the chord pattern designation circuit 393 may be constructed by considering the same factors as in the case of the timing pattern memory circuit 335 and the bass pattern designation circuit 334 for the bass pattern but the program contents of the memory circuit 392 and 335 are not equal. Because the chord pattern generation timing and the bass pattern generation timing are different, the chord pattern memory circuit 392 stores chord patterns (the timing for chopping the chord tone) corresponding to respective rhythms.

Figure 19:
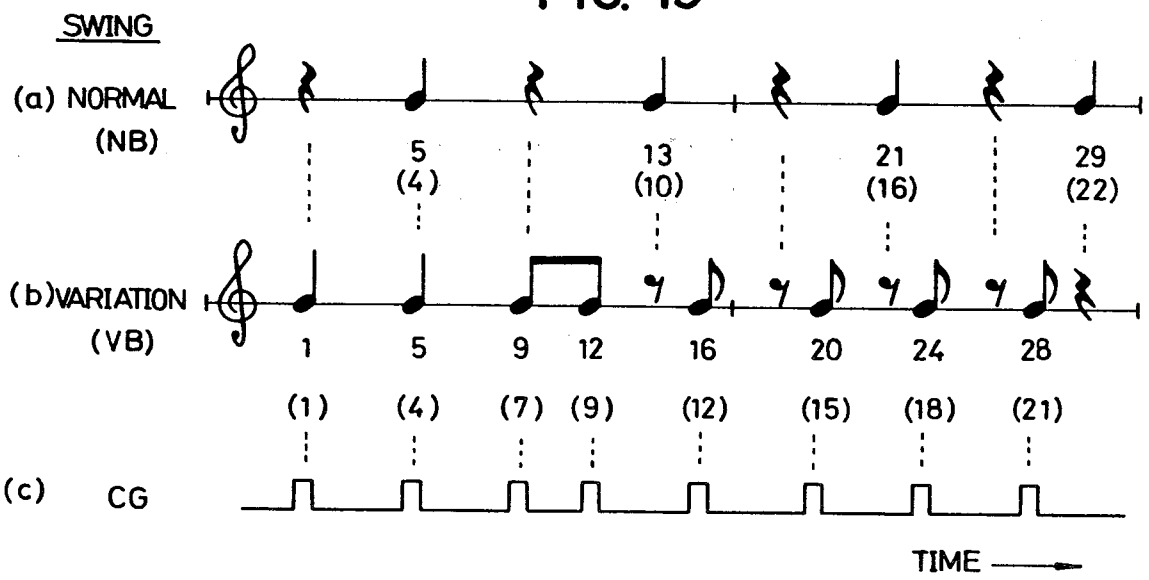

As an example, the chord pattern of swing is illustrated in FIG. 19. FIG. 19*a* shows the chord pattern of a normal mode (NB), and FIG. 19*b* shows the chord pattern of a variation mode (VB). In this manner, the pattern of either one of the normal mode NB and the variation mode $VB_1$ can be selected. If swing is selected, AND gate circuit 394 and 395 of the chord pattern designation circuit 393 are enabled so that the AND gate circuit 394 is operated by the normal selection signal NB and the AND gate circuit 395 is operated by the variation selection signal VB. Since swing contains a triplet (see FIG. 19*b*), the frequency division ratio switching signal $FD_1$ becomes "1" corresponding to the output "1" of the AND gate circuit 394 or 395 whereby the counter 337' operates as a counter of modular 24.

When a pattern shown in FIG. 19*a* is selected, a pulse is generated when the count of the counter 337' becomes binary data for decimal values 5, 12, 21 and 29 respectively in accordance with the output "1" of the AND gate circuit 394 and the pulse is applied to one input of the AND gate circuit 397 via the OR gate circuit 396. When the counter 337' acts as a counter of modulo 24, the counts 3, 7, 11, 15, 19, 23, 27 and 31 are jumped so that said pulses are generated when 4, 10, 16 and 22 pulses TCL are counted respectively.

Where the pattern shown in FIG. 19*b* is selected, the OR gate circuit 396 produces pulses when the count of the counter 337' reaches binary data for decimal 1, 5, 9, 12, 16, 20, 24 and 28 respectively. In other words, the OR gate circuit 396 produces pulses when 1, 4, 7, 9, 12, 15, 18 and 21 TCL pulses are counted.

The chord pattern pulses generated by the OR gate circuit 396 are utilized as the chord tone generating timing signals CG through the AND gate circuit 397. The other inputs of the AND gate circuit 397 are connected to receive the signal LKM from the AND gate circuit 398 shown in FIG. 3, a signal produced by inverting the initial clear signal IC, an operation enabling signal from an AND gate circuit 355' and a signal NCON obtained by inverting the output of an OR gate circuit 385'. Signal LKM is generated when the lower keyboard depressed key memory signal MLK stored in the delay flip-flop circuit 83 (FIG. 3) and the inverted signal OFF of the OFF signal OFF enable the AND gate circuit 398. As a consequence, at the time of the automatic bass chord fperformance, when the depressed key of the lower keyboard (for chords) is memorized, the signal LKM becomes "1". Signal NCON obtained by inverting the output of the OR gate circuit 385' becomes "0" when a sustained tone is produced thus inhibiting the generation of the chord tone generation timing signal CG. Instead, the sustained tone gate signal NG is produced for producing the lower keyboard tone (chord tone) as a sustained tone, as above described. The enabling signal EN is used to chop the chord tone generation timing signal CG in accordance with the basic tempo signal TCL (for example ½ duty). For instance, where the chrod pattern shown in FIG. 19*b* is selected, the chord tone generation timing signal CG is generated as shown in FIG. 19*c*.

While in the foregoing embodiment, the lower keyboard 28 was used as the chord tone performance keyboard, and the pedal keyboard 29 as the bass tone performance keyboard, it should be understood that in a keyboard type electronic musical instrument provided with a plurality of upper keyboards 27 any other suitable keyboard may be used for the automatic bass chord performance.

In the example shown in FIG. 2, the chord type of the chord tone produced by the lower keyboard 28 was used as the chord type (major, minor or seventh and so on) of the automatic bass tone for the custom function by using the chord detection output of the chord detection logic circuit 96. The invention is not limited to such operation. For example, an additional selecting means such as the chord type selection switching circuit 51 (FIG. 4) utilized for the single finger function or chord type setting means may be provided so as to apply a chord type signal by such selecting means or setting means to the chord type detection circuit 109 (FIG. 4) when the custom function is selected.

As can be noted from the foregoing description, the invention provides an improved musical instrument wherein the automatic chord tone and the automatic bass tone can be automatically controlled as desired by the player.

What is claimed is:

1. An electronic musical instrument comprising:

a first keyboard for performing chord tones;

a second keyboard for performing bass tones;

circuit means connected to said first keyboard and to said second keyboard for generating chord tone signals according to a performance on said first keyboard and bass tone signals according to a performance on said second keyboard, said bass tone signals being generated by said circuit means in response to the playing of only a single key on said second keyboard, said generated bass tone signals including a first signal defining a root note which is designated by said single key played on said second keyboard and at least one additional signal defining at least one subordinate note, each of said subordinate notes having a corresponding predetermined note interval with respect to said root note, an automatic rhythm performance circuit connected to said circuit means and automatically gating said bass tone signals in a predetermined rhythm pattern, and wherein said circuit means comprises:

a first circuit for detecting the type of chord performed on said first keyboard, and a second circuit for forming said at least one additional signal so as to define a subordinate note having a tone pitch which is shifted from that of said root note by an amount established by said chord type detected by said first circuit.

2. An electronic musical instrument according to claim 1 wherein said circuit means further includes:

a digital circuit generating digital signals representing keys under performance in numerical codes, said first circuit being responsive to said digital signals, and wherein said second circuit includes a calculation circuit for arithmetically modifying said digital signals in accordance with predetermined numerals indicative of predetermined note intervals to obtain modified numerical codes designating the subordinate notes.

3. An electronic musical instrument comprising:

a first keyboard for performing chord tones;

a second keyboard for performing bass tones;

circuit means connected to said first keyboard and to said second keyboard for generating chord tone signals according to a performance on said first keyboard and bass tone signals according to a performance on said second keyboard, said bass tone signals being generated by said circuit means in response to the playing of only a single key on said second keyboard, said generated bass tone signals including a first signal defining a root note which is designated by said single key played on said second keyboard and at least one additional signal defining at least one subordinate note, each of said subordinate notes having a corresponding predetermined note interval with respect to said root note, an automatic rhythm performance circuit connected to said circuit means and automatically gating said bass tone signals in a predetermined rhythm pattern, and a memory circuit for storing signals indicative of said performance on said first keyboard and said root note designated by said single played key on said second keyboard, said memory circuit being coupled to said circuit means and to said automatic rhythm performance circuit, and means for clearning the contents of said memory circuit when the automatic gating is ceased.

4. In a keyboard electronic musical instrument having a tone generator for producing musical tones in accordance with digital key codes supplied thereto, the improvement comprising:

a first keyboard and a second keyboard, a key coder for scanning said keyboards to detect played keys and for producing a digital key code for each played key, different portions of the key code identifying the note name and the keyboard of playing, chord detector means for identifying from the produced digital key codes that a chord has been played on said first keyboard and for determining the chord type, subordinate tone forming data generator means for forming digital codes indicative of musical intervals in accordance with the chord type determined by said chord detector means, key code processor means for arithmetically combining said interval indicative codes with the digital key code of a key played on said second keyboard to form modified key codes designating subordinate tones that are interval-related to the note corresponding to said key played on said second keyboard, and pattern generator means for gating said modified key codes to said tone generator in a selected order and with a rhythmic tempo.

5. An electronic musical instrument according to claim 4 further comprising:

chord type selection means for selecting a chord type, and single key performance mode selection means, operative when enabled and when a single key is played on said first keyboard so that said performance device does not identify a played chord and hence does not determine a chord type, for causing said data generator means to form digital codes indicative of musical intervals in accordance with the chord type selected on said chord type selection means, and for causing said processor means to combine those interval indicative codes with the digital key code of said single key played on said first keyboard to form modified key codes designating a chord having a root note corresponding to said single key played on said first keyboard and having subordinate tones that are interval-related thereto in accordance with said selected chord type.

6. An electronic musical instrument in accordance with claim 4 further comprising:

chord tone generation timing means, cooperating with said pattern generator means and with said tone generator, for causing said tone generator to produce musical tones corresponding to the chord played on said first keyboard repetitively and in synchronism with said rhythmic tempo.

7. In a keyboard musical instrument of the type wherein played keys are identified by digital key codes, each code including a portion defining the note name of the played key, the improvement comprising:

note name decoder means, connected to receive the key codes for one or more concurrently played keys and having individual outputs associated with each note name in a musical scale, for producing for each received key code a decoder output signal on the individual output associated with the note name identified by that received key code, memory means, having a storage location associated with each note name, for storing said decoder output signals in the storage locations associated with the corresponding note names, the set of stored decoder output signals thus designating the note names of all concurrently played keys, and memory scanning chord detection means, for scanning said memory means and for determining the presence therein of decoder output signals at predetermined note intervals corresponding to particular musical chord types, such presence indicating the playing of a chord of corresponding type.

8. In a keyboard musical instrument of the type wherein played keys are identified by digital key codes, each code including a portion defining the note name of the played key, the improvement comprising:

note name decoder means, connected to receive the key codes for played keys and having individual outputs associated with each note name in a musical scale, for producing for each received key code a decoder output signal on the individual output associated with the note name identified by that received key code, memory means, having a storage location associated with each note name, for storing said decoder output signals in the storage locations associated with the corresponding note names, and memory scanning chord detection means, for scanning said memory means and for determining the presence therein of decoder output signals at predetermined note intervals corresponding to particular musical chord types, such presence indicating the playing of a chord of corresponding type, and wherein:

said instrument includes a key coder means for scanning the keyboard and for producing said digital key codes sequentially, said key coder means also producing a start code signal after the keyboard has been completely scanned at least once, said memory means comprising:

a primary memory circuit into which said decoder output signals are loaded as said key coder means scans said keyboard, and a secondary memory circuit into which the contents of said primary memory circuit are transferred upon occurrence of said start code, whereby upon such transfer the secondary memory will contain decoder output signals for all played keys, said chord detection means scanning said secondary memory circuit to determine the playing of said chord.

9. The improvement of claim 8 wherein said chord detection means comprises:

a parallel input, serial shift register connected for recirculation of its contents and having a storage location corresponding to each note name in said musical scale, said register being loaded in parallel with decoder output signals from said secondary memory circuit, shifting means for shifting and recirculating the contents of said shift register at a rate that is faster than the occurrence rate of said start codes from said key coder, and logic network means connected to the storage locations of said shift register corresponding to said predetermined musical intervals, for producing an output when, during recirculation of said shift register, decoder output signals are present in the set of storage locations corresponding to the predetermined musical intervals of a particular chord type.

10. The improvement of claim 9 wherein said logic network means is configured to produce a separate output in the event that no chord is detected at the end of a complete circulation of said shift register.

11. In an electronic musical instrument in which musical notes are represented by binary note codes in a binary sequence, the improvement comprising:

subordinate tone forming data generator means for providing a set of binary codes each indicative of a certain musical interval, combining means for arithmetically combining said interval-indicative binary codes with a selected note code to produce modified note codes each representing a note shifted from the original note by the corresponding certain musical interval, bass pattern generator means for gating selected sets of said interval-indicative binary codes to said combining means for combination with said selected note code, thereby to provide a set of modified note codes in a particular bass pattern, and selecting means, cooperating with said bass pattern generator means, for selecting said sets of interval-indicative binary codes in accordance with a particular chord type so that said bass pattern harmonizes with a chord of that type.

12. A musical instrument according to claim 11 and having a first keyboard for chord selection and a second keyboard for bass note selection, said improvement further comprising:

chord detector means for detecting the type of chord played on said first keyboard, said detected chord type being provided to said means for selecting, and means for providing to said bass pattern generator means a note code corresponding to a single bass note played on said second keyboard.

13. A musical instrument according to claim 12 further comprising:

rhythm generator means, cooperating with said selecting means and with said bass pattern generator means, for selecting and gating said interval-indicative binary codes in a particular rhythmic pattern, and chord tone generator timing means, cooperating with said rhythm generation means, for controlling the repetitive production of chords played on said first keyboard in synchronism with said particular rhythmic pattern.

14. A musical instrument according to claim 11 and including:

chord type selection means for designating a chord type and for providing to said selecting means a signal indicative thereof, and keyboard means for providing to said combining means a note code indicative of a single key played thereon, this provided note code being said selected note code.

15. A musical instrument according to claim 14 and having a pedal keyboard, said keyboard means comprising the keyboard switches of said pedal keyboard.

16. In a keyboard electronic musical instrument in which each note is identified by a binary note code having a binary value, said instrument having tone generator means for producing musical tones in accordance with binary note codes supplied thereto, the improvement wherein:

said binary note codes are in a binary sequence in accordance with the note name, said instrument comprising:

subordinate note forming means for modifying the binary value of the note code of a root note to produce a modified note code having the binary value of a different note separated from said root note by a definite interval in a musical scale, said subordinate note forming means including an interval value memory circuit storing interval-indicative binary codes having values respectively corresponding to certain musical note intervals, said binary note codes and said interval-indicative binary codes being selected so that when a code indicative of a certain interval is arithmetically combined with the binary code for a particular note, the resultant modified key code thus formed will correspond to the unmodified key code for that musical note which is separated from said particular note by said certain interval, said subordinate note forming means arithmetically combining an interval-indicative binary code accessed from said memory circuit with said root note code to produce said modified note code, and timing means, cooperating with said subordinate note forming means, for changing in a preselected temporal order which interval-indicative binary codes are accessed from said memory circuit, thereby changing the amount by which said root note code binary value is modified, so that said forming means will produce at temporally spaced intervals a set of modified note codes having a selected pattern of musical intervals with respect to said root note.

17. A musical instrument according to claim 16 wherein said timing means comprises:

rythm generation means for generating a set of timing signals having a selectable temporal order corresponding to a particular musical tempo, said timing signals being supplied to said timing means to establish said preselected temporal order.

18. A musical instrument according to claim 16 wherein said instrument has a bass note selection keyboard and wherein said root code is supplied from a single key played on that keyboard.

19. A musical instrument according to claim 16 whrein said instrument has a chord selection keyboard and wherein said root note code corresponds to the root note of a chord produced in response to key selection of that keyboard.

20. A musical instrument according to claim 19 wherein a fingered chord is played on said chord selection keyboard, and wherein said instrument also includes:

a chord detector, responsive to notes played on said chord selection keyboard, for determining the root note of said fingered chord, and a note encoder, responsive to the root note determined by said chord detector, for generating a note code corresponding to said determined root note and for supplying this generated root note code to said subordinate note forming means.

21. A musical instrument according to claim 19 wherein a single note is played on said chord selection keyboard, the note code for said single played key being supplied to said subordinate note forming means as said root note code, and wherein said subordinate note forming means is used to form said produced chord.

22. A keyboard musical instrument in which each note is identified by a binary note code having a binary value, said instrument having tone generator means for producing musical tones in accordance with binary note codes supplied thereto, the improvement comprising:

subordinate note forming means for modifying the binary value of the note code of a root note to produce a modified note code having the binary value of a different note separated from said root note by a definite interval in a musical scale, timing means, cooperating with said subordinate note forming means, for changing in a preselected temporal order the amount by which said root note code binary value is modified, so that said forming means will produce at temporally spaced intervals a set of modified note codes having a selected pattern of musical intervals with respect to said root note, wherein said instrument has a chord selection keyboard, wherein said root note code corresponds to the root note of a chord produced in response to key selection of that keyboard, wherein a single note is played on said chord selection keyboard, the note code for said single played key being supplied to said subordinate note forming means as said root note code, and wherein said subordinate note forming means is used to form said produced chord, said instrument further comprising:

bass pattern timing generation means for generating a first set of timing signals having a selectable temporal order corresponding to a particular musical tempo, said first set of timing signals being supplied to said timing means to establish the preselected temporal order of a first set of modified note codes which establish a bass accompaniment pattern, and chord generation timing means for producing a second set of timing signals and for supplying these signals to said timing means in time-shared relationship with the timing signals from said bass pattern timing generation means, said forming means thereby forming a separate, second set of modified note codes which, when supplied to said tone generator means, result in chord production.

23. A musical instrument according to claim 16 wherein note codes are supplied to said tone generator means in time shared fashion, and wherein said instrument has a single finger chord capability, said instrument including a chord selection keyboard, the playing of a single key on said keyboard causing a corresponding note code to be provided to said forming means as said root note code, said timing means comprising:

means for providing a set of timing signals to said subordinate note forming means in synchronism with the time shared data rate at which note codes are provided to said tone generator means, said forming means thereby providing to said tone generator means a set of modified note codes corresponding to the notes of a chord based on the note of said single played key as a root.

24. A musical instrument according to claim 23 further comprising:

chord type selection means, cooperating with said subordinate note forming means and said timing means, for establishing the amounts by which said root note code binary value is modified in accordance with a selected chord type.

25. A musical instrument according to claim 24 wherein said chord type selection means comprises the black and white pedals of a pedal keyboard of said instrument.

26. An electronic musical instrument according to claim 4 wherein said key coder produces digital key codes that are binary coded, said key codes being in a binary sequence in accordance with the note name, and wherein said data generator means forming interval indicative codes that are binary codes having a fixed value for each certain musical interval, so that when a code indicative of a certain interval is arithmetically combined with the binary code for a particular note by said processor means, the resultant modified key code thus formed will correspond to the unmodified key code for that musical note which is separated from said particular note by said certain interval.

27. An electronic musical instrument according to claim 26 wherein said pattern generator accomplishes said gating by enabling formation of said interval-indicative digital codes by said data generator means in said selected order and rhythmic tempo.

* * * * *